US006001543A

United States Patent [19]

Asami et al.

[11] Patent Number: 6,001,543

[45] Date of Patent: Dec. 14, 1999

[54] SILVER HALIDE COLOR PHOTOGRAPHIC LIGHT-SENSITIVE MATERIAL AND METHOD FOR FORMING IMAGE

[75] Inventors: Masahiro Asami; Tetsuro Kojima, both of Kanagawa, Japan

[73] Assignee: Fuji Photo Film Co., Ltd., Kanagawa, Japan

[21] Appl. No.: 09/128,421

[22] Filed: Aug. 4, 1998

[30] Foreign Application Priority Data

Aug. 5, 1997 [JP] Japan ..... 9-223078
Jun. 11, 1998 [JP] Japan ..... 10-179686

[51] Int. Cl.[6] ..... G03C 1/035; G03C 1/34; G03C 7/32; G03C 8/40

[52] U.S. Cl. ..... 430/351; 430/203; 430/206; 430/353; 430/551; 430/567; 430/611

[58] Field of Search ..... 430/203, 206, 430/351, 353, 551, 611, 567

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/567 |
| 5,217,858 | 6/1993 | Maskasky | 430/567 |
| 5,773,560 | 6/1998 | Asami | 430/351 |

FOREIGN PATENT DOCUMENTS 0 762 201 A1 3/1997 European Pat. Off. .

*Primary Examiner*—Richard L. Schilling
*Attorney, Agent, or Firm*—Sughrue, Mion, Zinn, Macpeak & Seas, PLLC

[57] ABSTRACT

Disclosed is a novel silver halide color photographic light-sensitive material comprising a support and photographic constituent layers formed thereon, said photographic constituent layers including at least one photographic light-sensitive layer comprising light-sensitive silver halide, said silver halide color photographic light-sensitive material being capable of forming an image thereon after exposure and simple heat development thereof, wherein the light-sensitive material contains a specific compound acting as an anti-fogging agent and wherein at least one silver halide emulsion contained in the light-sensitive material is characterized in that silver halide grains of the emulsion have a silver chloride content of 50 mol % or more, the tabular grains whose principal faces are each made up of a (111) plane account for 50% or more of the total projected area of the silver halide grains of the emulsion, the tabular grains have an average thickness of 0.3 $\mu$m or less, and that the grains have an average aspect ratio of 2 to 80. Further, a method for forming an image by using the above silver halide color photographic light-sensitive material is disclosed.

16 Claims, No Drawings

SILVER HALIDE COLOR PHOTOGRAPHIC LIGHT-SENSITIVE MATERIAL AND METHOD FOR FORMING IMAGE

BACKGROUND OF THE INVENTION

1. Field of the Invention

The present invention relates to a novel silver halide color photographic light-sensitive material for recording images and to a method for forming color images using the material.

2. Description of the Related Art

Owing to the remarkable development of color photographic light-sensitive materials utilizing silver halides in recent years, high-quality color images are now easily available. For example, according to so-called ordinary color photography, color prints are obtained by taking a photograph utilizing a color negative film, processing the film, and optically printing the image information which is recorded in the processed color negative film onto color photographic printing paper. Recently, this process has made remarkable progress, and large-scale, centralized color laboratories, in which a large quantity of color prints are produced efficiently, and the so-called mini-labs which are installed in shops and are designed to use compact and simple printer-processors have spread widely. Therefore, anybody can enjoy color photography easily.

In addition, recently, a new concept, the APS system, which utilizes a color negative film capable of recording as a magnetic record a variety of information by using a support coated with a magnetic material, is being put on the market. Using this system photography is made even more enjoyable by allowing the size of the prints to be changed using information recorded at the time the photograph was taken, and by the general simplicity with which the film can be handled. Also proposed is a tool which edits or processes images by reading the image information from processed negative film by means of a simple scanner. Since these means make it possible to easily digitize high-quality image information from silver salt photographs, the enjoyment taken in conventional photography is in the process of being surpassed by a wide range of easily accessible applications.

The color photography, now in common currency, use the optical printing system using color reproduction by the subtractive color process. Generally, a color negative film comprises a transparent support and light-sensitive layers thereon utilizing silver halide emulsions as light-sensitive elements sensitive to blue, green or red wavelength regions respectively, and so-called color couplers capable of producing a yellow, magenta or cyan dye having a complementary hue of the sensitive wavelength region of each light-sensitive layer. A color negative film exposed during photography, is processed in a color developing solution containing an aromatic primary amine developing agent. At this time, the developing agent develops, i.e., reduces the exposed silver halide grains, and the oxidized form of the developing agent, which is formed concurrently with the foregoing reduction, undergoes a coupling reaction with the color coupler to form dyes. The metal silvers (developed silver) generated by the development and the unreacted silver halides are removed through a bleaching and fixing process, respectively. This creates a color image on the color negative film. Subsequently, color photographic printing paper, which comprises a reflective support and light-sensitive layers coated thereon having a combination of light-sensitive wavelength regions and hue in each layer, similar to the color negative film, is optically exposed to light through the processed color negative film, and is then subjected to the color developing, bleaching and fixing processes as in the case of the negative film to obtain a color print having a color image composed of dye images so that an original image can be reproduced. In contrast with the above-described classic methods for forming images, recently it has become possible to enhance the image quality of print by converting the image information recorded on a color negative into digital information by means of a scanner and processing the digitized information in various ways. Mini-lab systems which perform the above-described process have actually been announced.

Because of this background, there is a growing demand for the simplification of the image forming method of the color negative. The first reason for this is that expertise and skilled operation are necessary due to the requirement of strict control of the composition and the temperature of the solutions in processing baths for the above-mentioned procedure consisting of color development, bleaching and fixation. The second reason for this is that equipment to be used exclusively for the developing process is often required, due to substances, such as developing agents and bleaching agents comprising an iron chelate compound, the discharge of which is regulated from the standpoint of environmental protection. The third reason for this is that the currently available systems do not satisfactorily fulfill the requirement for rapid reproduction of recorded images. The above-mentioned processes still take time, although this time has been shortened with recent advances in technology. From this background the demand is increasing for reducing the burden on the environment by creating a system which doesn't utilize bleaching agents or color developing agents as used in current image forming systems and for thereby further improving the ease of use. In order to compete with electronic still photography and similar systems it is imperative to continue improving the ease of use of image forming methods which use processing solutions.

From these standpoints, many improved technologies have been proposed. For example, IS & T's 48th Annual Conference Proceedings, p. 180, discloses a system in which the dye formed in the developing reaction is transferred to a mordant layer and thereafter a light-sensitive material is stripped to remove the developed silver and unreacted silver halide from an image formed by the dye without the use of a bleach-fixing bath which has been indispensable to conventional color photographic processing. However, this technique cannot perfectly solve environmental problems because a developing process using a processing bath containing a developing agent is still necessary.

Fuji Photo Film Co., Ltd. has proposed Pictrography system which dispense with a processing solution containing a developing agent. In these systems, a small amount of water is supplied to a light-sensitive member containing a base precursor, and then the light-sensitive member and an image receiving member are placed face to face and heated to promote the developing reaction. This system does not use the aforementioned processing bath and, in this regard, is advantageous with respect to environmental protection. Accordingly, it is clearly conceivable that this system can be utilized for image formation in light-sensitive materials for photographic.

For example, Japanese Patent Application Laid-Open (JP-A) No. 9-10,506 and European Patent No. 762,201 describe a method whereby a color image is obtained in a light-sensitive material by a developing agent and a coupler contained in the light-sensitive material.

This Pictrography system can dispense with a developing solution, and the processing can be carried out by merely supplying a small amount of water. According to this system, the generation of a base, which is necessary for the progress of heat development, is realized by the above-described simple method. Therefore, developed silver and undeveloped silver halide remain in the light-sensitive material after the heat development. If this system is applied to a light sensitive material for photography, then, as it is necessary to obtain an extremely sharp image, various problems arise due to the necessity of using an image formed on a light sensitive material.

As is generally known, since silver halide grains have a larger refractive index compared with a binder such as gelatin, and since a silver iodobromide emulsion, which can provide high sensitivity for photography, has absorption in a blue color region, so the remaining silver halide causes significant light scattering and thus hinders the reading of the formed image. Therefore, whether to establish a method in which the silver halide grains, which are a light scattering substance, can be removed with the same simplicity as in Pictrographic heat development, or to establish a method in which the image information can be read from a light-sensitive material containing the light scattering substance at a high density, is an important subject.

From the above point of view, silver chloride has an advantageous physical properties as a silver halide in comparison with the silver iodobromide generally utilized in photographic light-sensitive materials, because the refractive index of silver chloride is small and silver chloride has little light scattering due to it having no absorption in the visible light region. In addition to the above properties, silver chloride is preferable due to its rapid fixing speed allowing the silver halide to be removed easily.

Several attempts are known to impart the required high sensitivity to photographic light-sensitive materials by using silver chloride. Although the most effective way of imparting high sensitivity is to increase the amount of light absorbed by each single silver halide grain, merely increasing the grain size is accompanied by such undesirable results as poor graininess and a decrease in the developing speed. Therefore, designing the silver halide grains with a tabular form has the advantage of increasing the area of each grain which can receive light. Examples of these attempts are described in, e.g., U.S. Pat. Nos. 4,399,215, 4,400,463 and 5,217,858, wherein the photographic emulsions comprise tabular high silver chloride grains which are each made up of a (111) plane as a principal face.

Meanwhile, U.S. Pat. Nos. 5,292,632 and 5,310,635 disclose a photographic emulsion composed of tabular high silver chloride grains which are each made up of a (100) plane as a principal face. Although silver chloride grains are known to tend to form a (100) plane as a prevailing face when growing into fine crystals, a strict control of reaction conditions is necessary for preparing tabular grains having the desired shapes and sizes while holding a (100) plane as the principal face, and therefore a simple manufacturing process is difficult to establish.

In the preparation of a practical photographic material, plural kinds of emulsions having different levels of sensitivity need to be used in order to obtain a broad latitude. When viewed from this standpoint, the use of tabular grains having a (111) plane as a principal face is desirable, because the manufacturing process of these grains is more likely to be simplified.

Based on these technologies, an attempt was made to produce tabular grains having a high silver chloride content and being made up of a (111) plane as a principal face and also being characterized by little light scattering and ease in fixing. These grains-were used for the preparation of a photographic light-sensitive material which would enable a simple heat development in the aforementioned Pictrography system. However, this attempt faced serious problems.

In a simple heat developing system suited for the purpose of the present invention, such as the Pictrography system, it is difficult to obtain the high level sensitivity required for photographic light-sensitive materials by using an emulsion having a high silver chloride content. But employment of a higher level of chemical sensitization, for obtaining a higher level of sensitivity, tends to cause serious fogging, and the creation of good discrimination is difficult. Further, it has been found that, when an emulsion having a high silver chloride content is used, the sensitivity of a light-sensitive material prepared by using a coating liquid after the passage of time tends to decrease, and the sensitivity of the light-sensitive material stored for a long time tends to decrease

SUMMARY OF THE INVENTION

As is apparent from what is described above, a first object of the present invention is to provide a light-sensitive material for photography which enables simple and rapid image formation while minimizing adverse effects on the environment, and to provide a method for forming a color image by using the light-sensitive material. More specifically, the first object of the present invention is to provide a silver halide color photographic light-sensitive material, which provides good discrimination, sufficient sensitivity and high color density as a photographic light-sensitive material, little variation of sensitivity during production, and excellent storage stability as a product, by using an emulsion composed of silver halide grains having a high silver chloride content, which have advantages that the light scattering is minimized even if a simple and rapid process such as where silver halide is not removed is employed and that fixing is easily accomplished even if a simple process is employed. Further, a second object of the present invention is to provide amethod for forming a color image by using the photographic light-sensitive material.

The above-described objectives of the present invention can be effectively achieved by the following items 1) to 8).

1) A silver halide color photographic light-sensitive material comprising a support and photographic constituent layers formed thereon, said photographic constituent layers including at least one photographic light-sensitive layer comprising light-sensitive silver halide, said silver halide color photographic light-sensitive material after exposure thereof being put together with a processing material, which comprises a support and constituent layers formed thereon including a processing layer containing at least a base and/or a base precursor, in the presence of water supplied between the light-sensitive material and the processing material in an amount ranging from 1/10 of to the equivalent of an amount which is required for the maximum swelling of the entire coating layers of these materials, so that the layers face each other, and being heated to form a color image in the light-sensitive material, wherein the light-sensitive material contains a compound represented by the following general formula [I] or [II]; at least one silver halide emulsion contained in the light-sensitive material is characterized in that silver halide grains of the emulsion have a silver chloride content of 50 mol % or more;

tabular grains whose principal faces are each made up of a (111) plane account for 50% or more of the total projected area of the silver halide grains of the emulsion;

and the tabular grains have an average grain thickness of 0.3 μm or less; and the grains have an average aspect ratio of 2 to 80:

General formula [I]

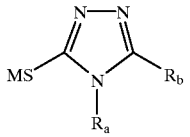

General formula [II]

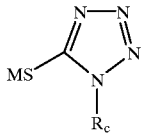

where $R_a$ and $R_b$ are each a group selected from the group consisting of an alkyl group, an alkenyl group, an aralkyl us group, an aryl group, and a heterocyclic group with the sum of the carbon atoms of $R_a$ and $R_b$ is 14 or more; M stands for a hydrogen atom, ammonium, or an alkali metal atom; and $R_c$ stands for an aryl group with the sum of the carbon atoms of $R_c$ is 10 or more.

2) In the silver halide color photographic light-sensitive material of the present invention, the average grain thickness is 0.2 μm or less.

3) In the silver halide color photographic light-sensitive material of the present invention, the average grain thickness is 0.1 μm or less.

4) In the silver halide color photographic light-sensitive material of the present invention as described in any one of items 1) to 3), the light-sensitive material comprises at least two kinds of silver halide emulsions having light-sensitivity in the same wavelength region and having different average grain projected areas, in which these emulsions are combined such that a ratio of grain numbers per unit area of an emulsion having a larger average grain projected area to the grain numbers per unit area of an emulsion having a smaller average grain projected area, both of which numbers being relative numbers which take the number of an emulsion having the smallest average grain projected area as 1, is greater than a ratio of the value obtained by dividing the coated silver amount by the $3/2^{nd}$ power of the average grain projected area of emulsion having a larger average grain projected area to that value of an emulsion having a smaller average grain projected area, both values of which are relative values which take the value of an emulsion having the smallest average grain projected area as 1.

5) In silver halide color photographic light-sensitive material of the present invention as described in any one of items 1) to 4), at least part of the grains, which constitute the silver halide emulsion, is formed in the presence of at least one of the compounds represented by the following general formula [III], [IV]or [V]:

General formula [III]

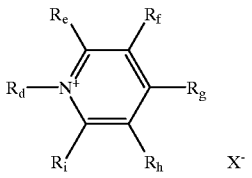

-continued

General formula [IV]

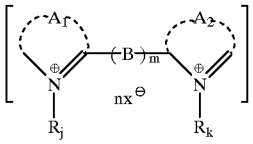

General formula [V]

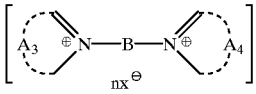

where $R_d$ is a group selected from the group consisting of an alkyl group, an alkenyl group, and an aralkyl group; $R_e$, $R_f$, $R_g$, $R_h$ and $R_i$ are each a group selected from the group consisting of a hydrogen atom and a substituent; the couples $R_e$ and $R_f$, $R_f$ and $R_g$, $R_g$ and $R_h$ as well as $R_h$ and $R_i$ each may form a condensed ring, however, provided that at least one of $R_e$, $R_f$, $R_g$, $R_h$ and $R_i$ is an aryl group; $X^-$ stands for a anion; $A_1$, $A_2$, $A_3$ and $A_4$ may be the same or different and. each represent a group of atoms forming a nitrogen-containing heterocyclic ring; B stands for a divalent linking group; m is 0 or 1; $R_j$ and $R_k$ are each an alkyl group; $X^-$ stands for an anion; and n is 0 or 1 with the proviso that n is 0 if an intramolecular salt is formed.

6) In silver halide color photographic light-sensitive material of the present invention, the light-sensitive material contains in the photographic constituent layers thereof a developing agent and a compound capable of reacting with the oxidized form of the developing agent to form a dye.

7) In silver halide color photographic light-sensitive material of the present invention, the light-sensitive material contains in the photographic constituent layers thereof at least one compound representedby the following general formula [VI], [VII], [VIII], or [IX] as a developing agent:

General formula [VI]

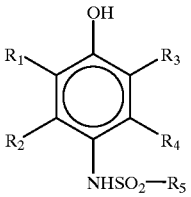

General formula [VII]

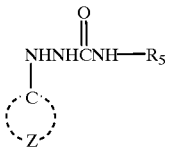

General formula [VIII]

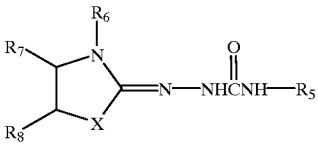

General formula [IX]

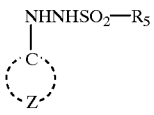

where $R_1$ to $R_4$ are each a group selected from the group consisting of a hydrogen atom, a halogen atom, an alkyl group, an aryl group, an alkylcarboxamido group, an arylcarboxamido group, an alkylsulfonamido group, an arylsulfonamido group, analkoxy group, anaryloxy group, an alkylthio group, an arylthio group, an alkylcarbamoly group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, and an acyloxy group; $R_5$ is a group selected from the group consisting of an alkyl group, an aryl group, and a heterocyclic group; Z stands for a group of atoms forming an aromatic ring or a heterocyclic aromatic ring and the total of Hammett's constants σ of the substituents is 1 or greater if Z is a benzene ring; $R_6$ stands for an alkyl group; X is a group selected from the group consisting of an oxygen atom, a sulfur atom, a selenium atom, and a trivalent nitrogen atom bearing an alkyl substituent or an aryl substituent; $R_7$ and $R_8$ are each a group selected from the group consisting of a hydrogen atom and a substituent, and $R_7$ and $R_8$ may join with each other to form a double bond or a ring; and each of the compounds represented by the general formulas [VI] to [IX] contains at least one ballast group having 8 or more carbon atoms in order to impart oil solubility to the molecule.

8) The method for forming an image according to the present invention comprises exposing a silver halide color photographic light-sensitive material described in any one of items 1) to 7) image-wise, putting the photographic light-sensitive material after image wise exposure thereof together with a processing material, which comprises a support and constituent layers formed thereon including a processing layer containing at least a base and/or a base precursor, face to face in the presence of water supplied between the light-sensitive material and the processing material in an amount ranging from 1/10 of to the equivalent of an amount which is required for the maximum swelling of the entire coating layers of these materials, and heating these materials at 60 to 100° C. for 5 to 60 seconds to form a color image in the light-sensitive material.

DESCRIPTION OF THE PREFERRED EMBODIMENTS

[Embodiments of the Invention]

Details of the present invention are described below.

The silver halide emulsion for use in the present invention is characterized in that silver halide grains of the emulsion have a silver chloride content of 50 mol % or more; that tabular grains whose principal faces are each made up of a (111) plane account for 50% or more of the total projected area of the silver halide grains of the emulsion; that the tabular grains have an average thickness of 0.3 μm or less; and that the grains have an average aspect ratio, which is defined as a ratio of the equivalent-circle diameter of the projected area of a grain to the grain thickness of 2 to 80.

According to the present invention, the silver chloride content in the silver halide grains of the silver halide emulsion is 50 mol % or more, preferably 70 mol % or more, more preferably 80 mol % or more, and most preferably 90 mol % or more. The higher the silver chloride content of silver halide grains, the lower the amount of the light scattering by the silver halide grains, and, as a result, the transparency of the photographic constituent layers containing the silver halide grains can be increased. Accordingly, as in the present invention, after development processing, the higher the content of silver chloride is preferable for reading the information of an image not having the silver halide removed.

Also, as another embodiment of the present invention, wherein the light scattering by the silver halide is reduced by a simple treatment, for example, putting together a light-sensitive material after development with a sheet, which contains a compound capable of complexing the silver halide, face to face in the presence of water, so that the silver halide is complexed, the higher the content of silver chloride, the more possible it is to increase transparency at a lower temperature and in a shorter time.

The composition other than silver chloride consist of silver bromide or silver iodide. Generally, it is difficult for an emulsion composed of silver halide grains having a high silver chloride content to impart high sensitivity as a blue-sensitive emulsion which, because the silver halide itself absorbs only a small amount of light in the visible region. Although the lack of sensitivity can also be compensated for by a technique of spectral sensitization, the lack of sensitivity can be compensated by adding silver bromide in an amount of 20 to 50 mol % and/or silver iodide in an amount of less than 10 mol % to the silver chloride. In this case, however, the silver chloride content needs to be 50 mol % or more.

The grain which constitutes the emulsion of the present invention needs to be a grain whose principal face is made up of a (111) plane in order to obtain a good sensitivity/fogging ratio even when heat development is carried out. The term "principal face" as used herein means the face of a tabular grain having the largest area. The term "(111) plane" means the plane defined by the peaks of crystal unit cell vectors a, b and c (silver halide has a rock salt crystal in which the vectors a, b and c have the same length and are at right anglse to one another). A method for producing grains whose principal faces are each made up of a (111) plane is described later.

The grain which constitutes the emulsion of the present invention is a so-called tabular grain, and has an average grain thickness of 0.3 μm or less and an average aspect ratio in the range of from 2 to 80. In order to achieve the object in the present invention, the thinner grain thickness is preferable.

The average grain thickness is preferably 0.2 μm or less, and more preferably 0.1 μm or less. If the average thickness exceeds 0.3 μm, the sensitivity/granularity ratio is reduced. As used herein, the grain thickness means the value obtained from an electron microscope photograph of the grain.

Further, the tabular grain needs to have an average aspect ratio in the range of from 2 to 80. The term "average aspect ratio" as used herein means an average of the values obtained by dividing the diameter of a circle which is equivalent to the projected area of each grain-by the thickness of the grain, and the average aspect ratio is a value indicative of the tabularity. Accordingly, when tabular grains having an average aspect ratio in the above-mentioned range are selected from the emulsion and then the average aspect ratios of these selected grains are averaged, the average of average aspect ratio obtained is preferably 5 or more, more preferably 8 or more, and most preferably 15 or more. Furthermore, when finer grains are utilized and their grain size is expressed as a sphere diameter in which the spheres have a volume equivalent to a grain volume of about 0.5 μm or less, the grain tabularity, which is expressed as a value obtained by dividing the average aspect ratio by the grain thickness, is preferably 25 or more. If the average aspect ratio is less than 2, the sensitivity/granularity ratio is reduced. On the other hand, if the average aspect ratio exceeds 80, serious fog and desensitization increase when pressure is applied to the grains.

When compared with grains having the same volume, grains having a higher aspect ratio can provide a larger projected area. Therefore, the spectral sensitization rate of the grains can be enhanced by using the tabular grains having a high aspect ratio. Further, when photographic sensitivity is proportional to the projected area of the grains, the same sensitivity can be achieved by a smaller amount of silver halide having a high aspect ratio. Although the volume of a grain of an emulsion may take different values in accordance with target sensitivities, the diameter of a sphere having a volume equivalent to that of the grain, is preferably in the range of from 0.1 to 5 $\mu$m, and more preferably in the range of from 0.2 to 3 $\mu$m. When the grain volume is kept constant, the grain thickness becomes smaller as the aspect ratio becomes larger. Accordingly, the use of tabular grains having a high aspect ratio can increase the sharpness, because the components which have larger scattering angles with respect to incident light-path decrease. On the other hand, when the projected area of the grains is kept constant and their aspect ratio increases, the number of grains, in the constant volume of grains, can increase. Accordingly, the use of tabular grains having a high aspect ratio can improve the graininess.

Among the known technologies relating to grains having a high aspect ratio, most technologies relating to color light-sensitive materials make it a prerequisite to use a color developing bath utilizing a developing solution containing an aromatic primary amine color developing agent. Therefore, these technologies do not necessarily provide the same result in the system of the light-sensitive material of the present invention where an image is formed by the heat development of the light-sensitive material containing a developing agent. Particularly, In contrast with the processing using a developing solution containing a color developing agent, the heat developing system utilizing an emulsion having a high silver chloride content, such as in the present invention, often causes serious fogging. In extreme cases, the discrimination is so poor that the color density of images is hardly distinguishable from fog.

In the system of the present invention where a light-sensitive material is put together with a processing material in the presence of a small amount of water and heat-developed, a combination of an emulsion specified in the present invention and the compound represented by the general formula [I] or [II] described hereinbefore makes it possible to create good discrimination and to obtain a high level of sensitivity and a high level of color density. In other words, the compound represented by the general formula [I] or [II] described hereinbefore can act as an effective anti-fogging agent, when the compound is combined with the silver halide emulsion specified in the present invention.

The compound represented by the general formula [I] is known as mercaptotriazole, while the compound represented by the general formula [II] is known as mercaptotetrazole. Mercaptotriazoles and mercaptotetrazoles are known to act as anti-fogging agents or as stabilizers in a photographic light-sensitive material. However, in the case of the present invention in which tabular grains, whose principal faces are each composed of a (111) plane and which have a high silver chloride content, are subjected to heat development, a mere homologous compound of the above-mentioned compounds cannot prevent fogging and enhance discrimination sufficiently. Further, although the compounds in the present invention reduce the sensitivity of a conventional color photographic light-sensitive material, they can prevent fogging and give the high sensitivity of the system of the present invention.

In order to achieve the effect of the present invention, in the general formula [I], preferably $R_a$ and $R_b$ are each a group selected from the group consisting of a substituted or unsubstituted alkyl group, a substituted or unsubstituted alkenyl group, a substituted or unsubstituted aralkyl group, a substituted or unsubstituted aryl group, and a substituted or unsubstituted heterocyclic group and the sum of carbon atoms of $R_a$ and $R_b$ is preferably 14 or more. In the general formula [II], $R_c$ is a substituted aryl group in which the sum of carbon atoms is preferably 10 or more. If the sum of carbon atoms is small, the fog preventing effect of the compound is weak, and the desensitization increase when the amount of the compound added is increased. Further, when tabular grains, whose principal faces are each composed of a (111) plane and which have a high silver chloride content, as preferably used in the present invention, are used with a so-called anti-fogging agent, which is commonly used in a photographic light-sensitive material, the grain tends to have markedly reduced sensitivity when there is an interval before the coating solution is applied during the production of the light-sensitive material or when the light-sensitive material is stored for a length of time between production and use. But the use of a compound having carbon atoms exceeding the aforementioned number makes it possible to obtain good discrimination and to inhibit the fogging of the tabular silver halide grains having a high silver chloride content in heat development, without impairing the sensitivity even if the coating liquid is applied after a period of time has elapsed or if the light-sensitive material prepared is used after long storage.

By designing the number of carbon atoms of these groups so as to fall inside the above-described range, the fact that the discrimination in heat development of the tabular silver halide grains having a high silver chloride content can be markedly improved is a novel discovery, which has never been known in the science of traditional photography.

Further details of the compounds represented by the general formula [I] or [II] are given below.

In the general formula [I], preferably $R_a$ and $R_b$ are each a group selected from the group consisting of a substituted or unsubstituted alkyl group (e.g., butyl, hexyl, octyl, decyl, or the like), a substituted or unsubstituted alkenyl group (e.g., butenyl, octenyl, or the like), a substituted or unsubstituted aralkyl group (e.g., benzyl, phenethyl, or the like), a substituted or unsubstituted aryl group (e.g., phenyl, biphenyl, amidophenyl, phenoxyphenyl, naphthyl, anthracenyl, or the like), and a substituted or unsubstituted heterocyclic group (pyridyl, thienyl, or the like), and the sum of the carbon atoms of $R_a$ and $R_b$ is 14 or more. In addition, at least one of $R_a$ and $R_b$ has at least one aromatic ring preferably. More preferably, the aromatic ring is directly linked to a triazole ring. M stands for a hydrogen atom, ammonium, or an alkali metal atom (e.g., sodium, potassium, or the like). As examples of the substituent, the substitutable groups represented by $R_e$ to $R_i$ which are described later can be included.

In the general formula [II], $R_c$ is a substituted or unsubstituted aryl group (e.g., phenyl, naphthyl, or the like). The substituent is a group selected from the group consisting of a carbamoyl group substituted by a butyl group, a pentyl group, a hexyl group, or a nonyl group, an amido group substituted by a alkyl group which was similar to the alkyl group described above, an alkyl carboxylate group, an alkyl-substituted ureido group, and the like, and the sum of carbon atoms of $R_c$ is 10 or more. Preferably, $R_c$ has an aromatic ring directly linked to a tetrazole ring. M stands for the same group as in the general formula [I].

Specific examples of these compounds (I-1~24, II-1~20) are given below. However, the compound in the present invention are not limited by these examples.
(I-1)
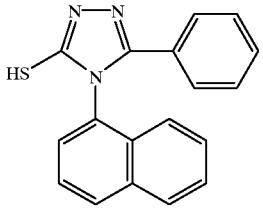
(I-2)
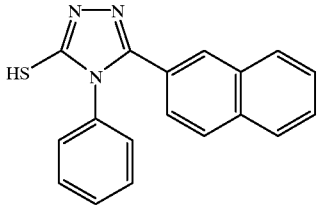
(I-3)
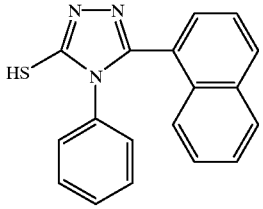
(I-4)
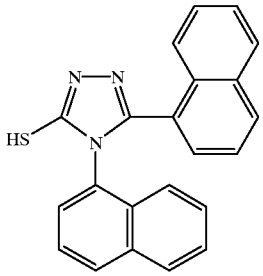
(I-5)
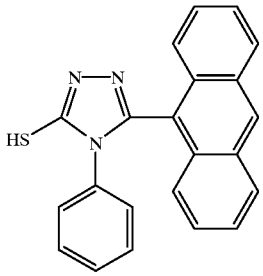
-continued
(I-6)
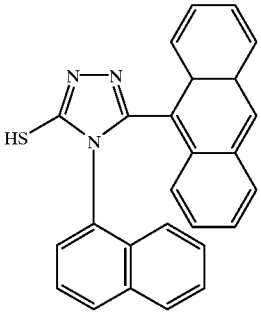
(I-7)
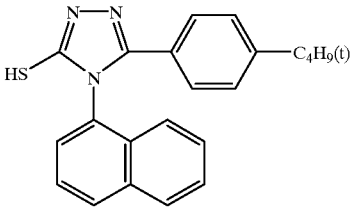
(I-8)
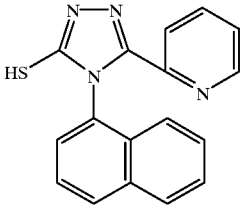
(I-9)
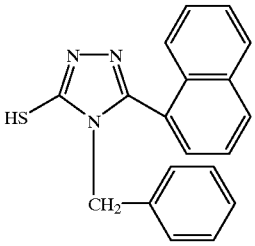
(I-10)
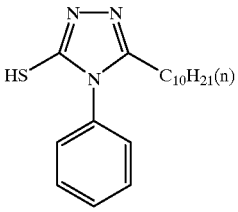
(I-11)
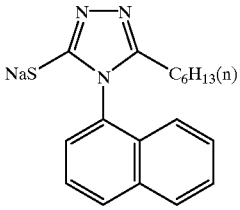

-continued
(I-12)
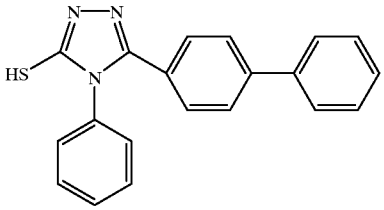
(I-13)
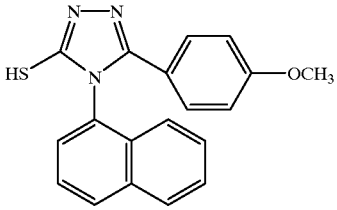
(I-14)
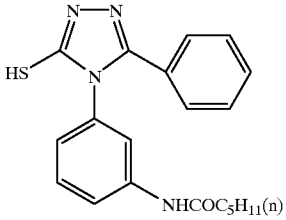
(I-15)
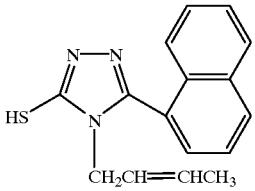
(I-16)
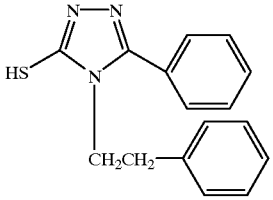
(I-17)
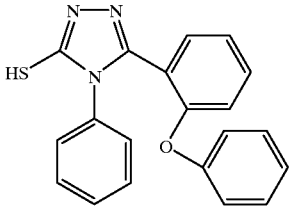
(I-18)
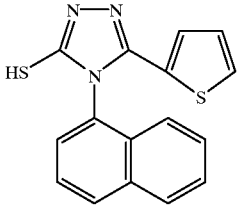
-continued
(I-19)
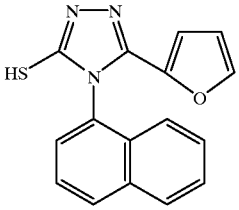
(I-20)
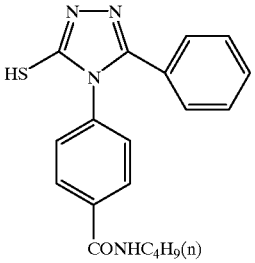
(I-21)
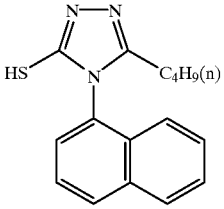
(I-22)
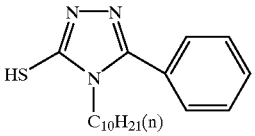
(I-23)
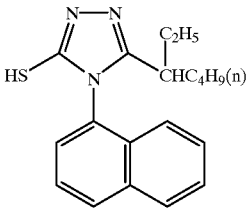
(I-24)
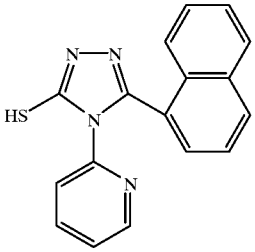
(II-1)
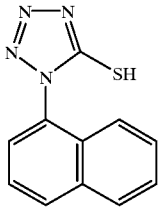

-continued
(II-1)
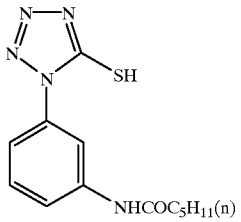
(II-3)
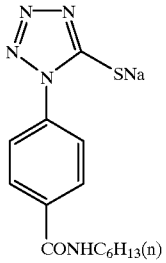
(II-4)
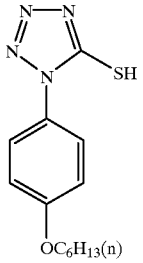
(II-5)
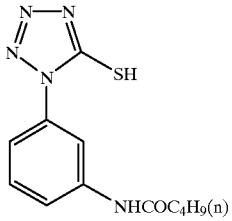
(II-6)
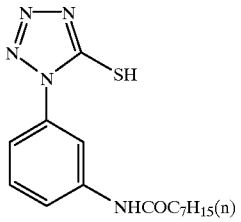
(II-7)
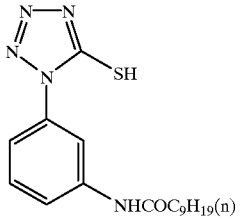
-continued
(II-8)
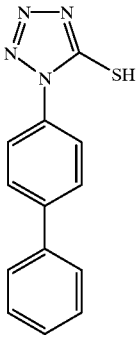
(II-9)
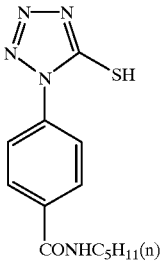
(II-10)
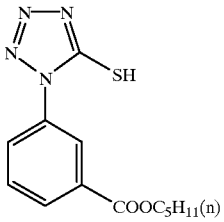
(II-11)
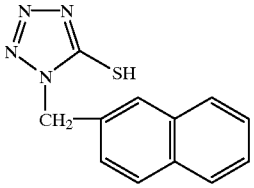
(II-12)
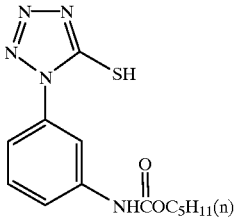
(II-13)
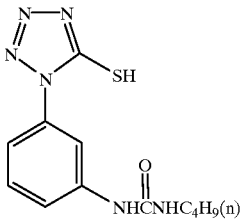

-continued (II-14)

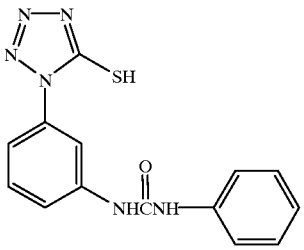

(II-15)

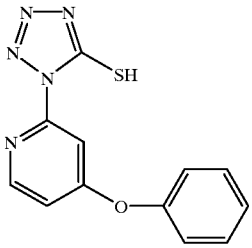

(II-16)

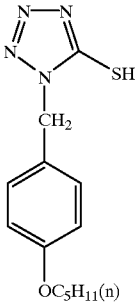

(II-17)

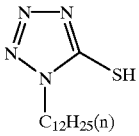

(II-18)

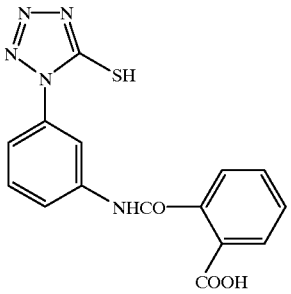

-continued (II-19)

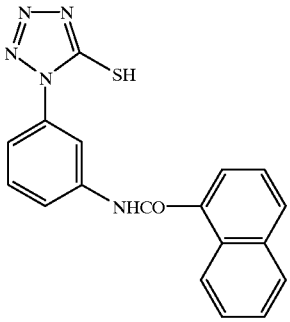

(II-20)

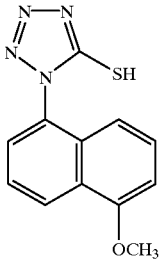

Although a variety of methods may be adopted for preparing the silver halide emulsion of the present invention, it is desirable that at least part of the grain formation be carried out in the presence of at least one of the compounds represented by the formula [III], [IV], or [V].

These compounds are a so-called crystal habit controlling agent which allows a silver halide grain having a high silver chloride content to take a (111) plane as a principal outer face while the grain is growing. Although a silver halide grain having a high content of silver chloride is generally known to take a (100) plane as a principal outer face while the grain is growing, the presence of the crystal habit controlling agent enables the grain to take a (111) plane as a principal outer face while the grain is growing.

The details of the crystal habit controlling agents represented by the formula [III] to be used in the present invention are given below.

In the aforementioned general formula [III] preferred examples of $R_d$ include a straight, branched or cyclic alkyl group having 1 to 20 carbon atoms (e.g., methyl, ethyl, isopropyl, t-butyl, n-octyl, n-decyl, n-hexyldecyl, cyclopropyl, cyclopentyl or cyclohexyl) an alkenyl group having 2 to 20 carbon atoms (e.g., an allyl, 2-butenyl or 3-pentenyl) and an aralkyl group having 7 to 20 carbon atoms (e.g., benzyl or phenethyl)

The groups represented by Rd may be substituted by a substituent, examples of which include the following substitutable groups represented by $R_e$ to $R_i$.

$R_e$, $R_f$, $R_g$, $R_h$ and $R_i$ may be the same or different and represent a hydrogen atom or a group capable of substituting with a hydrogen atom. Examples of the substitutable group include the following groups.

A halogen atom (e.g., a fluorine, chlorine or bromine atom), an alkyl group (e.g., a methyl, ethyl, n-propyl, isopropyl, t-butyl, n-octyl, cyclopentyl or cyclohexyl group), an alkenyl group (e.g., an ally, 2-butenyl or 3-pentenyl group), an alkynyl group (e.g., a propargyl or 3-pentynyl group), an aralkyl group (e.g., a benzyl or phenethyl group), an aryl group (e.g., a phenyl, naphthyl or 4-methylphenyl group), a heterocyclic group (e.g., a pyridyl, furyl, imidazolyl, piperidyl or morpholino group), an alkoxy group (e.g., a methoxy, ethoxy or butoxy group), an aryloxy group (e.g., a phenoxy or 2-naphthyloxy group), an amino group (e.g., an unsubstituted amino, or dimethylamino, ethylamino or anilino group), an acylamino group (e.g., an acetylamino or benzolyamino group), a ureido group (e.g., an unsubstituted ureido, N-methylureido or N-phenylureido group), a urethane group (e.g., a methoxycarbonylamino or phenoxycarbonylamino group), a sulphonylamino group (e.g., a methylsulphonylamino or phenylsulfonylamino group), a sulfamoyl group (such as an unsubstituted sulfamoyl, N,N-dimethylsulfamoyl or N-phenylsulfamoyl group), a carbamoly group (e.g., an unsubstituted carbamoyl, N,N-diethylcarbamoyl or N-phenylcarbamoyl group), a sulfonyl group (e.g., a mesyl and tosyl group), a sulfinyl group (e.g., a methylsulfinyl or phenylsulfinyl group), an alkyloxycarbonyl group (e.g., a methoxycarbonyl or ethoxycarbonyl group), an aryloxycarbonyl group (e.g., a phenoxycarbonyl group) an acyl group (e.g., an acetyl, benzoyl, formyl or pivalolyl group), an acyloxy group (e.g., an acetoxy or benzoyloxy group), a phosphoric acid amide group (e.g., an N,N-diethyl phosphoric acid amide group), an alkylthio group (e.g., a methylthio or ethylthio group), an arylthio group (e.g., a phenylthio group), a cyano group, a sulfo group, a carboxyl group, a hydroxyl group, a phosphono group, a nitro group, a sulfino group, an ammonio group (e.g., a trimethylammonio group), a phosphonio group and a hydrazino group. These groups may be substituted by a substituent, and, if these groups bear two or more substituents, the substituents may be the same or different.

The couples $R_e$ and $R_f$, $R_f$ and $R_g$, $R_g$ and $R_h$ as well as $R_h$ and $R_i$ may each be condensed to form a quinoline, isoquinoline or acridine ring.

$X^-$ stands for a counter anion, examples of which include a halogen ion (e.g., a chloride and bromide ion) nitrate ion, sulfate ion, p-toluenesulfonate ion and trifluoromethanesulfonate ion.

In the general formula III, preferably $R_d$ is an aralkyl group, and at least one of $R_e$, $R_f$, $R_g$, $R_h$ and $R_i$ is an aryl group. In the general formula III, more preferably $R_d$ is an aralkyl group; $R_g$ is an aryl group; and $X^-$ is a halogen ion.

Concrete examples (crystal habit controlling agents 1 to 18) of the crystal habit controlling agent represented by the general formula m to be used in the present invention are given below. However, it should be noted that these examples present no limitation whatsoever to the present invention.

crystal habit controlling agent-1

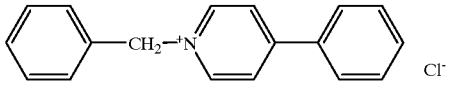

crystal habit controlling agent-2

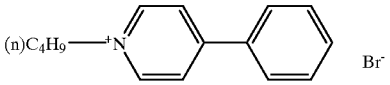

crystal habit controlling agent-3

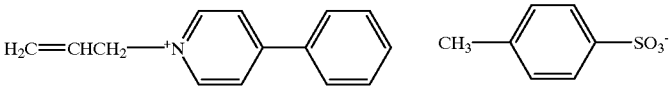

crystal habit controlling agent-4

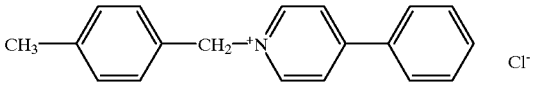

crystal habit controlling agent-5

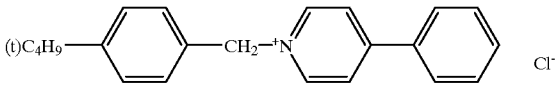

crystal habit controlling agent-6

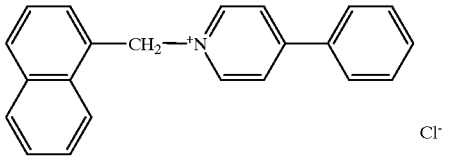

-continued
crystal habit controlling agent-7
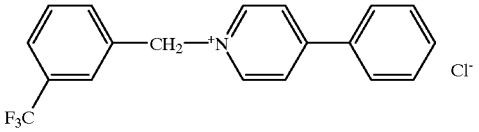
crystal habit controlling agent-8
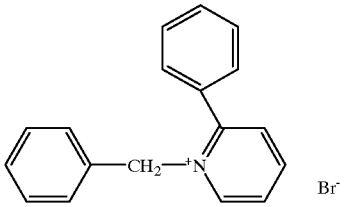
crystal habit controlling agent-9
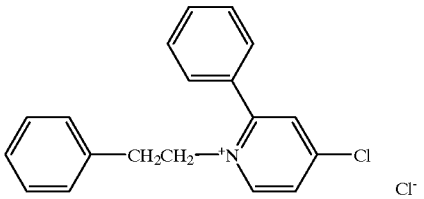
crystal habit controlling agent-10
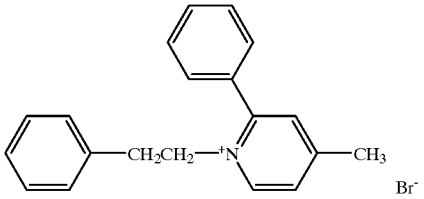
crystal habit controlling agent-11
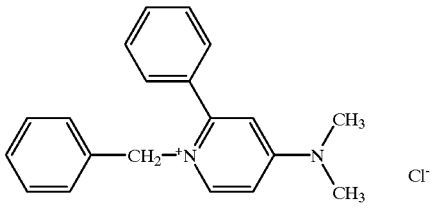
crystal habit controlling agent-12
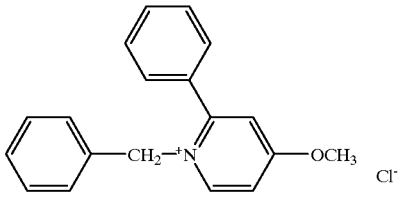
crystal habit controlling agent-13
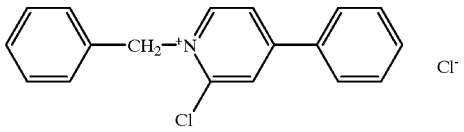

-continued crystal habit controlling agent-14

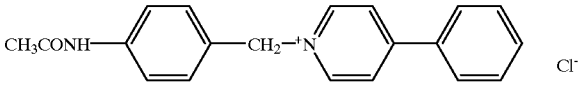

crystal habit controlling agent-15

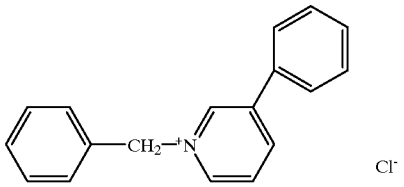

crystal habit controlling agent-16

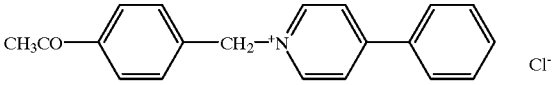

crystal habit controlling agent-17

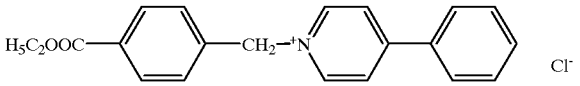

crystal habit controlling agent-18

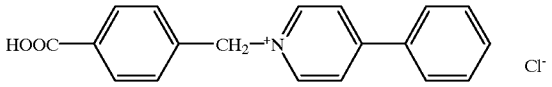

Next, the details of the crystal habit controlling agents represented by the formulas IV and V to be used in the present invention are given below.

In the general formulas IV and V, $A_1$, $A_2$, $A_3$ and $A_4$ each stands for a group of non-metallic atoms for completing a nitrogen-containing heterocyclic ring, and may contain atoms such as an oxygen, nitrogen or sulfur atom. The benzene ring may form a condensed benzene ring. The heterocyclic ring composed of $A_1$, $A_2$, $A_3$ and $A_4$ may have a substituent or substituents which may be the same or different. Examples of the substituent include an alkyl group, and aryl group, an aralkyl group, an alkenyl group, a halogen atom, an acyl group, an alkoxycarbonyl group, an aryloxycarbonyl group, a sulfo group, a carboxyl group, a hydroxyl group, an alkoxy group, an aryloxy group, an amide group, a sulfamoyl group, a carbamoyl group, an ureido group, an amino group, a sulfonyl group, a cyano group, a nitro group, a mercapto group, an alkylthio group and an arylthio group. Preferably, $A_1$, $A_2$, $A_3$ and $A_4$ are selected from 5- to 6-membered rings (e.g., pyridine, imidazole, thiazole, oxazole, pyrazine and pyrimidine rings). More preferably, $A_1$, $A_2$, $A_3$ and $A_4$ are each a pyridine ring.

B stands for a divalent linking group, which is composed singly of or a combination of the following groups, i.e., alkylene, arylene, alkenylene, —$SO_2$—, —SO—, —O—, —S—, —CO—, and —N($R_2$)—($R_2$ representsan alkyl group, an aryl group or a hydrogen atom). Preferably, B is alkylene or alkenylene.

$R_j$ and $R_k$ are each an alkyl group of from 1–20 carbon atoms, and $R_j$ and $R_k$ may be the same or different.

The alkyl group means a substituted or unsubstituted alkyl group, and the examples of the substituents are the same as those illustrated for $A_1$, $A_2$, $A_3$ and $A_4$.

Preferably, $R_j$ and $R_k$ are each an alkyl group of 4–10 carbon atoms. More preferably, $R_1$and $R_2$ are each a substituted or unsubstituted aryl-substituted alkyl group.

$X^-$ stands for an anion, examples of which include a chloride ion, a bromide ion, an iodide ion, a nitrate ion, a sulfate ion, a p-toluenesulfonate ion and an oxalate ion. n is 0 or 1 and only 0 when an intramolecular salt is formed.

Concrete examples (crystal habit controlling agents 19 to 30) of the crystal habit controlling agents represented by the aforementioned general formulas IV and V are given below. Other examples are disclosed in JP-A No. 2-32. However, it should be noted that these examples present no limitation whatsoever on the present invention.

crystal habit controlling agent-19

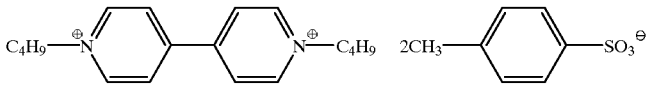

-continued
crystal habit controlling agent-20
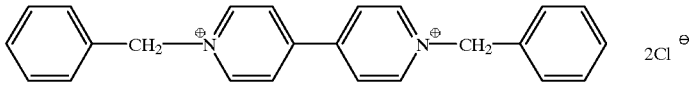
crystal habit controlling agent-21
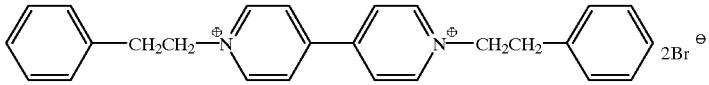
crystal habit controlling agent-22
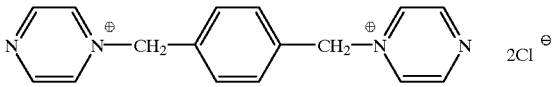
crystal habit controlling agent-23
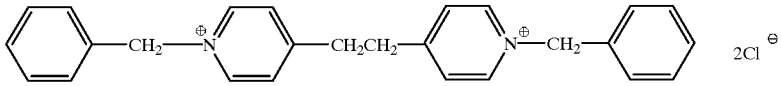
crystal habit controlling agent-24
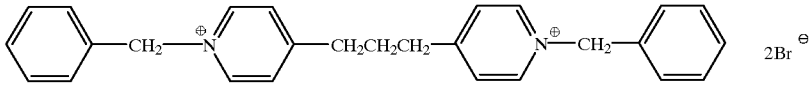
crystal habit controlling agent-25
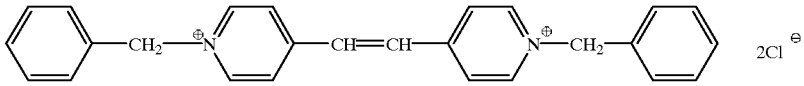
crystal habit controlling agent-26
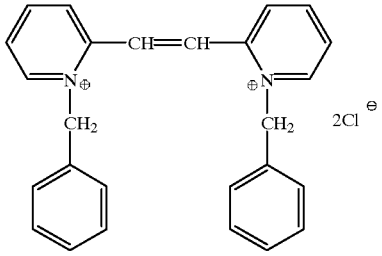
crystal habit controlling agent-27
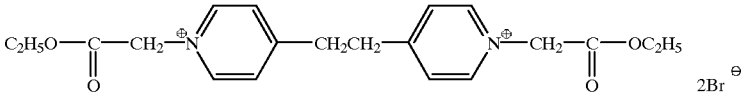
crystal habit controlling agent-28
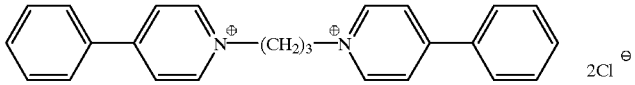
crystal habit controlling agent-29
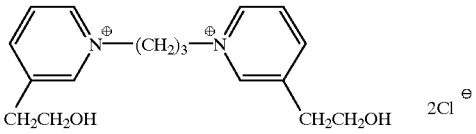

-continued crystal habit controlling agent-30

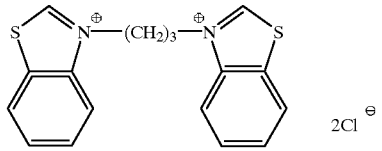

The amount of any of the crystal habit controlling agents used is preferably $6\times10^{-5}$ mol or more, and most preferably in the range of $3\times10^{-4}$ to $6\times10^{-2}$ mol per mol of silver halide in a completed emulsion.

The timing of the crystal habit controlling agent addition may be at any stage between the stage of nucleus formation and the stage of the physical development of the silver halide grains. After the addition of the crystal habit controlling agent, (111) plane growth begins. The crystal habit controlling agent may be placed in a reaction vessel in advance, or the crystal habit controlling agent may be added to the reaction vessel such that its concentration will increase as the grains grow.

In the preparation of the silver halide grains having a (111) plane, it is possible to prepare both regularly structured crystals (octahedron to tetradecahedron) and tabular grains. However, the preparation of any of the two groups separately depends mainly on the method for forming nuclei and also on the timing and amount of addition of the crystal habit controlling agent. The method for forming nuclei is described below.

(preparation of normal crystal habit grains)

It is preferable that the above-described crystal habit controlling agent be absent at the time when the nuclei are formed.

When the nuclei are formed, the chloride concentration should be 0.6 mol/l or less, preferably 0.3 mol/l or less, and most preferably 0.1 mol/l or less.

(preparation of tabular grains)

Tabular grains can be obtained by forming two parallel twin faces. Since the formation of the twin faces depends on such conditions as temperature, dispersing media (e.g., gelatin) and halogen concentrations, appropriate conditions need to be set up.

If the crystal habit controlling agent is present at the time when the nuclei are formed, the gelatin concentration is preferably 0.1 to 10%. The chloride concentration is 0.01 mol/l or more, and preferably 0.03 mol/l or more.

If the crystal habit controlling agent is not used at the time when the nuclei are formed, the gelatin concentration is 0.03 to 10%, and preferably 0.05 to 1.0%. The chloride concentration is 0.001 to 1 mol/l, and preferably 0.003 to 0.1 mol/l.

The temperature for the formation of nuclei may be any temperature between 2 and 90° C., but the temperature is preferably 5 to 80° C., more preferably 5 to 40° C.

The nuclei formed are grown in the presence of the crystal habit controlling agent by physical ripening and through the addition of a silver salt and a halide. In this case, the chloride concentration is 5 mol/l or less, and preferably 0.05 to 1 mol/l. The temperature for growing the nuclei may be any temperature between 10 and 90° C., but the temperature is preferably in the range of 30 to 80° C. If the amount of the dispersing medium employed at the time of nuclei formation becomes insufficient for the growth of the nuclei, replenishment of the medium is necessary. For this growth, it is preferable that gelatin in an amount of 10 to 60 g/l be present. The pH at the time when the nuclei are formed is optional, but preferably it is in the range of neutral to acidic.

The presence of the crystal habit controlling agent on grain surfaces after grain formation, influences adsorption of sensitizing dyes and development, etc. Therefore, it is preferable to eliminate the crystal habit controlling agent after the formation of grains. However, if the crystal habit controlling agent is eliminated, it is difficult for the silver chloride rich grains to maintain the (111) plane under ordinary conditions. Consequently, it is preferable to maintain the shape of the grains by means of substitution with sensitizing dye or a photographically useful compound. This method is described in, e.g., Japanese Patent Application Nos. 7,230,906 and 7-289,146 and U.S. Pat. Nos. 5,221,602, 5,286,452, 5,298,387, 5,298,388 and 5,176,992.

The above-mentioned method allows the crystal habit controlling agent to be desorbed from the grains, and the desorbed crystal habit controlling agent is preferably removed from the emulsion by means of water washing. The temperature for water washing may be a temperature which does not cause coagulation of the gelatin conventionally employed as a protective colloid. The method for water washing may be a known technique such as a flocculation method or ultrafiltration. If apyridinium salt is used as the crystal habit controlling agent, the temperature for water washing is preferably 40° C. or higher, and most preferably 50° C. or higher. If a flocculation method is used, it is necessary to use a flocculant, examples of which include a sulfonic acid group-bearing flocculant and a carboxylic acid group-bearing flocculant. The pyridinium salt crystal habit controlling agent is difficult to remove by the water washing treatment, because it strongly interacts with the sulfonic acid group of the flocculant to form a salt even after the desorption from the grains. Therefore, it is preferable to use the carboxylic acid group-bearing flocculant. Examples of the carboxylic acid group-bearing flocculant are disclosed in British Patent No. 648,472.

A lower pH value accelerates the desorption of the crystal habit controlling agent from the grains. Therefore, the use of a lower pH in the water washing stage is preferred so long as the grains are not excessively flocculated.

The silver halide grain, which constitutes the silver halide emulsion of the present invention, can have various structures in order to impart high sensitivity to the emulsion.

One preferred example is a method in which the grains are made so that a plurality of layers each having a different halogen composition are formed. According to the present invention, a plurality of laminated layers can be formed concentrically by varying the halogen composition during the process in which tabular grains are formed. For example, the grain takes a structure such that the center is a core having a high silver iodide content and the core is covered with a shell having a low silver iodide content. Conversely, the grain takes a structure such that the center is a core having a high silver chloride content and the core is covered with a shell having a high silver bromide content. Also a method in which the core is covered with a plurality of shells is possible. By this method, it is possible to form regions which have a high silver bromide content or a low silver bromide content, in the shape of doughnut. When the grain has a high silver chloride content as in the present invention, the incorporation of a trace amount of iodine can markedly change the physical characteristics of the silver halide crystal, such as ionic conductivity. Because of this, it is a preferred and often conducted practice to incorporate iodine in a certain concentration into the core or the shell. The content ratio of silver bromide or the silver iodide can be changed at will in so far as the purpose of the present invention is not impaired and in so far as the silver chloride content of the grain is not lowered below 50%. In the present invention, it is also desirable to place a layer having a high silver bromide content or having silver iodide on the outer periphery of the tabular grain, or to place a layer having a high silver bromide content or having a silver iodide as an intermediate shell. A dislocation line which is based on a crystalline disorder is formed on the shell (corresponding to the fringe part of the outer periphery in a tabular grain) which is deposited on the layer having a high silver bromide content or a high iodine content, and contributes to the high sensitivity.

In order to introduce silver iodide into the grain, it is also preferable to add an aqueous solution containing a water-soluble iodide such as potassium iodide to the emulsion. The timing to add the water-soluble iodide may be at any point in the period between the grain formation-and the preparation of a coating liquid. A desirable point is one of the following: a stage of grain formation after grain formation is 50% completed, a stage immediately after grain formation, a stage before the addition of a sensitizing dye, a stage after the addition of a sensitizing dye, and a stage before chemical sensitization.

Also, it is preferable to form the grain of silver iodide by using an organic compound, such as sodium p-iodo-acetamidobenzenesulfonate, which is capable of generating iodide ions as a result of a reaction with a base, a sulfite, or the like in the emulsion.

Although the amount of these iodides added may vary markedly depending on such factors as grain size, the type of spectral sensitizing dye employed, and the target photographic characteristics, the amount is preferably in the range of from 0.01 to 10 mol %.

Further, it is also desirable to form on the surface of the tabular grains at least one protruding portion composed of silver halide which is epitaxially joined. Because the protruding portion is composed of silver halide, the crystal form of the protruding portion is made up of rock salt crystals which have a face-centered cubic form and their form is identical to that of the host grain. However, since the halogen composition of the protruding portion differs from that of the host grain, an epitaxially joined part is formed, and contributes to the enhancement of sensitivity.

The control of the halogen composition of the protrusion formed by epitaxial growth is carried out by varying the type of halide ions which are supplied or which exist when the protrusion formed by epitaxial growth is deposited on the host grain. For example, the silver iodide content of the protrusion formed by epitaxial growth can be increased by the addition of iodide ions prior to the deposition of the the protrusion formed by epitaxial growth, and/or by the presence of iodide ions in an aqueous solution of an alkali halide which is supplied together with a solution of a silver salt. Alternatively, an the protrusion formed by epitaxial growth having a desired composition can be formed by the addition of fine crystalline silver halide having a controlled composition into the system.

Although the size of the the protrusion formed by epitaxial growth may vary depending on the shapes or halogen composition of a host grain, it is preferably 0.3 to 50 mol %, more preferably 0.3 to 25 mol %, and most preferably 0.5 to 15 mol % based on the amount of silver of the host grain. The position where the the protrusion formed by epitaxial growth is formed is preferably limited to the edges or corners of a tabular grain. That is, the area occupied by the the protrusion formed by epitaxial growth is preferably 1 to 50%, more preferably 1 to 40%, and most preferably 1 to 30% based on the surface area of the grain.

In order to control the position where the protrusion formed by epitaxial growth is deposited, it is a preferable practice to add an adsorption material, which can act as a site director, prior to the formation of the protrusion formed by epitaxial growth. Preferred examples of the adsorption material include a cyanine dye and a merocyanine dye. The position where the protrusion formed by epitaxial growth is formed and the area which is occupied by the protrusion formed by epitaxial growth can be controlled by controlling the amount added of the above-mentioned dye. In addition to these dyes, a heterocyclic compound containing nitrogen, such as aminoazaindene, can also be used as a site director. If these compounds are used, a method disclosed in U.S. Pat. No. 4,435,501 may be referred to.

It is a preferable practice to incorporate a metallic complex into the protrusion formed by epitaxial growth. The term "metallic complex" as used herein means a complex ion in which halogenide ions, cyanide ions, or the like are coordinated around an ion of a transition metal.

Among these metallic complexes, a desirable metallic complex for use is the one which provides a transient shallow electron trap at the time of exposure to light. Whether or not a metallic complex in the protrusion formed by epitaxial growth acts as a transient shallow electron trap can be examined by measuring the life of the photoelectrons generated when a test piece, which is coated with a silver halide emulsion having grains in which metallic complexes are comprised in the protrusion formed by epitaxial growth, is irradiated with laser pulse light by way of microwave absorption. If the life of the photoelectrons generated by the irradiation with laser pulse light is extended by the incorporation of a metallic complex into the silver halide grains, the metallic complex is judged to have acted as a transient shallow electron trap. If the life of the photoelectrons becomes very short due to, for example, many electron traps introduced in the stage of the preparation of silver halide grains and therefore the measurement of the length of life is difficult, the measurement can be facilitated by cooling the test piece.

Another method which serves this purpose is the method for measuring the depth of an electron trap by a dynamic measurement using ESR which is described by R. S. Eachus, R. E. Grave, and M. T. Olm in Phys. Stat. Sol(b), vol. 88, p. 705 (1978). According to the depth of electron trap obtained by this method, the metallic complex which provides a transient shallow electron trap at the time of exposure to light as mentioned herein is a metallic complex which provide a trap having 0.2 eV or less, and preferably a trap having 0.1 eV or less.

The metallic complex which is suited for use in the present invention and acts as a transient shallow electron trap at the time of exposure to light, is a complex in which a metal ion, belonging to the first, second, or third transition series, coordinated to together with a ligand, which is capable of markedly splitting a d orbit on a spectrochemical series, such as a cyanide ion, and the like. These complexes are preferably 6-coordinate complex which comprises 6 ligands coordinated in an octahedral shape, and the number of cyan ligands is 4 or more.

Examples of the central transition metal include iron, cobalt, ruthenium, rhenium, osmium, and iridium.

If none of the 6 ligands around the metal ion are cyan ligands, the rest of the ligands may be selected from the group consisting of halide ions such as fluoride ions, chloride ions and bromide ions, inorganic ligands such as ligands of SCN, NCS and $H_2O$, and organic ligands such as ligands of pyridine, phenanthroline, imidazole, and pyrazole.

It is desirable that the emulsion of the present invention contain a metallic complex which provides a deep electron trap at the time of exposure to light together with the metallic complex which provides a transient shallow electron trap at the time of exposure to light. Whether or not a metallic complex acts as a deep electron trap can be known by the aforementioned measuring of the life of the photoelectron to examine whether or not the photoelectron is shortened by the introduction of the metallic complex.

According to the depth of the electron trap obtained by the ESR measurement, a metallic complex which provides a trap having 0.35 eV or more is preferable.

Examples of the metallic complex which provides a deep electron trap at the time of exposure to light include ruthenium, rhodium, palladium, or iridium having halide ions or thiocyanate ions as ligands, ruthenium having one or more nitrosyl ligands, and chromium having cyanide ions as ligands.

In the silver halide emulsion of the present invention, the amount of the metallic complex doped into the silver halide grains is generally in the range of from $10^{-9}$ to $10^{-2}$ mol per mol of silver halide. More specifically, a metallic complex which provides a transient shallow electron trap at the time of exposure to light is used preferably in the range of from $10^{-6}$ to $10^{-2}$ mol per mol of silver halide, while a metallic complex which provides a deep electron trap at the time of exposure to light is used preferably in the range of from $10^{-9}$ to $10^{-5}$ mol per mol of silver halide.

The position where the metallic complex is doped may vary. That is, the metallic complex may be doped uniformly into the silver halide grain, or alternatively, the metallic complex may be localized in a region inside the grain or on the surface of the grain. Further, the metallic complex may be doped into the subsurface region which is very shallow from the surface of the grain. Furthermore, when the interior of the grain is structured as described later, it is a preferable practice to dope a different metallic complex into a region having a different composition. For example, suitable methods in this regard include a method in which hexacyanoferrate (II) ions are doped into a region having a high silver chloride content while hexachloroiridate (III) ions are doped into an epitaxial crystal region having a high silver bromide content, a method in which the doping with the metallic complex centers on dislocation regions which are introduced into the interior of a silver iodobromide tabular grain in a controlled manner, and a method in which hexachloroiridate (IV) ions are doped into silver iodobromide base grains while hexacyanoruthenate (II) ions are doped into corners of hexagonal tabular grains to deposit epitaxial crystals having a high silver chloride content.

For the purpose of doping these metallic complexes into silver halide grains, a variety of methods can be employed appropriately. Examples of these methods include a method in which a metallic complex is dissolved in a reaction solution which is used in grain formation, such as an aqueous solution of an alkali halide so that the metallic complex is introduced into the grains, and a method in which a solution of a metallic complex is added into a reaction vessel, in which grains are being formed, so that the metallic complex is introduced into the grains.

Although silver halide grains having various shapes can be used in the present invention, the size distribution of these grains is preferably a monodispersion so as to impart uniform functions to the grains (excluding fogging grains and dead grains). For evaluating the grain size of the monodispersion, a so-called coefficient of variation can be used, which is obtained by dividing the statistically obtained standard deviation of the grain sizes by the average grain size. In the case of the silver halide emulsion suited for use in the present invention, the coefficient of variation is preferably 40% or less, more preferably 30% or less, and most preferably 20% or less.

Further, since the silver halide grains for use in the present invention are tabular, it is preferable that the variation coefficient for the distribution of average thicknesses likewise be small. Also, the coefficient of variation is preferably 40% or less, more preferably 30% or less, and most preferably 20% or less.

Among the tabular grains, in the case of grains whose principal outer faces are each made up of a (111) plane, a plurality of twin faces are present inside the grain. Although the distance between the twin faces may vary depending on average grain thickness, the distance is preferably 0.2 $\mu$m or less, more preferably 0.15 $\mu$m or less, and most preferably 0.10 $\mu$m or less, in the case where grains having a high aspect ratio are used. Also, it is preferable that the variation coefficient for the distances between the twin faces be small. The variation coefficient is preferably 40% or less, more preferably 30% or less, and most preferably 20% or less.

Besides the aforementioned metal oxide, it is also a preferable practice to use as a dopant a divalent anion of a so-called chalcogen element such as sulfur, selenium or tellurium. These dopants are also effective in obtaining a high sensitivity level of silver halides and improving their dependence on exposure conditions.

For other conditions for the preparation of silver halide grains, reference can be made, for example, to P. Glafkides, Chimie et Phisique Photographique, Paul Montel, 1967; G. F. Duffin, Photographic Emulsion Chemistry, Focal Press, 1966; and V. L. Zelikman et al., Making and Coating of Photographic Emulsion, Focal Press, 1964. That is, the preparation can be performed in any of pH regions selected from an acidic method, a neutral method and an ammonia method. Further, any method selected from a single jet method, a double jet method and a combination thereof may be used as a method for supplying reaction solutions of a water-soluble silver salt and a water-soluble halogen salt. It is also preferable to employ a controlled double jet method whereby the addition of reaction solutions is controlled in order that the pAg is maintained at a target value during the reaction. Further, a method whereby the pH during the reaction is maintained at a constant value is also employed. When the grains are formed, although the solubility of silver halide can be controlled by varying the temperature, pH or pAg of the system, a thioether, a thiourea or a rhodanate can be used as a solvent. These examples are described in, for example, JP-B No. 47-11,386 and JP-A No. 53-144,319.

In the present invention, silver halide grains are usually prepared by supplying a solution of a water-soluble silver salt such as silver nitrate and a solution of a water-soluble halogen salt such as an alkali halide into a solution containing a water-soluble binder such as gelatin dissolved therein in a controlled condition.

The gelatin, which is used during grain formation, has a significant influence on the formation of tabular silver halide grains having a high aspect ratio which are used in the present invention. The use of gelatin having a small methionine content is desirable for the formation of tabular grains having a small average grain thickness. For the purpose of reducing the methionine content of the gelatin, it is preferable to oxidize the gelatin by use of, for example, hydrogen peroxide. Further, it is also possible to modify the amino group in the gelatin with a compound having a carboxyl group. Preferred examples of the compound as a treating agent include phthalic acid, succinic acid, trimellitic acid, and pyromellitic acid.

After the formation of the silver halide grains, excess of the water soluble salts is preferably removed. This operation is called a desalting or water-washing process, and a variety of means are employed for the process. One example is a noodle washing process comprising gelling a gelatin solution containing silver halide grains, cutting the gelled substance into the form of strings and then washing away the water-soluble salts from the strings with cold water. Another example is a precipitation process comprising coagulating the gelatin by adding to the solution a compound such as an inorganic salt comprising a polyvalent anion (e.g., sodium sulfate), an anionic surfactant, an anionic polymer (e.g., polystyrenesulfonic acid sodium salt) or a gelatin derivative (e.g., aliphatic-acylated gelatin, aromatic-acylated gelatin and aromatic-carbamoylated gelatin), and thereafter removing the excess salts. The precipitation process is preferable, because the excess salts are rapidly removed.

Normally, a chemically sensitized silver halide emulsion is preferably used in the present invention. The chemical sensitization imparts a high sensitivity level to the silver halide grains prepared and contributes to the stability of the silver halide emulsion to exposure conditions and storage conditions. The chemical sensitization can be performed by any one of the generally known methods or by a combination of them.

As a chemically sensitizing process, preferably employed is a method utilizing chalcogen such as a sulfur compound, a selenium or a tellurium compound. When added to a silver halide emulsion, these sensitizers release the chalcogen element to form a silver chalcogenide with the silver halide. Use of a combination of these sensitizers is also preferable from the viewpoint of achieving a high sensitivity level and reducing fog.

Also preferable is a sensitizing method by means of a noble metal, such as gold, platinum or iridium. In particular, a gold-sensitizing method, which uses chloroauric acid singly or in combination with a compound capable of becoming a ligand of gold, such as thiocyanate ion, brings about a high sensitivity level. A combination of the gold-sensitizing method and a chalcogen-sensitizing method brings about a further higher sensitivity level.

A yet another preferable method is a reductive method in which, in the grain forming stage, a compound having an appropriate reductive capability is used to introduce reductive nuclei into the grain so that a high sensitivity level is obtained. Also preferable is a reductive sensitization in which an alkynylamine having an aromatic ring is added to a silver halide emulsion at the time of chemical sensitization thereof.

When a chemical sensitizing process is carried out, it is also preferable to control the reactivity of silver halide grains by use of a compound capable of being adsorbed on the silver halide grain. It is particularly preferable to add a nitrogen-containing heterocyclic compound or a mercapto compound and a sensitizing dye such as a cyanine dye or a merocyanine dye prior to a chalcogen-sensitizing or gold-sensitizing process.

Although conditions for a chemical sensitization vary depending on the silver halide grain size, the structure, and the used sensitizing agent, the temperature is in the range of 30 to 95° C. and preferably in the range of 40 to 75° C., the pH is in the range of 5.0 to 11.0 and preferably in the range of 5.5 to 8.5, and the pAg is in the range of 6.0 to 10.5 and preferably in the range of 6.5 to 9.8.

The techniques concerning chemical sensitization are described in, for example, JP-A Nos. 3-110,555, 4-75,798, 62-253,159, 5-45,833 and 62-40,446.

In these chemical sensitization stages, it is also preferable to form the protrusion formed by epitaxial growth so that high sensitivity and high contrast are obtained.

In the present invention, a silver halide emulsion preferably undergoes a so-called spectral sensitization process which makes the silver halide emulsion sensitive to light in a desired region of wavelength. In particular, a color light-sensitive material comprises light-sensitive layers sensitive to blue, green and red, respectively, so the color reproduction is carried out well in conformity to an original. In order to impart the above-mentioned color-sensitivity to a silver halide silver halide emulsion, the silver halide emulsion is spectrally sensitized. For the purpose of the spectral sensitization, a so-called spectrally sensitizing dye is used so that this dye is adsorbed on the silver halide particle to make the silver halide grain sensitive to the region of wavelength corresponding to the region of absorption wavelength of the dye.

Examples of employable dyes include cyanine dyes, merocyanine dyes, complex cyanine dyes, complex merocyanine dyes, holopolar cyanine dyes, hemicyanine dyes, styryl dyes and hemioxonol dyes. Examples of these sensitizing dyes are disclosed in, for example, U.S. Pat. No. 4,617,257 and JP-A Nos. 59-180,550, 64-13,546, 5-45,828 and 5-45,834.

Although these sensitizing dyes may be used alone, they may also be used in a combination thereof. A combination of these sensitizing dyes is used for the adjustment of distribution in wavelength of spectral sensitization or for supersensitization. By the use of a combination of dyes exhibiting a supersensitization effect, it is possible to obtain sensitivity far greater than the sum of sensitivity obtainable by the use of a single dye.

The light-sensitive silver halide emulsion in the present invention preferably contain a compound which is a dye having no spectral sensitization effect itself or a compound substantially incapable of absorbing visible light but which exhibits a supersensitizing effect. Examples of the compound which exhibits the supersensitizing effect include a diaminostilbene compound. Examples of these compounds are described in U.S. Pat. No. 3,615,641 and JP-A No. 63-23,145.

These spectrally sensitizing dyes or supersensitizing dyes can be added to the silver halide emulsion at any stage of the preparation of the emulsion. There are a variety of methods, for examples, a method in which the addition is performed when a coating solution is prepared from an emulsion after the chemical sensitization thereof, a method in which the addition is performed upon the completion of the chemical sensitization of the emulsion, a method in which the addition is performed during the chemical sensitization of the emulsion, a method in which the addition is performed before the chemical sensitization of the emulsion, a method in which the addition is performed after the grain formation but before desalting, a method in which the addition is performed during the process for grain formation, and a method in which the addition is performed before grain formation. These methods may be employed alone, or a combination of these methods may be employed.

In the present invention, when a crystal habit controlling agent is used in tabular grain formation, it is preferable to add a spectral sensitizing dye after the grain formation so that the crystal habit controlling agent is exchanged by the dye for adsorption, and to remove the crystal habit controlling agent in a following desalting stage. Also, it is preferable to add the spectral sensitizing dye in various steps and at a plurality of times, by dividing the total amount of the spectral sensitizing dye into portions. Particularly, the addition of 10% or more of the total amount at a stage before the chemical sensitization is desirable from the standpoint of obtaining high sensitivity.

The amounts added of the spectral sensitizing dye and supersensitizing dye differ depending on the form and size of the grains, and on the photographic characteristics to be imparted, however, in general, the amounts range from $10^{-8}$ to $10^{-1}$ mol, and preferably from $10^{-5}$ to $10^{-2}$ mol per one mol of silver halide. These compounds can be added in the form of a solution in an organic solvent such as methanol, fluorinated alcohol and the like, or in the form of a dispersion in water together with a surfactant and gelatin.

The spectral sensitizing dye in the present invention is preferably used as a site director when a protrusion that is formed by epitaxial growth is formed.

These compounds represented by the general formula I or II and other anti-fogging agents or stabilizers can be added to the silver halide emulsion at any stage of the preparation of the emulsion. There are a variety of methods, for examples, a method in which the addition is performed when a coating solution is prepared from an emulsion after the chemical sensitization thereof, a method in which the addition is performed upon the completion of the chemical sensitization of the emulsion, a method in which the addition is performed during the chemical sensitization of the emulsion, a method in which the addition is performed before the chemical sensitization of the emulsion, a method in which the addition is performed after the grain formation but before desalting, a method in which the addition is performed during the process for grain formation, and a method in which the addition is performed before grain formation. These methods may be employed alone, or a combination of these methods may be employed.

The amount of the general formula I or II and other anti-fogging agents or stabilizers to be added varies depending on the halogen composition of the silver halide emulsion and purpose but it is generally in the range of $10^{-6}$ to $10^{-1}$ mol and preferably in the range of $10^{-5}$ to $10^{-2}$ mol per mol of silver halide.

The photographic additives described above which are used in the light-sensitive material of the present invention are described in the Journal of Research Disclosure (hereinafter abbreviated as RD) Nos. 17,643 (December, 1978), 18,716 (November, 1979) and 307,105 (November, 1989). The following table shows the additives together with relevant references.

| | Additives | RD17,643 | RD18,716 | RD307,105 |
|---|---|---|---|---|
| 1. | Chemical sensitizers | page 23 | page 648, right column | page 866 |
| 2. | Sensitivity increasing agents | | page 648, right column | |
| 3. | Spectral sensitizers, Super-sensitizers | pages 23–24 | page 648, right column to page 649, right column | pages 866–868 |
| 4. | Brighteners | page 24 | page 648, right column | page 868 |
| 5. | Anti-fogging agents, Stabilizers | pages 24–26 | page 649, right column | pages 868–870 |
| 6. | Light absorbents, Filter dyes, Ultraviolet absorbents | pages 25–26 | page 649, right column to page 650, left column | page 873 |
| 7. | Dye image stabilizers | page 25 | page 650, left column | page 872 |
| 8. | Gelatin hardeners | page 26 | page 651, left column | pages 874–875 |
| 9. | Binders | page 26 | page 651, left column | pages 873–874 |
| 10. | Plasticizers, lubricants | page 27 | page 650, right column | page 876 |
| 11. | Coating aids, Surfactants | pages 26–27 | page 650, right column | pages 875–876 |
| | Antistatic agents | page 27 | page 650, right column | pages 876–877 |
| 13. | Matting agents | | | pages 878–879 |

Besides the compounds represented by the general formula I or II, in order to prevent the fogging or to improve the storage stability, a variety of stabilizers may be added to the silver halide emulsion. Preferable examples of these stabilizers include nitrogen-containing heterocyclic compounds, such as azaindene, triazole, tetrazole and purine, and mercapto compounds such as mercaptotetrazole, mercaptotriazole, mercaptoimidazole and mercaptothiadiazole. Detail of these compounds is described in T. H. James, The Theory of the Photographic Process, Macmillan, 1977, pp. 396–399, and references cited therein.

The coated weight of the light-sensitive silver halide to be used in the light-sensitive material of the present invention is in the range of 0.05 to 20 g/m$^2$, and preferably 0.1 to 10 g/m$^2$, based on the weight of silver.

An organic metal salt may be used as an oxidant together with a light-sensitive silver halide in the present invention. Among these organic metal salts, an organic silver salt is particularly preferable.

Examples of the organic compounds which can be used for the preparation of the above-mentioned organic silver salts serving as an oxidant include benzotriazoles, fatty acids and other compounds in U.S. Pat. No. 4,500,626, columns 52-53. The silver acetylide, which is described in U.S. Pat. No. 4,775,613, is also useful. These organic silver salts may be used alone or in a combination of two or more of them.

The above-mentioned organic silver salt can be used in an amount in the range of 0.01 to 10 mol, and preferably in the range of 0.01 to 1 mol, per mol of the light-sensitive silver halide.

The binder for a constituent layer of the light-sensitive material is preferably a hydrophilic material, examples of which include those described in the aforesaid RD and in JP-A No. 64-13,546, pp. 71–75. More specifically, the binder is preferably a transparent or translucent hydrophilic material, exemplified by a naturally occurring compound, such as a protein including gelatin and a gelatin derivative, and a polysaccharide including a cellulose derivative, starch, gum arabic, dextran and pullulan, and by a synthetic polymer such as polyvinyl alcohol, modified polyvinyl alcohol (e.g., Poval MP 103, MP 203 having alkyl-modified terminals and manufactured by Kuraray Co. Ltd.), polyvinyl pyrrolidone and acryl amide polymer. Also usable as the binder is a highly water-absorbent polymer described in U.S. Pat. No. 4,960,681 and JP-A No. 62-245,260, for example, a homopolymer composed of a vinyl monomer having —COOM or —$SO_3$M (M stands for a hydrogen atom or an alkali metal), or a copolymer obtained by a combination of these monomers or by a combination of at least one of these monomers and another monomer(s) such as sodium methacrylate and ammonium methacrylate (e.g., SUMIKAGEL L-5H manufactured by Sumitomo Chemical Co., Ltd.). These binders may be used alone or in a combination of two or more of them. Particularly, a combination of gelatin and any of the above-mentioned non-gelatin binders is preferable. Depending the on purposes, a lime-processed gelatin, acid-processed gelatin and delimed gelatin which has undergone a deliming treatment to decrease the content of calcium, and the like can be used alone or in a combination of two or more of them. Alternatively, a combination of these processed gelatin substances may be employed.

In the present invention, the coated weight of the binder is preferably 1 to 20 g/$m^2$, preferably 2 to 15 g/$m^2$, and more preferably 3 to 12 g/$m^2$. In the binder, the percentage of gelatin is 50 to 100% and preferably 70 to 100%.

The light-sensitive material in the present invention is preferable to comprise the developing agent. It is preferable to use the compounds represented the general formula VI~IX as the developing agent comprised in the light-sensitive material.

The compounds, which are represented by the general formula (VI), are generally called sulfonamide phenols.

In the formula, $R_1$ to $R_4$ are each a group selected from the group consisting of a hydrogen atom, halogen atoms (e.g., chlorine and bromine atoms), alkyl groups (e.g., methyl, ethyl, isopropyl, n-butyl and t-butyl groups), aryl groups (e.g., phenyl, tolyl and xylyl groups), alkylcarbonamide groups (e.g., acetylamino, propionylamino and butyloylamino groups), arylcarbonamide groups (e.g., benzoylamino groups), alkylsulfonamide groups (e.g., methanesulfonylamino and ethanesulfonylamino groups), arylsulfonamide groups (e.g., benzenesulphonylamino and toluenesulfonylamino groups), alkoxy groups (e.g., methoxy, ethoxy and butoxy groups), aryloxy groups (e.g., phenoxy group), alkylthio groups (e.g., methylthio, ethylthio and butylthio groups), arylthio groups (e.g., phenylthio and tolylthio groups), alkylcarbamoly groups (e.g., methylcarbamoyl, dimethylcarbamoyl, ethylcarbamoyl, diethylcarbamoyl, dibutylcarbamoyl, piperidylcarbamoyl and morpholinylcarbamoyl groups), arylcarbamoly groups (e.g., phenylcarbamoyl, methylphenylcarbamoyl, ethylphenylcarbamoyl and benzylphenylcarbamoyl groups), carbamoyls groups, alkylsulfamoyl groups (e.g., methylsulfamoyl, dimethylsulfamoyl, ethylsulfamoyl, diethylsulfamoyl, dibutylsulfamoyl, piperidylsulfamoyl and morpholinylsulfamoyl groups), arylsulfamoyl groups (e.g., phenylsulfamoyl, methylphenylsulfamoyl, ethylphenylsulfamoyl andbenzylphenylsulfamoyl groups), sulfamoyl groups, cyano groups, alkylsulfonyl groups (e.g., methanesulfonyl and ethanesulfonyl groups), arylsulfonyl groups (e.g., phenylsulfonyl, 4-chlorophenylsulfonyl and p-toluenesulfonyl groups), alkoxycarbonyl groups (e.g., methoxycarbonyl, ethoxycarbonyl and butoxycarbonyl groups), aryloxycarbonyl groups (e.g., phenoxycarbonyl group), alkylcarbonyl groups (e.g., acetyl, propionyl and butyloyl groups), arylcarbonyl groups (e.g., benzoyl and alkylbenzoyl groups), and acyloxy groups (e.g., acetyloxy, propionyloxy and butyloyloxy groups). Of the groups represented by $R_1$ to $R_4$, $R_2$ and $R_4$, are preferably hydrogen atoms. The total of Hammett's constants σp of $R_1$ to $R_4$ is preferably 0 or greater.

$R_5$ is a group selected from the group consisting of alkyl groups (e.g., methyl, ethyl, butyl, octyl, lauryl, cetyl or stearyl group), d aryl groups (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl or 3,5-di-(methoxy)carbonyl group), and heterocyclic groups (e.g., pyridyl group).

The compounds represented by the general formula VII are generally called carbamoylhydrazines. The compounds represented by the general formula IX are generally called sulfonylhydrazines.

Z stands for a group of atoms forming an aromatic ring. The aromatic group indicated by Z should be sufficiently electron-attractive to impart silver development activity to the compound. From this stand point, preferably employed is a nitrogen-containing aromatic ring or an aromatic ring such as a benzene ring bearing an electron-attractive substituent. In this sense preferred examples of such aromatic rings include a pyridine ring, a pyradine ring, a pyrimidine ring, a quinoline ring and a quinoxaline ring. $R_5$ is the same with $R_5$ of the general formula VI.

If the aromatic ring formed by Z is a benzene ring, examples of its substituents include alkylsulfonyl groups (e.g., methanesulfonyl and ethanesulfonyl groups), halogen atoms (e.g., chlorine and bromine atoms), alkylcarbamoly groups (e.g., methylcarbamoyl, dimethylcarbamoyl, ethylcarbamoyl, diethylcarbamoyl, dibutylcarbamoyl, piperidylcarbamoyl and morpholinylcarbamoyl groups), arylcarbamoly groups (e.g., phenylcarbamoyl, methylphenylcarbamoyl, ethylphenylcarbamoyl and benzylphenylcarbamoyl groups), carbamoyl groups, alkylsulfamoyl groups (e.g., methylsulfamoyl, dimethylsulfamoyl, ethylsulfamoyl, diethylsulfamoyl, dibutylsulfamoyl, piperidylsulfamoyl and morpholinylsulfamoyl groups), arylsulfamoyl groups (e.g., phenylsulfamoyl, methylphenylsulfamoyl, ethylphenylsulfamoyl and benzylphenylsulfamoyl groups), sulfamoyl groups, cyano groups, alkylsulfonyl groups (e.g., methanesulfonyl and ethanesulfonyl groups), arylsulfonyl groups (e.g., phenylsulfonyl, 4-chlorophenylsulfonyl and p-toluenesulfonyl groups), alkoxycarbonyl groups (e.g., methoxycarbonyl, ethoxycarbonyl and butoxycarbonyl groups), aryloxycarbonyl groups (e.g., a phenoxycarbonyl group), alkylcarbonyl groups (e.g., acetyl, propionyl and butyloyl groups), and arylcarbonyl groups (e.g., benzoyl and alkylbenzoyl groups). The total of Hammett's constants (of the above-mentioned substituents is preferably 1 or greater.

The compounds represented by the general formula VIII are generally called carbamoylhydrazones.

In the formulas, $R_6$ is a substituted or unsubstituted alkyl group (e.g., methyl and ethyl groups). X is selected from the group consisting of an oxygen atom, a sulfur atom, a selenium atom and an alkyl- or aryl-substituted tertiary nitrogen atom. X is preferably an alkyl-substituted tertiary nitrogen atom. $R_7$ and $R_8$ are selected from the group consisting of a hydrogen atom and a substituent, in which $R_7$ and $R_8$ may join with each other to form a double bond or a ring. $R_5$ of the general formula VIII is the same with $R_5$ of the general formula VI.

Further, each of the compounds represented by the general formulas [VI] to [IX] preferably contains at least one ballast group having 8 or more carbon atoms in order to impart oil solubility to the molecule.

Concrete examples (D-1~56) of the compounds represented by the general formulas [VI] to [IX] are given below, but the compounds in the present invention are not limited by these examples.

D-1

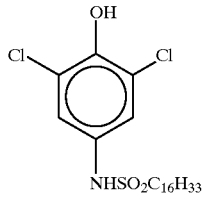

D-2

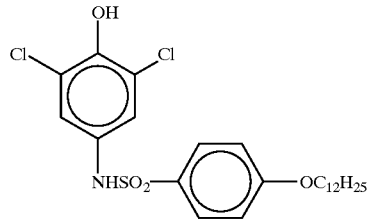

D-3

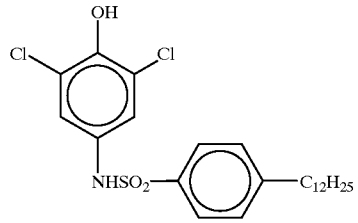

D-4

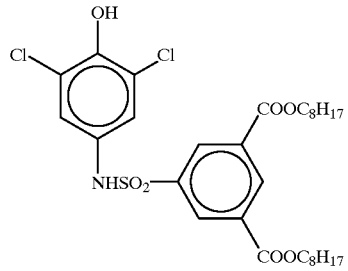

D-5

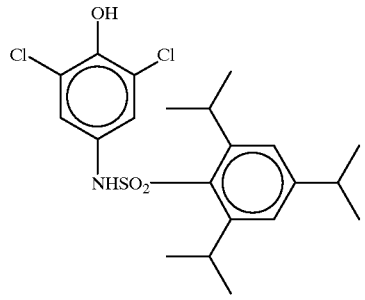

-continued
D-6
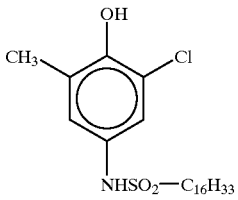
D-7
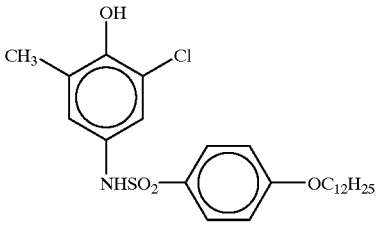
D-8
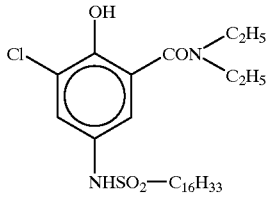
D-9
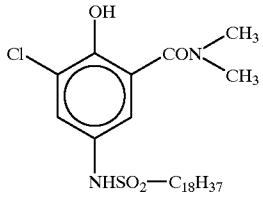
D-10
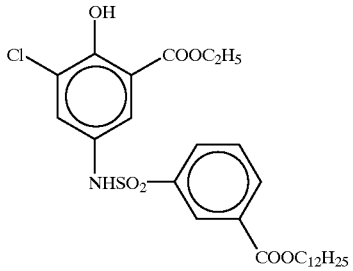
D-11
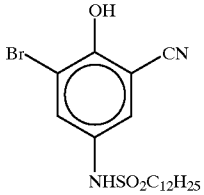
D-12
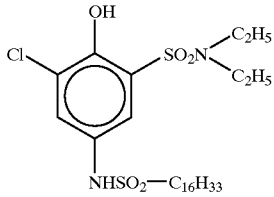

-continued
D-13
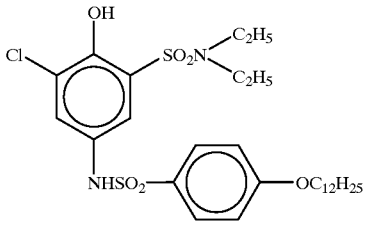
D-14
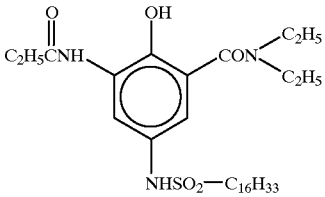
D-15
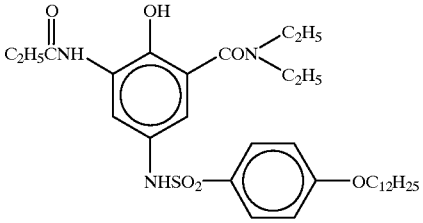
D-16
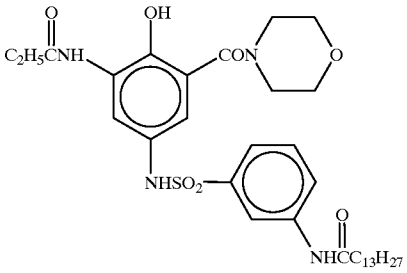
D-17
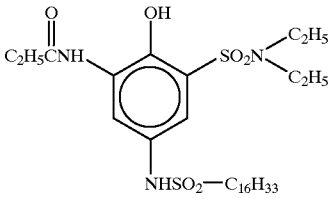
D-18
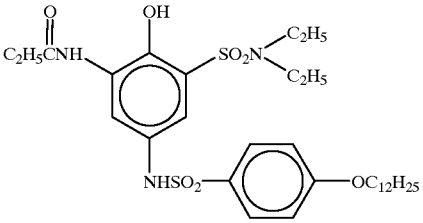

-continued
D-19
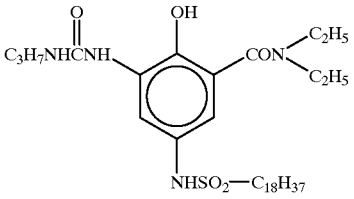
D-20
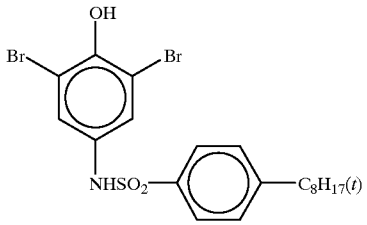
D-21
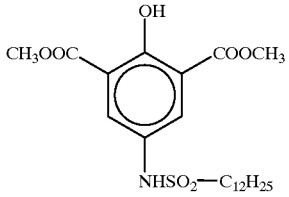
D-22
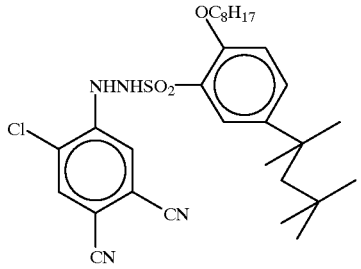
D-23
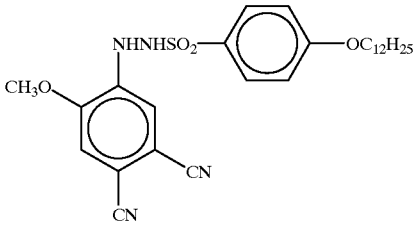
D-24
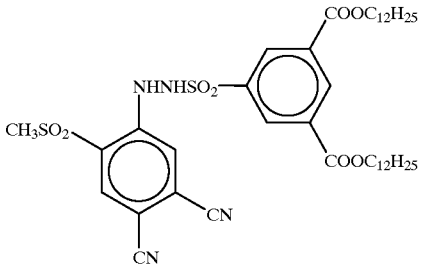

-continued
D-25
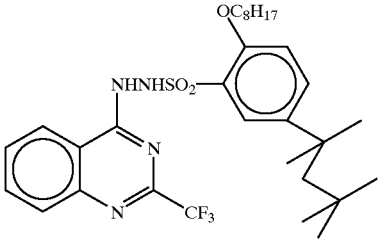
D-26
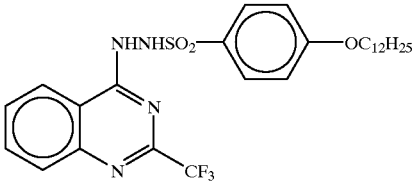
D-27
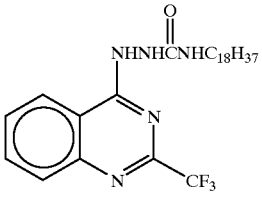
D-28
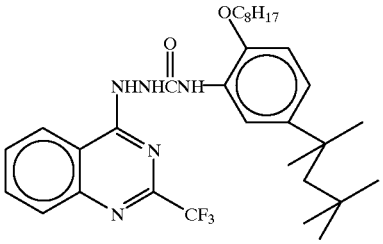
D-29
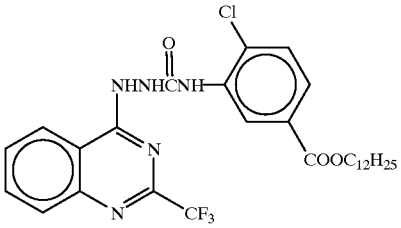
D-30
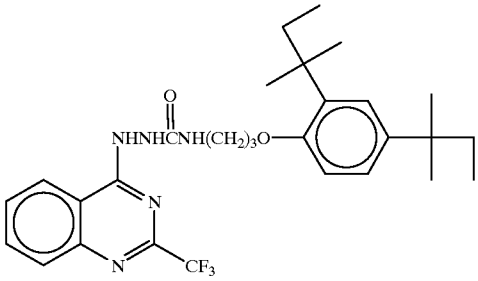

-continued
D-31
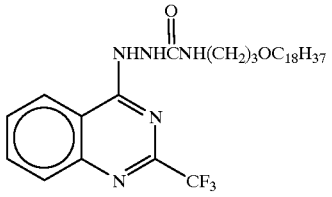
D-32
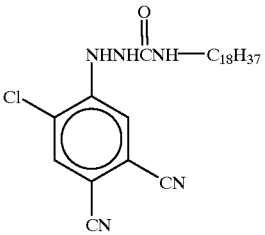
D-33
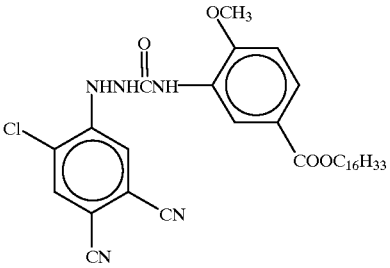
D-34
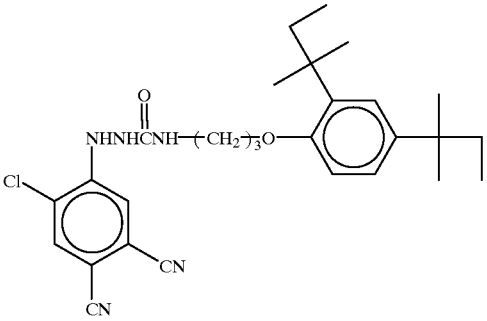
D-35
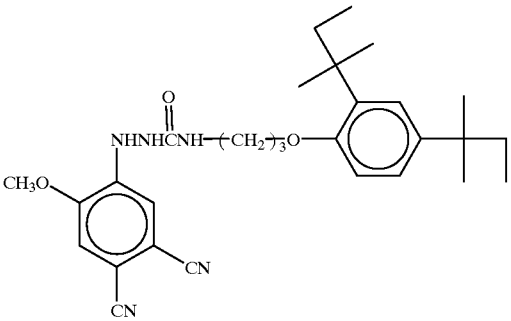

-continued
D-36
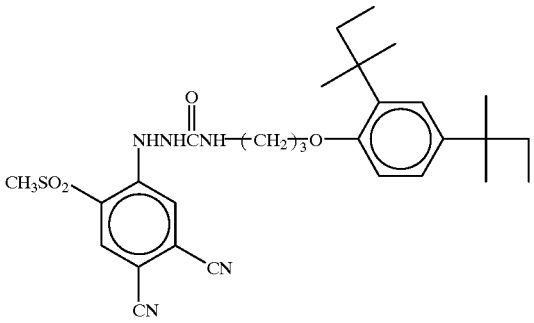
D-37
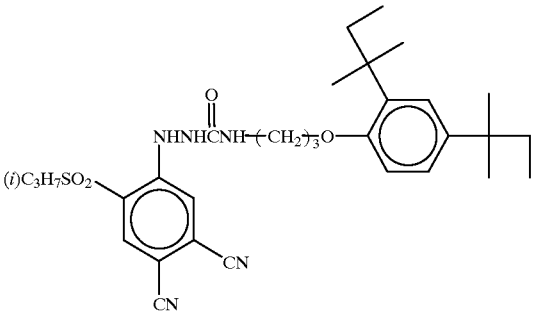
D-38
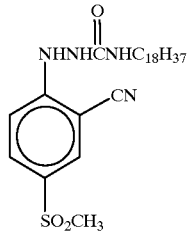
D-39
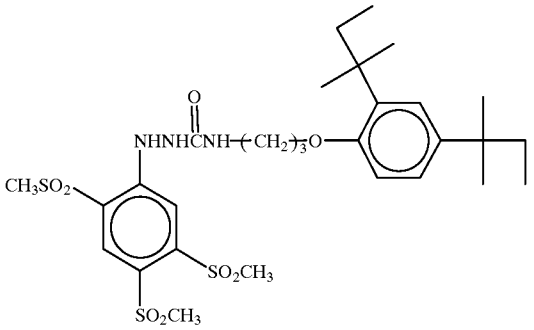
D-40
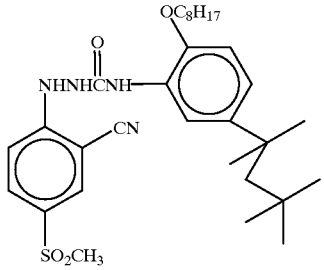

-continued
D-41
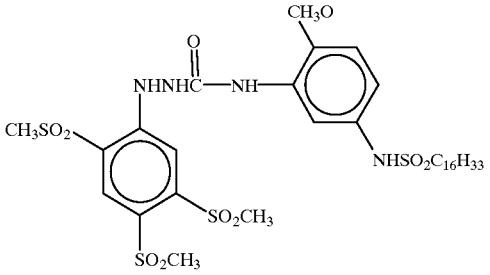
D-42
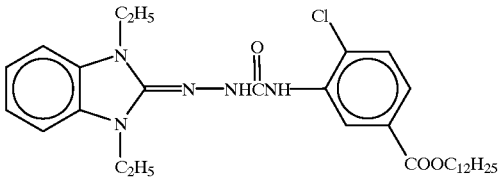
D-43
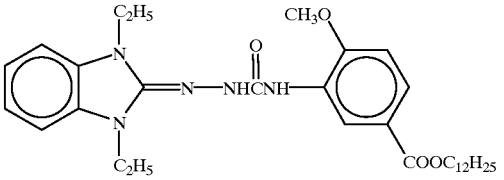
D-44
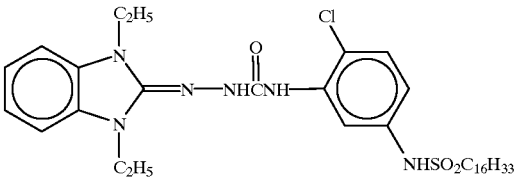
D-45
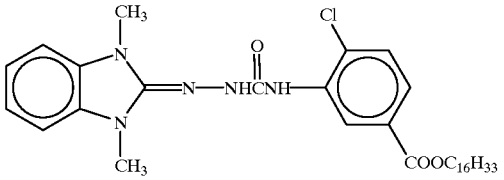
D-46
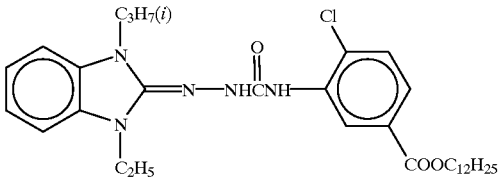
D-47
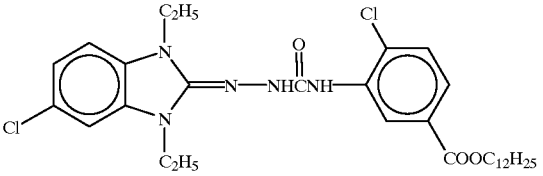

-continued
D-48
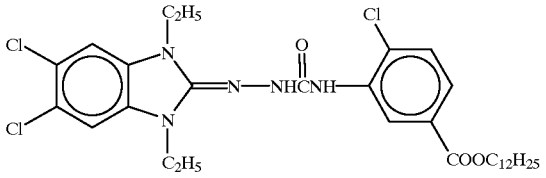
D-49
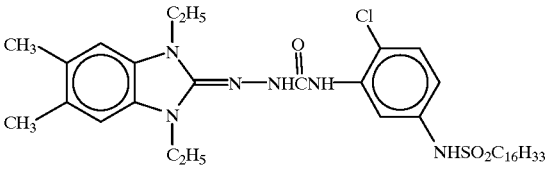
D-50
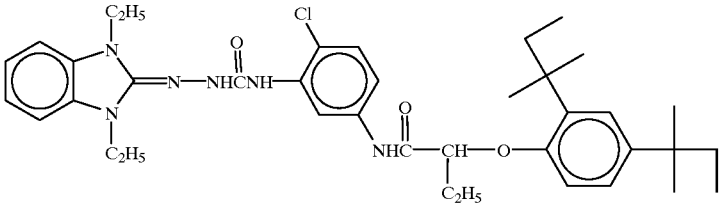
D-51
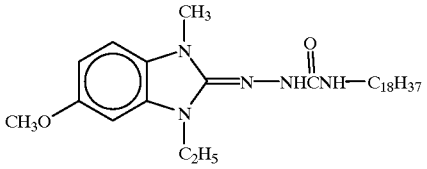
D-52
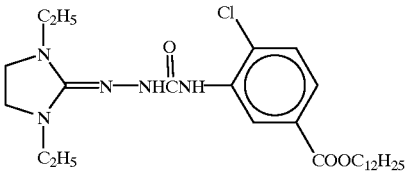
D-53
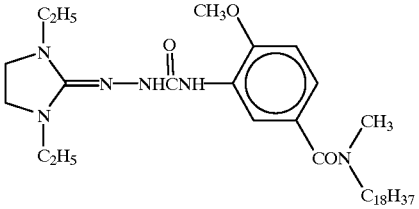
D-54
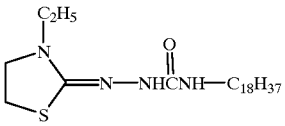
D-55
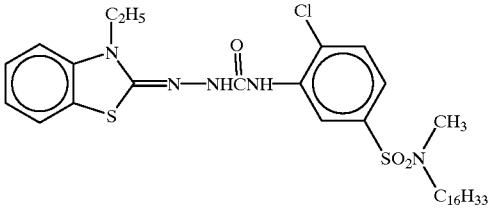

-continued

D-56

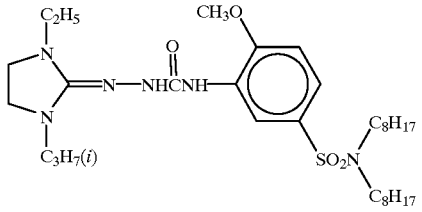

The above compounds can be synthesized by commonly known methods. Synthetic processes of the compounds are briefly described below.

Synthesis of developing agent D-2

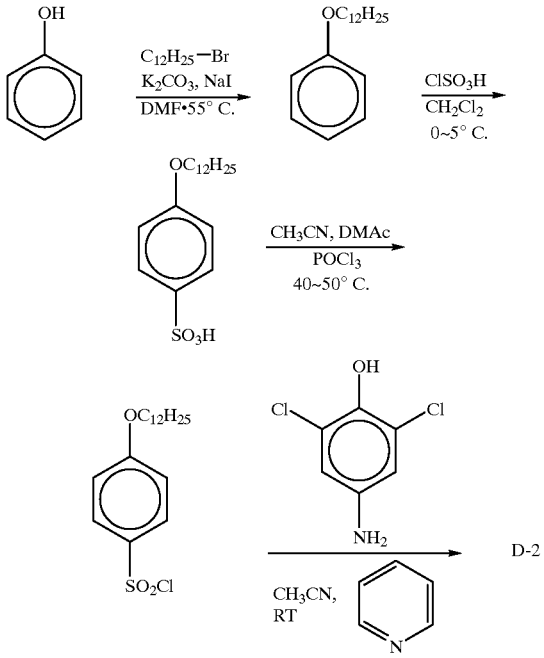

Synthesis of developing agent D-27

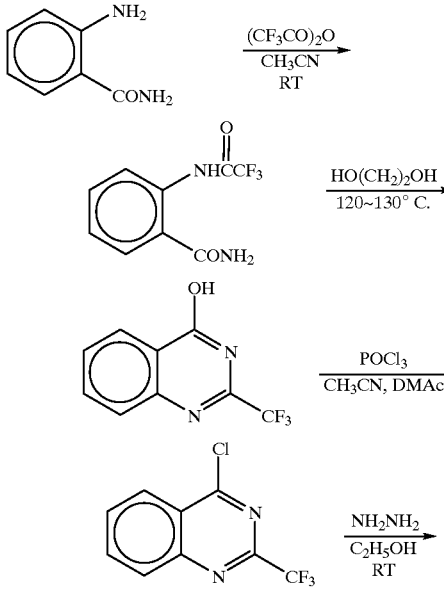

-continued

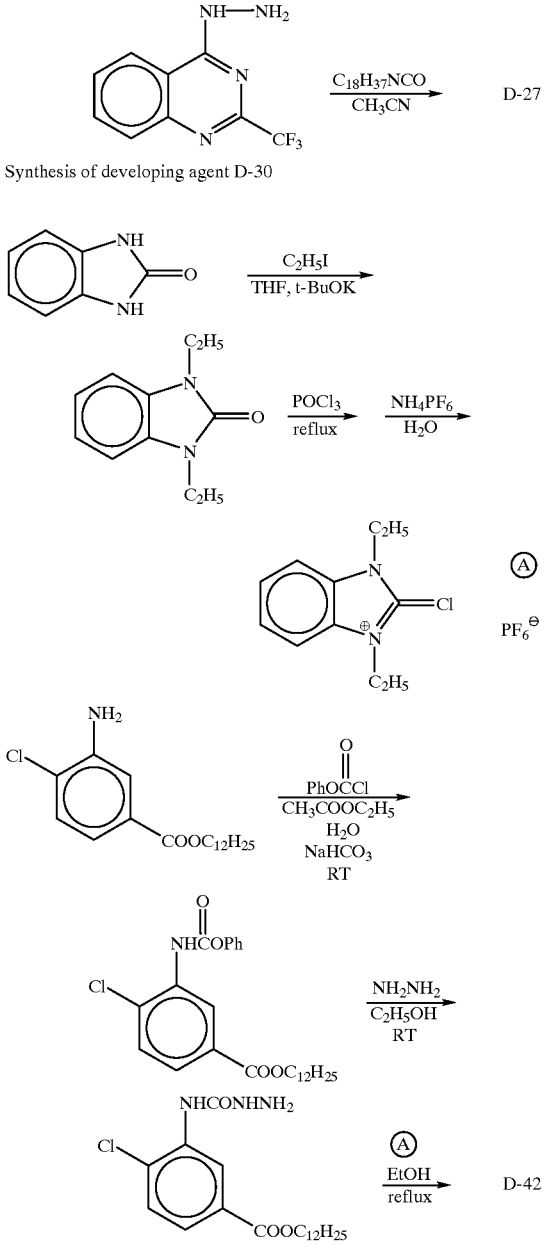

Synthesis of developing agent D-30

A color developing agent in the present invention uses one or more of the above-mentioned compounds. Each of the layers of a light-sensitive material may contain a different developing agent. The total amount of the developing agent to be used is in the range of 0.05 to 20 mmol/m$^2$, and preferably 0.1 to 10 mmol/m$^2$.

Couplers are described below. In the present invention, the term "coupler" refers to a compound which causes a coupling reaction with the developing agent to form a dye.

The couplers which are suitable for use in the present invention are compounds generally called active methylenes, 5-pyrazolones, pyrazoloazoles, phenols, naphthols and pyrrolotriazoles. Preferable examples of these couplers are described in RD No. 38,957 (September, 1996), pp. 616–624, "x. Dye image formers and modefiers ".

These couplers can be classified into so-called 2-equivalent couplers and so-called 4-equivalent couplers. Examples of the groups serving as anionic leaving groups of 2-equivalent couplers include halogen atoms (e.g., chlorine and bromine atoms), alkoxy groups (e.g., methoxy and ethoxy groups), aryloxy groups (e.g. phenoxy group, 4-cyanophenoxy and 4-alkoxycarbonylphenyl groups), alkylthio groups (e.g., methylthio, ethylthio and butylthio groups), arylthio groups (e.g., phenylthio and tolylthio groups), alkylcarbamoly groups (e.g., methylcarbamoyl, dimethylcarbamoyl, ethylcarbamoyl, diethylcarbamoyl, dibutylcarbamoyl, piperidylcarbamoyl and morpholinylcarbamoyl groups), arylcarbamoly groups (e.g., phenylcarbamoyl, methylphenylcarbamoyl, ethylphenylcarbamoyl and benzylphenylcarbamoyl groups), carbamoyls groups, alkylsulfamoyl groups (e.g., methylsulfamoyl, dimethylsulfamoyl, ethylsulfamoyl, diethylsulfamoyl, dibutylsulfamoyl, piperidylsulfamoyl and morpholinylsulfamoyl groups), arylsulfamoyl groups (e.g., phenylsulfamoyl, methylphenylsulfamoyl, ethylphenylsulfamoyl and benzylphenylsulfamoyl groups), sulfamoyl groups, cyano groups, alkylsulfonyl groups (e.g., methanesulfonyl and ethanesulfonyl groups), arylsulfonyl groups (e.g., phenylsulfonyl, 4-chlorophenylsulfonyl and p-toluenesulfonyl groups), alkylcarbonyloxy groups (e.g., acetyloxy, propionyloxy and butyloyloxy groups), arylcarbonyloxy groups (e.g., benzoyloxy, tolyloxy and anisyloxy groups), and nitrogen-containing heterocyclic groups (e.g., imidazolyl and benzotriazolyl groups).

Examples of the groups serving as cationic leaving groups of 4-equivalent couplers include a hydrogen atom, a formyl group, a carbamoyl group, a methylene group bearing a substituent (such as an aryl, sulfamoyl, carbamoyl, alkoxy, amino or hydroxyl group), an acyl group and a sulfonyl group.

Besides the compounds described in RD No. 38,957, preferable couplers are given below.

Active methylene-based couplers are: couplers represented by Formulas (I) and (II) in European Patent No. 502,424A; couplers represented by Formulas (1) and (2) in European Patent No. 513,496A; couplers represented by Formula (I) in claim 1 of European Patent No. 568,037A; couplers represented by Formula (I) in column 1, lines 45 to 55, in U.S. Pat. No. 5,066,576; couplers represented by Formula (I) in paragraph 0008 of JP-A No. 4-274,425; couplers described in claim 1 on page 40 in European Patent No. 498,381A1; couplers represented by Formula (Y) on page 4 in European Patent No. 447, 969A1; and couplers represented by Formulas (II) to (IV) in column 7, lines 36–58, in U.S. Pat. No. 4,476,219.

Preferable 5-pyrazolone-based magenta couplers are the compounds described in JP-A Nos. 57-35,858 and 51-20, 826.

Preferable pyrazoloazole-based couplers are imidazo[1,2-b]pyrazoles described in U.S. Pat. No. 4,500,630, pyrazo[1,5-b][1,2,4]triazoles described in U.S. Pat. No. 4,540,654 and pyrazo[1,5-c][1,2,4] triazoles described in U.S. Pat. No. 3,725,067. Among these compounds, pyrazo[1,5-b][1,2,4] triazoles are more preferable from the viewpoint of light fastness.

Preferable examples of phenol-based couplers include 2-alkylamino-5-alkylphenols described in U.S. Pat. Nos. 2,369,929, 2,801,171, 2,772,162, 2,895,826 and 3,772,002, 2,5-diacylaminophenols described in U.S. Pat. Nos. 2,772, 162, 3,758,308, 4,126,396, 4,334,011 and 4,327,173, German Patent Application Laid-Open No. 3,329,729, JP-A No. 59-166,956, and 2-phenylureido-5-acylaminophenols described in U.S. Pat. Nos. 3,446,622, 4,333,999, 4,451,559 and 4,427,767.

Preferable examples of naphthol-based couplers include 2-carbamoyl-1-naphthols described in U.S. Pat. Nos. 2,474, 293, 4,052,212, 4,146,396, 4,228,233 and 4,296,200, and 2-carbamoyl-5-amido-1-naphthols described in U.S. Pat. No. 4,690,889.

Preferable examples of pyrrolotriazole-based couplers are the couplers described in European Patent Nos. 488,248A1, 491,197A1 and 545,300.

Other usable couplers are those each having a structure such as a fused-ring phenol, an imidazole, a pyrrole, 3-hydroxypyridine, an active methine, a 5,5-fused heterocyclic ring or a 5, 6-fused heterocyclic ring.

Couplers which are based on a fused-ring phenol and usable in the present invention are those described in U.S. Pat. Nos. 4,327,173, 4,564,586 and 4,904,575.

Couplers which are based on an imidazole and usable in the present invention are those described in U.S. Pat. Nos. 4,818,672 and 5,051,347.

Couplers which are based on a pyrrole and usable in the present invention are those described in JP-A Nos. 4-188, 137 and 4-190,347.

Couplers which are based on 3- hydroxypyridine and usable in the present invention are those described in JP-A No. 1-315,736.

Couplers which are based on an active methine and usable in the present invention are those described in U.S. Pat. Nos. 5,104,783 and 5,162,196.

Couplers which are based on a 5,5-fused heterocyclic ring and usable in the present invention are the pyrrolopyrazoles described in U.S. Pat. No. 5,164,289, and pyrroloimidazoles described in JP-A Nos. 4-174,429.

Couplers which are based on a 5,6-fused heterocyclic ring and usable in the present invention are the pyrazolopyrimidines described in U.S. Pat. No. 4,950,585, pyrrolotriazines described in JP-A No. 4-204,730 and the couplers described in European Patent No. 556,700.

Besides these couplers, couplers which can be used in the present invention are those described in German Patent Nos. 3,819, 051A and 3,823,049, U.S. Pat. Nos. 4,840,883, 5,024, 930, 5,051,347 and 4,481,268, European Patent Nos. 304, 856A2, 329,036, 354,549A2, 374,781A2, 379,110A2, 386, 930A1, JP-A Nos. 63-141,055, 64-32,260, 64-32,261, 2-297,547, 2-44,340, 2-110,555, 3-7,938, 3-160,440, 3-172, 839, 4-172,447, 4-179,949, 4-182,645, 4-184,437, 4-188, 138, 4-188,139, 4-194,847, 4-204,532, 4-204,731 and 4-204,732.

These couplers are used in an amount of 0.05 to 10 mmol/m$^2$ and preferably 0.1 to 5 mmol/m$^2$ for each color.

In addition to the foregoing couplers, the following functional couplers can also be used.

Preferable examples of couplers which form dyes having a suitable diffusivity level are those described in U.S. Pat. No. 4,366,237, British Patent No. 2,125,570, European Patent No. 96,873B, and German Patent No. 3,234,533.

Couplers which are used for compensating unnecessary absorption of formed dyes are a yellow-colored cyan coupler described in European Patent No. 456,257A1, a yellow-colored magenta coupler described in European Patent No. 456,257A1, a magenta-colored cyan coupler described in U.S. Pat. No. 4, 833,069, and a colorless masking coupler represented by Formula (A) described in claim 1 in U.S. Pat. No. 4,837,136 (2) and WO92/11575 (particularly the compounds given on pages 36 to 45).

Examples of couplers which react with an oxidized form of a developing agent and release a residual compound which is photographically useful are as follows:

Development inhibitor releasing compounds: compounds represented by Formulas (I) to (IV) described on page 11 in European Patent No. 378,236A1, compounds represented by Formula (I) described on page 7 in European Patent No. 436,938A2, compounds represented by Formula (I) in European Patent No. 568,078A, and compounds represented by Formulas (I) to (III) described on pages 5 to 6 in European Patent No. 440,195A2.

Bleaching promoter releasing compounds: compounds represented by Formulas (I) and (I') described on page 5 in European Patent No. 310, 125A2 and compounds represented by Formulas (I) in claim 1 of JP-A No. 6-59,411.

Ligand releasing compounds: compounds represented by LIG-X described in claim 1 of U.S. Pat. No. 4,555,478.

Leuco dye releasing compounds: compounds 1 to 6 in U.S. Pat. No. 4,749,641, columns 3 to 8.

Liminescent dye releasing compounds: compounds represented by COUP-DYE described in claim 1 of U.S. Pat. No. 4,774,181.

Compounds which release a development promoter or a fogging agent: compounds represented by Formula (1), (2) or (3) in U.S. Pat. No. 4,656,123, column 3, and compounds represented by ExZK-2 described in lines 36 to 38 on page 75 in European Patent No. 450,637A2.

Compounds which release a group capable of becoming a dye only after being released: compounds represented by Formula (I) in claim 1 of U.S. Pat. No. 4,857,447, compounds represented by Formula (1) in Japanese Patent Application No. 4-134,523, compounds represented by Formula (I), (II) or (III) on pages 5 to 6 in European Patent No. 440,195A2, compound-ligand releasing compounds represented by Formula (I) described in claim 1 in JP-A No. 4-325,564 and compounds represented by LIG-X in claim 1 of U.S. Pat. No. 4,555,478.

Any of these functional couplers are used preferably in an amount of 0.05 to 10 times and more preferably 0.1 to 5 times the molar amount of the color forming coupler.

Further, as a different method to those described above, an image forming method can be used comprising the use of a colorant which releases or diffuses a diffusive dye in proportion to or in reverse proportion to the silver developing, and the removal from the light sensitive material in the developing process of either a portion or the whole of the diffusive dye which has been released or diffused.

A colorant which used for this purpose is a compound containing a dye portion in its own structure, and having ability to release or diffuse a diffusive dye in proportion or in reverse proportion to the silver developing. All or part of the diffusive dye is removed simultaneously with the development or the process following the development.

In this method, compounds which are disclosed as a reducing agent as described in Japanese Patent Application Laid-Open (JP-A) No. 9-121265, pp. 6 to 7 may be used. Further, the dye itself may comprise the functions of a unite reducing agent.

Further, a precursor of a reducing agent which has no reducing properties itself but which exhibits reducing properties through the addition of heat or a nucleophilic reagent in the developing process.

A colorant which is able to be used in the present invention and releases or diffuses a diffusive a dye in proportion or in reverse proportion to the development of silver can be represented by the general formula [L1] given below.

$$((\mathrm{Dye})_m\text{—}\mathrm{Y})_n\text{—}\mathrm{Z} \qquad \text{general formula (L1)}$$

In the formula, Dye represents a dye group or a dye precursor group having the absorption wavelength region thereof temporarily shifted in a short wavelength region, Y represents merely a bond or linking group, Z represents a group which differentiates the diffusivity of the compound represented by the formula $((\mathrm{Dye})_m\text{—}\mathrm{Y})_n\text{—}\mathrm{Z}$ conforming either regularly or reversely to the imagewise latent image of a light-sensitive silver halide, or which releases $(\mathrm{Dye})_m\text{—}\mathrm{Y}$ and differentiates the diffusivity of the released $(\mathrm{Dye})_m\text{—}\mathrm{Y}$ from that of $((\mathrm{Dye})_m\text{—}\mathrm{Y})_n\text{—}\mathrm{Z}$, m is an integer of 1 to 5, n is 1 or 2, and the plural Dyes may be the same or not if all of m and n are not 1. Concrete examples of the dye forming compounds represented by the general formula [LI] include the following compounds (i) to (vi). Among these compounds, the compounds (i) to (iv) release or diffuses a diffusive a dye in reverse proportion to the development of silver, while the compounds (v) and (vi) releases or diffuses a diffusive in proportion to the development of silver.

(i) Color developers which comprise a hydroquinone-based developing agent and a dye component linked thereto and which are described in, e.g., U.S. Pat. Nos. 3,134,764, 3,362,819, 3,597,200, 3,544,545 and 3,482,972 and JP-B No. 3-68,387. These color developers are diffusive in an alkaline environment, but they become nondiffusive after their reaction with a silver halide.

(ii) As described in, e.g., U.S. Pat. No. 4,503,137, it is possible to use a nondiffusive compound which is capable of releasing a diffusive dye in an alkaline environment but loses this capability after the reaction with a silver halide. Examples of this compound are a compound which releases a diffusive dye as a result of an intramolecular nucleophilic substitution reaction as described in, e.g., U.S. Pat. No. 3,980,479, and a compound which releases a diffusive dye as a result of an intramolecular tautomerization of an isooxazolone ring as described in, e.g., U.S. Pat. No. 4,199,354.

(iii) Nondiffusive compounds which react with a reducing agent remaining unoxidized after a developing process and release a diffusive dye as described in, e.g., U.S. Pat. No. 4,559,290, European Patent No. 220,746A2, U.S. Pat. No. 4,783,396, Journal of Technical Disclosure No. 87-6,199, and JP-A No. 64-13,546. Examples of these compounds include compounds which release, after reduction thereof, a diffusive dye as a result of the intramolecular nucleophilic substitution reaction as described in, e.g., U.S. Pat. Nos. 4,139,389 and 4,139,379, and JP-A Nos. 59-185,333 and 57-84,453, compounds which release, after reduction thereof, a diffusive dye as a result of the intramolecular transfer of electrons as described in, e.g., U.S. Pat. Nos . 4,232, 107, JP-A Nos. 59-101, 649 and 61-88,257, and RD No. 24,025 (1984), compounds which releases, after reduction thereof, a diffusive dye as a result of the severance of a single bond as described in, e.g., German Patent No. 3,008, 588A, JP-A No. 56-142,530, U.S. Pat. Nos. 4,343,893 and 4,619,884, nitro compounds which release a diffusive dye after accepting electrons as described in, e.g., U.S. Pat. No. 4,450,223, and compounds which release a diffusive dye after accepting electrons as described in, e.g., U.S. Pat. No. 4,609,610.

More preferable examples include compounds which have in a single molecule thereof an N—X linkage (X stands for an oxygen atom, a sulfur atom or a nitrogen atom) and an electron-attractive group as described in, e.g., European Patent No. 220,746A2, Journal of Technical Disclosure No. 87-6,199, U.S. Pat. No. 4,783,396, JP-A Nos. 63-201,653, 63-201,654 and 64-13,546, compounds which have in a single molecule thereof an $SO_2$—X linkage (X is as defined above) and an electron-attractive group as described in JP-A No. 1-26,842, compounds which have in a single molecule thereof a PO—X linkage (X is as defined above) and an electron-attractive group as described in JP-A No. 63-271,344, and compounds which have in a single molecule thereof a C—X' linkage (X' is the same as X or stands for —$SO_2$—) and an electron-attractive group as described in JP-A No. 63-271,341. Also usable are compounds which releases a diffusive electron as a result of severance of a single bond after reduction due to a π bond conjugated with an electron-accepting group as described in JP-A Nos. 1-161,237 and 1-161,342. Among these compounds, a compound, which has in a single molecule thereof an N—X linkage and an electron-attractive group, is preferable. Concrete examples of the preferable compounds include the compounds (1)~(3), (7)~(10), (12), (13), (15), (23)~(26), (31), (32), (35), (36), (40), (41), (44), (53)~59), (64) and (70) described in European Patent No. 220,746A2 or U.S. Pat. No. 4,783,396, the compounds (11)~(23) described in Journal of Technical Disclosure No. 87-6,199, and the compounds (1)~(84) described in JP-A No. 64-13,546.

(iv) Compounds which react with a silver ion or an organosilver complex ion to release a diffusive dye as described in U.S. Pat. Nos. 4,362,806, 3,719,489 and 4,375,507.

(v) Compounds (DRR couplers) which are couplers having a diffusive dye as a leaving group and release the diffusive dye by reacting with an oxidized form of a reducing agent. Concrete examples of these compounds include those described in, e.g., British Patent No. 1,330,524, JP-B No. 48-39,165, U.S. Pat. Nos. 3,443,940, 4,474,867 and 4,483,914.

(vi) Compounds (DDR compounds) which are capable of reducing a silver halide or an organic salt of silver and release a diffusive dye after reducing the silver halide or the organic salt of silver. These compounds do not need the use of other reducing agent, and bring about the advantage that the resulting image is not contaminated with an oxidative decomposition product of the reducing agent. Typical examples of these compounds are described in, e.g., U.S. Pat. Nos. 3,928,312, 4,053,312, 4,055,428 and 4,336,322, JP-A Nos. 59-65, 839, 59-69,839, 53-3,819 and 51-104,343, RD 17,465, U.S. Pat. Nos. 3,725,062, 3,728,113 and 3,443,939, JP-A Nos. 58-116,537 and 57-179,840, and U.S. Pat. Nos. 4,500,626. Concrete examples of the DRR compounds include those described in U.S. Pat. No. 4,500,626, columns 22–44. Among these compounds described in this patent document, compounds (1)~(3), (10)~(13), (16)~(19), (28)~(30), (33)~(35), (38)~(40) and (42)~(64) are preferable. Also useful are the compounds described in U.S. Pat. No. 4,639,408, columns 37–39.

The hydrophobic additives such as couplers, color developing agents, colorant and the like can be introduced in the layer of a light-sensitive element by known methods such as the method described in U.S. Pat. No. 2,322,027 and the like. In this case, organic solvents having high boiling point, such as those described in U.S. Pat. Nos. 4,555,470, 4,536,466, 4,536,467, 4,587,206, 4,555,476, 4,599,296, Japanese Patent Application Publication (JP-B) No. 3-62256 and the like can be used, together if necessary, with an organic solvent having a low boiling point of from 50° C. to 160° C. Further, these dye-donating couplers, high boiling point organic solvents and the like can be used in combination of two or more.

The amount of the high boiling point organic solvent is not more than 10 g, preferably not more than 5 g, and more preferably from 1 g to 0.1 g, per 1 g of the hydrophobic additive. Further, the amount is suitably not more than 1 ml , more preferably not more than 0.5 ml, and particularly preferably not more than 0.3 ml, per 1 g of the binder.

Dispersion methods using a polymerized compound described in Japanese Patent Application Publication (JP-B) No. 51-39853 and Japanese Patent Application Laid-Open (JP-A) No. 51-59943 and a method in which a fine particle dispersion is made before addition, as described in Japanese Patent Application Laid-Open (JP-A) No. 62-30242, can also be used.

In the case of a compound which is substantially insoluble in water, the compound can be dispersed as fine particles in a binder using a method other than that described above.

Various surfactants can be used when dispersing a hydrophobic compound in a hydrophilic colloid. For example, compounds which are listed as a surfactant on pp. 37 to 38 of Japanese Patent Application Laid-Open (JP-A) No. 59-157636, and the above-described RD can be used. Further, phosphate type surfactants described in Japanese Patent Application Nos. 5-204325, 6-19247 and OLS No. 1,932,299A can also be used.

In the light-sensitive material of the present invention, at least one light-sensitive layer is formed on a support. A typical example of the light-sensitive materials of the present invention is a silver halide color light-sensitive material having on the support at least one light-sensitive layer made up of a plurality of silver halide emulsion layers which are sensitive to the same color but which have different levels of sensitivity. The light-sensitive layer is a unit light-sensitive layer having sensitivity to any of blue light, green light and red light. In the case of a multilayered silver halide color light-sensitive material, a generally adopted order of the unit light-sensitive layers from the support is a red-sensitive layer, a green-sensitive layer and a blue-sensitive layer. However, depending on the purpose, this order of layers may be reversed, or light-sensitive layers sensitive to the same color may sandwich a light-sensitive layer sensitive to a different color. Non-light-sensitive layers can be formed between the silver halide light-sensitive layers or as the uppermost layer or as the lowermost layer. These layers may contain the couplers, developing agents, DIR compounds, color amalgamation inhibitors, dyes and the like. As for a plurality of silver halide emulsion layers constituting a unit light-sensitive layer, preferably a high-speed emulsion layer and a low-speed emulsion layer are arranged in a descending order of sensitivity toward a support as described in German Patent No. 1,121, 470 or British Patent No. 923,045. Alternatively, as described in JP-A Nos. 57-112,751, 62-200,350, 62-206,541 and 62-206,543, layers may be arranged such that a low-speed emulsion layer is formed remotely from a support and a high-speed layer is formed close to the support.

For example, the layers may be arranged from far to near to the support in the order of a low-speed blue-sensitive layer (BL)/a high-speed blue-sensitive layer (BH)/a high-speed green-sensitive layer (GH)/a low-speed green-sensitive layer (GL)/a high-speed red-sensitive layer (RH)/a low-speed red-sensitive layer (RL), or in the order of BH/BL/GL/GH/RH/RL , or in the order of BH/BL/GH/GL/RL/RH.

Alternatively, as described in JP-B No. 55-34,932, the layers may be arranged from far to near to the support in the order of a blue-sensitive layer /GH/RH/GL/RL. Further, as described in JP-A Nos. 56-25,738 and 62-63,936, the layers may be arranged from far to near to the support in the order of a blue-sensitive layer/GL/RL/GH/RH.

Further, as described in JP-B No. 49-15,495, three layers may be arranged such that a silver halide emulsion layer having the highest sensitivity is placed as an upper layer, a silver halide emulsion layer having sensitivity lower than that of the upper layer is placed as an intermediate layer, and a silver halide emulsion layer having sensitivity lower than that of the intermediate layer is place as a lower layer, i.e., the three layers having different sensitivities may be arranged in a descending order of sensitivity toward the support. Also, when the light-sensitive material comprises the three layers having different sensitivities, these layers may be arranged from far to near to the support in the order of medium-speed emulsion layer/high-speed emulsion layer/low-speed emulsion layer within a layer sensitive to the same color as described in JP-A No. 59-202,464

In addition, an order of high-speed emulsion layer/low-speed emulsion layer/medium-speed emulsion layer or an order of low-speed emulsion layer/medium-speed emulsion layer/high-speed emulsion layer may be adopted. Furthermore, the arrangement can be changed as described above, even when four or more layers are formed.

Preferably, the light-sensitive material of the present invention comprises at least two silver halide emulsions which are sensitive to the same wavelength region and have different average grain projected areas. The term "sensitivity to the same wavelength region" as used herein means sensitivity to practically the same wavelength region. Therefore, emulsions, which have slightly different distributions of spectral sensitivity but whose main light-sensitive regions overlap with each other, are deemed to be emulsions having light-sensitivity in the same wavelength region.

In the above-mentioned emulsions, the ratio of the average grain projected area of one emulsion to that of the other emulsion is preferably at least 1.25, more preferably 1.4 or more, and most preferably 1.6 or more.

In the case where three or more emulsions are used, it is preferable that the emulsion, which has the largest average grain projected area, and the emulsion, which has the smallest average grain projected area, meet the above-described relationship.

In the present invention, a plurality of emulsions, the light-sensitivity of each of which lies in the same wavelength region and the average grain projected areas of which are different, may be incorporated in different light-sensitive layers or may be incorporated as a mixture of the emulsions in the same light-sensitive layer.

In the case where these emulsions are incorporated in different layers, it is preferable that the layer, which contains the emulsion having a larger average grain projected area, be positioned in an upper layer (closer to the incident light).

In the case where these emulsions are incorporated in different light-sensitive layers, it is preferable that the color couplers to be used in combination with these emulsions produce the same hue. However, the hue of a color coupler, which is incorporated in one of the light-sensitive layers, may be different from the hue from a color coupler which is incorporated in other light-sensitive layer so that the light-sensitive layers produce different hues, or otherwise the light-sensitive layers may contain couplers leading to different absorption profiles for a hue.

In the present invention, preferably, these emulsions having spectral sensitivity in the same wavelength region are coated that the larger the average grain projected area of the emulsion is, the greater the ratio of silver halide grain numbers of the emulsion per unit area of the light-sensitive material is than the ratio of the value obtained by dividing the value of the coated silver amount of the emulsion by the value of the $3/2^{nd}$ power of the average grain projected area of the emulsion.

Specifically, assuming that(i) emulsion a is an emulsion having the smallest average grain projected area, and emulsions b, c, . . . have greater average grain projected areas in that order; (ii) Ka, Kb, Kc . . . are numbers of silver halide grains per unit areas of emulsion a, b, c, . . . , respectively; and (iii) Pa, Pb, Pc, . . . are ratios of Ka, Kb, Kc, . . . , to Ka, respectively, wherein Ka, which is the number of silver halide grains per unit areas of the emulsion a having the smallest average grain projected area, is taken as 1(Pa=1); and (iv) Ha, Hb, Hc, . . . are values which are obtained by dividing the coated silver amount of emulsions a, b, c, . . . by the $3/2^{nd}$ power of the average grain projected areas of emulsions a, b, c, . . . , respectively; and (v) Qa, Qb, Qc, . . . are ratios of Ha, Hb, Hc, . . . , to Ha, respectively, wherein Ha, which is the value of the emulsion a having the smallest average grain projected area, is taken as 1(Qa=1). Thus "the larger the average grain projected area of the emulsion is, the greater the ratio of silver halide grain numbers of the emulsion per unit area of the light-sensitive material is than the ratio of the value obtained by dividing the value of the coated silver amount of the emulsion by the value of the $3/2^{nd}$ power of the average grain projected area of the emulsion" means that the ratio of Pi to Qi($i \neq a$)is larger than the ratio of Pa to Qa (Pa/Qa=1). The relationship . . . >Pc/Qc>Pb/Qb>Pa/Qa is the most preferable in the present invention.

By having such a construction, an image having good graininess can be obtained even under the development condition of heating at a high temperature and also, high developing property and wide exposure latitude canbe satisfactorily achieved at the same time.

In a color negative film conventionally used in photography, in order to attain a desired level of granularity, a silver halide emulsion has been improved and a so-called DIR coupler, which releases a compound capable of inhibiting the development by a coupling reaction with the oxidized form of a developing agent, has been used. The light-sensitive material according to the present invention provides an excellent level of granularity even if a DIR coupler is not used in the light-sensitive material. If the light-sensitive material according to the present invention contains a DIR coupler, the level of granularity is further improved.

In order to improve color reproduction, it is preferable to arrange a donor layer (CL), which provides a double-layer effect and has a distribution of spectral sensitivity different from that of main light-sensitive layers such as BL, GL and RL, in a position adjacent or close to the main light-sensitive layer, as described in U.S. Pat. Nos. 4,663,271, 4,705,744 and 4,707,436, and JP-A Nos. 62-160,448 and 63-89,850.

In the present invention, a silver halide, a color forming coupler and a developing agent may be contained in the same layer. However, if these substances are likely to react with each other, they may be incorporated in separate layers. For example, if the developing agent is contained in one layer and the silver halide is contained in another layer, the storage stability of the unexposed light-sensitive material can be increased.

In the present invention, a color reproduction according to a subtractive color process can be basically used for the preparation of a light-sensitive material which is used for the recording of an original scene and reproducing it as a color image. That is, the color information of the original scene can be recorded by means of a light-sensitive material having at least three light-sensitive layers, which have sensitivity to the blue, green, and red wavelength regions of light, respectively, and are incorporated, respectively, with a color coupler capable of producing a yellow, magenta or cyan dye as a complementary hue of the sensitive wavelength region of the layer. Through the thus obtained dye image, color photographic paper, which has a wavelength sensitivity to hue relationship identical to that of the light-sensitive material, is optically exposed to thereby reproduce the original scene. Alternatively, it is also possible to reproduce an image for enjoyment by reading out by means of a scanner the information of the colar dye image obtained by taking a photograph of an original scene.

The light-sensitive material of the present invention can comprise a light-sensitive layer which has sensitivity to three or more wavelength regions of light.

In addition, the relationship between the sensitive wavelength region and the hue of the layer may be different from the complementary hue relationship described above. In this case, the original color information can be reproduced by image processing, e.g., hue conversion, of the image information which has been read out as described above.

Although the relationship between the spectral sensitivity and hue of a coupler may be selected at will in each of the layers, the combination, in which a red-sensitive layer contains a cyan coupler, a green-sensitive layer contains a magenta coupler and a blue-sensitive layer contains a yellow coupler, enables the light-sensitive material to be directly projected for exposure of conventional color paper and the like.

A non-light-sensitive layer, such as a protective layer, a primer layer, an intermediate layer, a yellow filter layer or an antihalation layer, may be formed between the silver halide emulsion layers, or as a top layer or a bottom layer. Further, a supplementary layer, such as a back layer, may be formed on the reverse side of the support. More specifically, it is possible to form various layers including the above-mentioned construction, a primer layer described in U.S. Pat. No. 5,051,335, an intermediate layer containing a solid pigment described in JP-A Nos. 1-167,838 and 61-20,943, an intermediate layer containing a reducing agent or a DIR compound described in JP-A Nos. 1-120,553, 5-34,884 and 2-64,634, an intermediate layer containing an electron transferring agent described in U.S. Pat. No. 5,017,454 and 5,139,919 and in JP-A No. 2-235,044 and a protective layer containing a reducing agent described in JP-A No. 4-249, 245 as well as a combination of two or more of these layers.

A dye, which can be used in a yellow filter layer in an a magenta filter layer or in an antihalation layer, is preferably a dye which loses its color or is leached out of these layers at the time of development so that it exerts no influence on the density of image after the developing process of the light-sensitive material.

That the dye which is present in a yellow filter layer or in the antihalation layer loses its color or is eliminated at the time of development means that the amount of the dye remaining after the developing process is less than one third, preferably less than one tenth, of the amount of the dye present immediately before the process. This may be attained by a phenomenon in which the component of the dye is transferred into the processing material at the time of development, or by a phenomenon in which the component of the dye undergoes a reaction and becomes a colorless compound at the time of development.

Concrete examples of the dyes include the dye described in European Patent Application No. 549,489A and the dye described in JP-A No. 7-152,129, ExF 2-6. A dye which is solid-dispersed and is described in JP-A Nos. 8-101487 can also be used.

Further, it is also possible to mordant a dye to a mordant and a binder. In this case, the mordant and the dye may be those well known in the field of photography. Examples of the mordants include those described in U.S. Pat. No. 4,500,626, columns 58-59 and in JP-A Nos. 61-88,256, pp. 32–41, 62-244,043 and 62-244,036.

Furthermore, it is also possible to use a reducing agent and a compound which reacts with the reducing agent to release a diffusive dye so that the alkali at the time of development causes the reaction to release a mobile dye, which will be eliminated by being transferred to the processing sheet. Examples of these compounds and reducing agents are described in U.S. Pat. Nos. 4,559,290 and 4,783, 396, European Patent No. 220,746A2, Journal of Technical Disclosure No. 87-6,119 and JP-A Nos. 8-101,487, paragraph 0080-0081.

A leuco dye, which is achromatized , can also be used. For example, JP-A No. 1-150,132 discloses a silver halide light-sensitive material containing a leuco dye which is given a color in advance by means of a metal salt of an organic acid as a color developer. A complex of a leuco dye and a color developer undergoes a reaction by heat or reacts with an alkali to be achromatized.

In the present invention, a known leuco dye can be used, examples of which are described in Moriga and Yoshida, "Dyes and Chemicals", Vol. 9, pp. 84, Association of Chemical Products, "New Handbook of Dyes", pp. 242, Maruzen Co., Ltd.(1970), R. Garner, "Reports on the progress of Appl. Chem", Vol. 56, pp. 199 (1971), "Dyes and Chemicals", Vol. 19, pp. 230, Association of Chemical Products (1974), "Color Materials", Vol. 62, pp. 288 (1989) and "Dye Industry", Vol. 32, pp. 208.

Preferred color developers are a metal salt of an organic acid in addition to acid clay and a phenol/formaldehyde resin. Among metal salts of organic acids, metal salts of salicylic acid, metal salts of a phenol/salicylic acid/formaldehyde resin, rhodanates and metal salts of xanthogenic acid are preferable. Zinc is particularly preferable among the metals. An oil-soluble zincsalicylate described in U.S. Pat. Nos. 3,864,146 and 4,046,941 and in JP-B No. 52-1,327 can also be used as the color developers.

The light-sensitive material of the present invention is preferably hardened by means of a hardener.

Examples of the hardener include those described in U.S. Pat. Nos. 4,678,739, column 41 and 4,791,042, and in JP-A Nos. 59-116,655, 62-245,261, 61-18,942 and 4-218,044. More specifically, examples of these hardeners include an aldehyde (e.g., formaldehyde), an aziridine, an epoxy, a vinylsulfone (e.g., N,N'-ethylene-bis (vinylsulfonylacetamide)ethane), an N-methylol compound (e.g., dimethylolurea), boric acid, metaboric acid and a polymeric compound (e.g., a compound described in, e.g., JP-A No. 62-234,157).

The amount of the hardener added is in the range of 0.001 g to 1 g, preferably 0.005 to 0.5 g, per gram of the hydrophilic binder.

The light-sensitive material of the present invention may contain an anti-fogging agent or a photographic stabilizer as well as a precursor thereof, examples of which include the compounds described in the aforesaid RD, U.S. Pat. Nos. 5,089,378, 4,500,627 and 4,614,702, JP-A No. 64-13,564, pp. 7–9, pp. 57–71 and pp. 81–97; U.S. Pat. Nos. 4,775,610, 4,626,500 and 4,983,494, JP-A Nos. 62-174,747, 62-239, 148, 1-150,135, 2-110,557, 2-178,650 and RD 17,643 (1978) pp. 24-25.

The amount of these compounds added is preferably in the range of $5\times10^{-6}$ to $1\times10^{-1}$ mol, more preferably $1\times10^{-5}$ to $1\times10^{-2}$ mol, per mol of silver.

For such purposes as improvement of the coatability, improvement of the releaseability, improvement of the slipperiness, prevention of electrostatic charge and acceleration of developing reaction, a surfactant may be added to the light-sensitive material. Examples of the surfactant include those described in "Known Technologies" No. 5 (issued on Mar. 22, 1991, ASTECH Inc.), pp. 136–138, and in JP-A Nos. 62-173,643 and 62-183,457.

For such purposes as prevention of slip, prevention of electrostatic charge and improvement of the releaseability, an organic fluorine-containing compound may be added to the light-sensitive material. Typical examples of the organic fluorine-containing surfactant include a fluorine-containing surfactant and a hydrophobic fluorine-containing compound, an oiled fluorine compounds e.g., fluorocarbon oil, and a solid fluorine-containing resin, e.g., tetrafluoroethylene, described in JP-B No. 57-9,053, columns 8–17, JP-A Nos. 61-20,944 and 62-135,826. The use of a fluorine-containing surfactant having a hydrophilic group is also preferable for the realization of the two purposes of maintaining the wettablility and preventing electric charge of the light-sensitive material.

Preferably, the light-sensitive material has a certain level of slipperiness. For this purpose, layers containing a slicking agent are preferably formed on the surfaces of both a light-sensitive layer and aback layer. A preferable level of slipperiness is indicated by a coefficient of dynamic friction of 0.01 to 0.25. This value represents a measured value determined in a test comprising sliding the light-sensitive material at a rate of 60 cm/minute against stainless steels ball having a diameter of 5 mm (25° C., 60% RH). In this evaluation, a value of nearly the same level is obtained even when the stainless steel balls are replaced with the surface of a light-sensitive layer.

Examples of usable slicking agents include polyorganosiloxanes, higher fatty acid amides, metals salts of higher fatty acids, and esters of higher fatty acids and higher alcohols. Examples of the polyorganosiloxanes include polydimethylsiloxane, polydiethylsiloxane, polystyrylmethylsiloxane and polymethylphenylsiloxane. A layer to which the slicking agent is added is preferably the outermost emulsion layer or the back layer.

Polydimethylsiloxanes or esters having a long-chain alkyl group are particularly preferable. Silicone oils and chlorinated paraffins are preferably used in order to prevent the pressure-induced fogging or reduction in sensitivity of silver halide.

In the present invention, an antistatic agent is preferably used. Examples of the antistatic agent include carboxylic acids, carboxylates, polymers containing a sulfonate group, cationic polymers and ionic surfactant compounds.

It is most preferable to use as the antistatic agent at least one finely-divided crystalline metal oxide which is selected from the group consisting of ZnO, $TiO_2$, $SnO_2$, $Al_2O_3$, $In_2O_3$, $SiO_2$, MgO, BaO, $MoO_3$ and $V_2O_5$ and which has a volume resistivity of $10^7$ Ω·cm or less, more preferably $10^5$ Ω·cm or less, and a particle size of 0.001 to 1.0 μm, fine particles of composite oxides (e.g., Sb, P, B, In, S, Si and C) of these metal oxides, fine particles of metal oxides in a sol state, or fine particles of composite oxides of these metal oxides in a sol state. The content in the light-sensitive material is preferably 5 to 500 mg/m$^2$, and most preferably 10 to 350 mg/m$^2$. The weight ratio of an electroconductive crystalline oxide or its composite oxide to the binder is preferably 1/300 to 100/1, and more preferably 1/100 to 100/5. It is also preferable to coat a water-resistant polymer, described in JP-A No. 8-292,514, on the back of the support of the light-sensitive material.

Constituent layers (including back layers) of the light-sensitive material or processing material which is described later can contain a polymer latex in order to improve film physical properties such as dimension stability, prevention of curling, prevention of adhering, prevention of film cracking and prevention of pressure-induced sensitization or desensitization. Any of polymer latices, which are described in, e.g., JP-A Nos. 62-245,258, 62-136,648 and 62-110,066, can be used. Particularly, the utilization of a polymer latex having a low glass transition point (40° C. or below) in the mordant layer can prevent cracking of the mordant layer, while the utilization of a polymer latex having a high glass transition point in the back layer provides a curl-preventing effect.

The light-sensitive material of the present invention preferably contains a matting agent. Although the matting agent can be added to either the emulsion surface or the back surface, it is most preferable that the matting agent be added to the outermost layer on the same side of the support as the emulsion layer is provided. The matting agent may be either soluble or insoluble in the processing solutions, and it is preferable to use a combination of a soluble matting agent and an insoluble matting agent. Preferable examples are particles of polymethylmethacrylate, particles of poly (methylmethacrylate/methacrylic acid) (in a molar ratio of 9/1 or 5/5) and particles of polystyrene. The matting agent has particle diameters preferably in the range of 0.8 to 10 μm and preferably a narrow range of particle diameter distribution. It is preferable that 90% or more of the total number of the particles have a diameter falling in the range of 0.9 to 1.1 times the average particle diameter. Meanwhile, in order to enhance the matting effect, it is also preferable to use fine particles having a diameter of 0.8 μm or less, together with the matting agent having the above-mentioned particle diameter. Examples of the fine particles include particles of polymethylmethacrylate (0.2 μm), particles of poly (methylmethacrylate/methacrylic acid) (in a molar ratio of 9/1, 0.3 μm), particles of polystyrene (0.25 μm) and particles of colloidal silica (0.03 μm).

Concrete examples of the matting agent are described in JP-A No. 61-88,256, pp. 29. Other examples of the matting agent are such materials as benzoguanamine resin beads, polycarbonate resin beads and AS resin beads, all of which are described in JP-A Nos. 63-274,944 and 63-274,952. Further, the compounds which are described in the aforementioned RD can be employed as the matting agent.

As necessary, these matting agents may be dispersed in binders described in the paragraph relating to binders and thereafter used as dispersions. Particularly, a dispersion in gelatin, for example, acid-processed gelatin, easily provides a stable coating solution, in which parameters, i.e., pH, ion strength and binder density, are preferably optimized, as necessary.

The following compounds can also be used:

Dispersing media for oil-soluble organic compounds: P-3, P-5, P-16, P-19, P-25, P-30, P-42, P-49, P-54, P-55, P-66, P-81, P-85, P-86 and P-93 (pages 140 to 144) in JP-A No. 62-215,272;

Latices for impregnating oil-soluble organic compounds: latices described in U.S. Pat. No. 4,199,363; Scavengers for oxidized forms of developing agents: compounds represented by Formula (I) in column 2, lines 54 to 62 (particularly I-(1), I-(2) I-(6) and I-(12) (columns 4 and 5)) in U.S. Pat. No. 4,978,606, and compounds represented by formulas in column 2, lines 5 to 10 (particularly compound 1 (column 3)) in U.S. Pat. No. 4,923,787; Stain inhibitors: Compounds represented by Formulas (I) to (III) on page 4, lines 30 to 33, and particularly I-47, I-72, III-1 and III-27 (pages 24 to 48) in European Patent No. 298,321A; Browning inhibitors: A-6, A-7, A-20, A-21, A-23, A-24, A-25, A-26, A-30, A-37, A-40, A-42, A-48, A-63, A-90, A-92, A-94 and A-164 (pages 69 to 118) in European Patent No. 298,321A, II-1 to III-23, particularly III-10, in columns 25 to 38 in U.S. Pat. No. 5,122,444, I-1 to III-4, particularly II-2, on pages 8 to 12 in European Patent No. 471,347A, and A-1 to A-48, particularly A-39 and A-42, in columns 32 to 40 in U.S. Pat. No. 5,139,931; Materials which reduce the use amount of a color enhancer or a color amalgamation inhibitor: I-1 to II-15, particularly I-46, on pages 5 to 24 in European Patent No. 411,324A; Formalin scavengers: SCV-1 to SCV-28, particularly SCV-8, on pages 24 to 29 in European Patent No. 477,932A; Film hardeners: H-1, H-4, H-6, H-8 and H-14 on page 17 in JP-A No. 1-214,845, compounds (H-1 to H-54) represented by Formulas (VII) to (XII) in columns 13 to 23 in U.S. Pat. No. 4,618,573, compounds (H-1 to H-76), particularly H-14, represented by Formula (6) on page 8, lower right column, in JP-A No. 2-214,852, and compounds described in claim 1 of U.S. Pat. No. 3,325,287;

Precursors of development inhibitors: P-24, P-37 and P-39 (pages 6 and 7) in JP-A No. 62-168,139 and compounds described in claim 1, particularly compounds 28 and 29, in column 7, of U.S. Pat. No. 5,019,492; Antiseptic agents and mildew-proofing agents: I-1 to III-43, particularly II-1, II-9, II-10, II-18 and III-25, in columns 3 to 15 of U.S. Pat. No. 4,923,790;

Stabilizers and anti-fogging agents: I-1 to (14), particularly I-1, 60, (2) and (13), in columns 6 to 16 in U.S. Pat. No. 4,923,793, and compounds 1 to 65, particularly compound 36, in columns 25 to 32 in U.S. Pat. No. 4,952,483;

Chemical sensitizers: triphenylphosphine selenide and compound 50 described in JP-A No. 5-40,324;

Dyes: a-1 to b-20, particularly a-1, a-12, a-18, a-27, a-35, a-36 and b-5 on pages 15 to 18, and V-1 to V-23, particularly V-1, on pages 27 to 29 in JP-A No. 3-156,450, F-I-1 to F-II-43, particularly F-I-11 and F-II-8, on pages 33 to55 in European Patent No. 445,627A, III-1 to III-36, particularly III-1 and III-3, on pages 17 to 28 in European Patent No. 457,153A, fine crystal dispersions of Dye-1 to Dye-124 on pages 8 to 26 in WO 88/04,794, compounds 1 to 22, particularly compound 1, on pages 6 to 11 in European Patent No. 319,999A, compounds D-1 to D-87 (pages 3 to 28) represented by Formulas (1) to (3) in European Patent No. 519,306A, compounds 1 to 22 (columns 3 to 10) represented by Formulas (I) in U.S. Pat. No 4,268,622, and compounds (1) to (31) (columns 2 to 9) represented by Formulas (I) in U.S. Pat. No. 4,923,788;

Ultraviolet absorbents: compounds (18b) to (18r) and 101 to 427 (pages 6 to 9) represented by Formulas (1) in JP-A No. 46-3,335, compounds (3) to (66) (pages 10 to 44) represented by Formula (I) and compounds HBT-1 to HBT-10 (page 14) represented by Formula (III) in European Patent No. 520,938A and compounds (1) to (31) (columns 2 to 9) represented by Formula (1) in European Patent No. 521,823A.

The additives described above, such as a film hardener, an anti-fogging agent, a surfactant, a slicking agent, anantistatic agent, a latex and a matting agent, may be added, as necessary, to a processing material or to both of the processing material and a light-sensitive material.

In the present invention, a support for the light-sensitive material needs to be transparent and to be able to withstand the processing temperature. Generally, examples of the support are paper, a synthetic polymer (film) and the like, as described in "Fundamentals of Photographic Engineering—Silver Salt Photography Section", pp. 223–240, edited by Photographic Society of Japan, Corona Co., Ltd., 1979. Concrete examples of the support include polyethylene terephthalate, polyethylene naphthalate, polycarbonate, polyvinyl chloride, polystyrene, polypropylene, polyimide and cellulose (e.g., triacetylcellulose).

Among these materials, particularly preferable is polyester composed mainly of polyethylene naphthalate as principal constituent. The term "polyester composed mainly of polyethylene naphthalate" as used herein means polyester in which the proportion of naphthalenedicarboxylic acid contained in the total dicarboxylic acid residue is 50 mol % or more. The proportion is preferably 60 mol % or more, and more preferably 70 mol % or more. The polyester may be a copolymer, or may be a polymer blend.

In the case of a copolymer, preferably, a unit, such as terephthalic acid, bisphenol A, or cyclohexanedimethanol, is copolymerized in addition to the naphthalenedicarboxylic acid unit and the ethylene glycol unit. Among these copolymers, the most preferable compound from the viewpoint of mechanical strength and costs is a copolymer comprising terephthalic acid unit in addition to the naphthalenedicarboxylic acid unit and the ethylene glycol unit.

From the viewpoint of compatibility, a preferable counterpart for preparing a polymer blend is polyester such as polyethylene terephthalate (PET), polyarylate (PAr), polycarbonate (PC), or polycyclohexanedimethanol terephthalate (PCT). Among these polyesters, the most preferable as the counterpart from the viewpoint of mechanical strength and costs is PET.

Specific examples of preferable polyesters are given below.

Polyesters as a copolymer (the numbers in parentheses indicate molar ratios):

2,6-naphthalenedicarboxylic acid/terephthalic acid/ethylene glycol (70/30/100), Tg=98° C.

2,6-naphthalenedicarboxylic acid/terephthalic acid/ethylene glycol (80/20/100), Tg=105° C.

Polyesters as a polymer blend (the numbers in parentheses indicate weight ratios):

PEN/PET (60/40), Tg=95° C.

PEN/PET (80/20), Tg=104° C.

Other supports, which can be used in the present invention, include those described in, e.g., JP-A Nos. 62-253,159, pp. 29–31, 1-161, 236, pp. 14–17, 63-316,848, 2-22,651 and 3-56,955 and U.S. Pat. No. 5,001,033. In order to improve optical properties and physical properties, these supports may undergo treatments such as a thermal treatment (control of degree of crystallization or orientation), uniaxial or biaxial stretching (control of orientation), blending with other polymer and a surface treatment.

Where requirements of resistance to heat and curling are stringent, preferred examples of the supports are those described in JP-A Nos. 6-41,281, 6-43,581, 6-51,426, 6-51,437, 6-51,442, 6-82,961, 6-82,960, 6-123,937, 6-82,959, 6-67,346, 6-118,561, 6-266,050, 6-202,277, 6-175,282, 6-118,561, 7-219,129 and 7-219,144.

Also preferable is a support made from a styrene-based polymer mainly composed of a syndiotactic structure. The thickness of the support is preferably 5 to 200 μm and more preferably 40 to 120 μm.

In order to bond the constituent photographic layer to the support, it is preferable that the support be surface-treated. Examples of the surface-activating treatments include a chemical treatment, a mechanical treatment, a corona discharge treatment, a flame treatment, an ultraviolet ray treatment, a high frequency wave treatment, a glow discharge treatment, an activated plasma treatment, a laser treatment, a mixed acid treatment and an ozone-oxidation treatment. Among these surface treatments, an ultraviolet irradiation treatment, a flame treatment, a corona discharge treatment and glow discharge treatment are particularly preferable.

A primer layer is described below. The primer layer may consist of a single layer or two or more layers. Examples of the binder for the primer layer include a copolymer, which is made up of a monomer, as a starting material, selected from the group consisting of vinyl chloride, vinylidene chloride, butadiene, methacrylic acid, acrylic acid, itaconic acid, maleic anhydride and the like, polyethyleneimine, an epoxy resin, grafted gelatin, nitrocellulose, gelatin, polyvinyl alcohol, and modified polymers thereof. Examples of the compounds, which swells the support, include resorcin and p-chlorophenol. The primer layer may contain a gelatin-hardening agent such as chromates (e.g., chromium alum), aldehydes (e.g., formaldehyde and glutaraldehyde), isocyanates, active halogenated compounds (e.g., 2,4-dichloro-6-hydroxy-s-triazine), epichlorohydrin resins and active vinylsulfones. Further, the primer layer may contain $SiO_2$, $TiO_2$, particles of an inorganic material or particles of a copolymer of methyl methacrylate (0.01 to 10 μm) as a matting agent.

Regarding the dye used for film dying, gray dyeing is preferable from the viewpoint of general properties of the light-sensitive element, and a dye which has excellent heat resistance in the film forming temperature region and has excellent compatibility with polyester is preferable. From this point of view, it is possible to attain the desired result by mixing a dye which is commercially available as a polyester dye such as Diaresin, manufactured by Mitsubishi Chemical Co., Ltd., Kayaset manufactured by Nippon Kayaku Co., Ltd. and the like. In particular, from the viewpoint of heat resistance stability, anthraquinone-type dyes are listed. For example, those described in Japanese Patent Application Laid-Open (JP-A) No. 8-122970 can be preferably used.

In addition, it is preferable to record photographic information and the like by use of a support which is provided with a magnetic recording layer and is described in JP-A Nos. 4-124,645, 5-40,321, 6-35,092 and 6-317,875.

A magnetic recording layer is formed by coating onto a support an aqueous or organic solvent-based coating solution comprising a binder and magnetic particles dispersed therein.

Examples of usable magnetic particles include ferromagnetic iron oxide such as $\gamma$-$Fe_2O_3$, Co-deposited $\gamma$-$Fe_2O_3$, Co-deposited magnetite, Co-containing magnetite, ferromagnetic chromium dioxide, ferromagnetic metals, ferromagnetic alloys, hexagonal Ba-ferrite, Sr-ferrite, Pb-ferrite and Ca-ferrite. A Co-deposited ferromagnetic iron oxide such as Co-deposited $\gamma$-$Fe_2O_3$ is preferable. The particle can take the shape of any of, e.g., a needle, a rice grain, a sphere, a cube and a plate. The specific surface area in $S_{BET}$ is preferably 20 $m^2/g$ or greater, more preferably 30 $m^2/g$ or greater. The saturation magnetization ($\sigma s$) of the ferromagnetic substance is preferably in the range of $3.0\times10^4$ to $3.0\times10^5$ A/m, more preferably $4.0\times10^4$ to $2.5\times10^5$ A/m. The ferromagnetic particles may be surface-treated with silica and/or alumina or with an organic substance. Further, as described in JP-A No. 6-161,032, the ferromagnetic particles may be surface-treated with a silane coupling agent or with a titanium coupling agent. Magnetic particles, which are covered with an inorganic or organic substance and are described in JP-A Nos. 4-259,911 and 5-81,652, can also be used in the present invention.

As described in JP-A No. 4-219,569, the binders usable together with the magnetic particles are thermoplastic resin, thermosetting resin, radiation-curable resins, reactive resins, acid-, alkali- or biodegradable polymers, naturally occurring polymers (e.g., cellulose derivatives and derivatives of saccharides) and mixtures thereof. These resins have a Tg in the range of −40 to 3000° C. and a weight average molecular weight in the range of 2,000 to 1,000,000. Preferred examples of the binder include vinyl copolymers, cellulose derivatives, such as cellulose diacetate, cellulose triacetate, cellulose acetatepropionate, cellulose acetatebulylate and cellulose tripropionate, acrylic resins, polyvinyl acetal resins and gelatin. Cellulose di (tri)acetate is particularly preferable. The binder may be hardened by use of a crosslinking agent such as an epoxy, aziridine or isocyanate crosslinking agent. Examples of the isocyanate crosslinking agent include isocyantes, such as tolylenediisocyanate, 4,4'-diphenylmethanediisocyanate, hexamethylenediisocyanate and xylylenediisocyanate, a reaction product of any of these isocyanates and a polyalcohol (e.g., a tolylenediisocyanate/trimethylol propane in 3/1 molar ratio adduct) and a polyisocyanate produced by a condensation reaction of these isocyanates, all of which are described, for example, in JP-A No. 6-59,357.

As described in JP-A No. 6-35,092, the aforementioned magnetic particles are dispersed in a binder preferably by means of a kneader, a pin-type mill or an annular mill. A combination of these dispersing means is also preferable. Dispersants described in JP-A No. 5-088,283 and other known dispersants can be used. The thickness of the magnetic recording layer is in the range of 0.1 to 10 μm, preferably 0.2 to 5 μm, and more preferably 0.3 to 3 μm. The ratio of the weight of the magnetic grains to the weight of the binder is preferably in the range of 0.5:100 to 60:100, more preferably 1:100 to 30:100. The coated amount of the magnetic particles is in the range of 0.005 to 3 $g/m^2$, preferably 0.01 to 2 $g/m^2$, and more preferably 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer may be formed on the entire surface or in a stripe on the reverse side of a photographic support by coating or printing the coating solution for forming the magnetic recording layer. Employable methods for forming the magnetic recording layer include an air doctor method, a blade method, an air knife method, squeezing, impregnation, reverse roll coating, transfer roll coating, gravure coating, kissing, casting, spraying, dipping, bar coating and extrusion. The coating solution, which is described, for example, in JP-A No. 5-341,436, is preferably used.

The magnetic recording layer may also function in the enhancement of lubrication, control of curling, prevention of electrostatic charge, prevention of adhering and head polishing. Alternatively, another functional layer can be formed and any of these functions can be given to that layer. It is preferable to use a polishing agent comprising abrasive particles whose at least one kind is composed of non-spherically shaped inorganic particles having a Mohs hardness of 5 or greater. Examples of the composition of non-spherical inorganic particles include oxides, such as aluminum oxide, chromium oxide, silicon dioxide and titanium dioxide, carbides, such as silicon carbide and titanium carbide, and a fine powder of diamond. The surface of abrasive particles may be treated with a silane coupling agent or with a titanium coupling agent. These particles may be added to the magnetic recording layer. Alternatively, the magnetic recording layer may be overcoated with a coating solution (e.g., a protective layer and lubricating layer) containing these grains. As for the binder in the overcoat, the same binders as those mentioned above may be used, and the binder in the overcoat is preferably the same as that for the magnetic recording layer. The light-sensitive materials having a magnetic recording layer are described in U.S. Pat. Nos. 5,336,589, 5,250,404, 5,229,259 and 5,215,874 and in European Patent No. 466,130.

A polyester support suitable for use in the light-sensitive material having a magnetic recording layer in the present invention is described below. Details of the polyester support, light-sensitive materials, treatments, cartridges and examples are described in Journal of Technical Disclosure No. 94-6,023 (JIII; Mar. 15, 1994). The polyester used in the present invention is made up of a diol and an aromatic dicarboxylic acid as essential components. Examples of the aromatic dicarboxylic acid include 2,6-, 1,5-, 1,4- and 2,7-naphthalenedicarboxylic acids, terephthalic acid, isophthalic acid and phthalic acid. Examples of the diol include diethyleneglycol, triethyleneglycol, cyclohexanedimethanol, bisphenol A and bisphenol. Examples of the polymer are homopolymers such as polyethylene terephthalate, polyethylene naphthalate and polycyclohexanedimethanol terephthalate. The polyester containing 50 to 100 mol% of 2,6-naphthalenedicarboxylic acid is particularly preferable. Polyethylene 2,6-naphthalate is most preferable among these polymers. The average molecular weight ranges between 5,000 and 200,000. The Tg of the polyesters for use in the present invention is 50° C. or higher, preferably 90° C. or higher.

In order to make the polyester support more resistant to curling, the polyester support is heat-treated at a temperature within the range of from 40° C. up to Tg, more preferably at a temperature within the range of from Tg-20° C. up to Tg. The heat treatment can be performed at a fixed temperature within this range or can be performed while being cooled. The heat treatment time is 0.1 to 1,500 hours, more preferably 0.5 to 200 hours. The heat treatment can be performed in the form of a rolled support or while the support is conveyed in the form of a web. Grooves and bumps (e.g., coating the surface with electroconductive inorganic fine particles such as $SnO_2$ or $Sb_2O_5$) may be given to the surface to improve the surface condition. It is also desirable to knurl and slightly raise the edge portions, thereby preventing the shape of the cut edge portions of the core from being transferred. These heat treatments can be performed at any stage, for example, after the film making of the support, after surface treatment, after back layer coating (e.g., an antistatic agent or lubrication agent) and after the application of a primer. A preferable stage for the heat treatment is after the application of the antistatic agent.

An ultraviolet absorbent may be incorporated into this polyester. Also, the prevention of light piping can be achieved by incorporating the polyester with a dye or pigment, such as "Diaresin" manufactured by Mitsubishi Chemical Industries, Ltd. or "Kayaset" manufactured by Nippon Kayaku Co., Ltd., which is commercially available as an additive to polyester.

A film cartridge, into which the light-sensitive material of the present invention may be encased, is explained below. The main material of the film cartridge may be a metal or a synthetic plastic.

Preferable examples of the plastic material include polystyrene, polyethylene, polypropylene and polyphenylene ether. The film cartridge may contain an antistatic agent, examples of which include carbon black, metal oxide particles, surfactants such as nonionic, anionic, cationic and betaine-based surfactants, and polymers. Examples of the film cartridges(patrones), which have been rendered antistatic, are described in JP-A Nos. 1-312,537 and 1-312,538. The resistivity of the film cartridge is preferably $10^{12}$ Ω/□ or less in a condition of 25° C. and 25% RH. Normally, carbon black or a pigment is incorporated into the plastic film cartridge in order to afford shading. The size of the film cartridge maybe the 135 size which is currently employed. For use in a small-sized camera, a film cartridge having a diameter of the cartridge of 22 mm or less may be used in place of the currently employed 135 size having a diameter of cartridge of 25 mm. The cartridge volume of the film cartridge is 30 $cm^3$ or less and preferably 25 $cm^3$ or less. The weight of the plastics for a film cartridge is preferably in the range of 5 to 15 g.

A film cartridge which feeds out film by the rotation of a spool may be used in the present invention. A film cartridge in which the end of the film therein is fed from the port of the film cartridge to the outside by rotating the spool axis in the direction of the feed of the film can also be used. These film cartridges(patrones) are described in U.S. Pat. Nos. 4,834,306 and 5,226,613.

The light-sensitive material of the present invention described above is also suitable for use in a film unit with a lens described in JP-B No. 32,615 and Japanese Utility Model Application Publication (JP-Y) No. 3-39,784.

The film unit with a lens is obtained by pre-loaded in a light-proofing manner an unexposed color or monochrome photographic light-sensitive element, in a production process of a unit main body having an injection molded, for example, plastic body, equipped with a photographing lens and shutter. The unit after photographed by a user is transported as such to a developing laboratory for development. In the laboratory, the photographed film is taken out from this unit, and developing and photographic printing are carried out.

On the outer casing of this film unit with a lens, optical parts required for photographing such as a photographing lens, finder part and the like, and photographing operation parts such as a shutter button, winding knob and the like are exposed. This unit is wrapped for use, in a carton or a plastic envelop on which an explanation for the method of use and design are printed, as described in Japanese Utility Model Application Publication (JP-Y) Nos. 3-6910 and 5-31647, Japanese Patent Application Laid-Open (JP-A) No. 7-225454 and Japanese Utility Model Application Publication (JP-Y) No. 6-43798.

The film unit with a lens wrapped in paper or plastic is further wrapped in a dampproof material, for example, a wrapping article composed of a non-hydroscopic material having a water absorption of 0.1% or lower according to ASTM testing method D-570, for example, an aluminum foil laminated sheet, aluminum foil or metal-deposited transparent and dampproof plastic wrapping article, to be sold as described in Japanese Utility Model Application Publication (JP-Y) No. 4-1546 and Japanese Patent Application Publication (JP-B) No. 7-1380. From the viewpoint of storability of the photographic film loaded inside the film unit with a lens, the humidity of the film unit with a lens in the aforementioned dampproof wrapping article is controlled so that the relative humidity at 25° C. is from 40 to 70%, and preferably from 50 to 65%. Further, there is also a unit endowed with an underwater or water-proof function by housing the film unit with a lens, wrapped in paper or plastic in a transparent water-proof case, allowing shuttering and winding operations to be perfomed, as described in Japanese Utility Model Application Publication (JP-Y) Nos. 6-6346 and 6-8589 and U.S. Pat. No. 5,239,324.

The film unit main body from which the photographic film has been taken out in the laboratory is recycled to a production factory of the unit, examined, and then, parts which are able to be reused are reused, and a partial plastic parts which cannot be reused are melted, and made into pellets again for recycling.

As the photographing lens to be used, a plastic lens composed of one or two spherical or aspherical plastic lens is used as described in Japanese Patent Application Publication (JP-B) No. 7-56363, Japanese Patent Application Laid-Open (JP-A) No. 63-199351, Japanese Utility Model Application Publication (JP-Y) Nos. 3-22746, 3-39784, 5-38353, 7-33237 and 7-50746. It is preferable that the film receiving surface in the exposure area of the back lid, is formed with a curved surface so as to be concave in relation to the photographing lens, along the direction in which the film travels, in order to compensate for curvature aberrations in the lens. The finder may be a free through finder formed only by defining a finder aperture on the body corresponding to the image, as described in Japanese Utility Model Application Publication (JP-Y) Nos. 2-41621, 3-6910 and 3-39784, and also may be a reverse Galileo type or Albert type finder obtained by placing an ocular lens and an objective finder lens on the finder aperture as described in Japanese Utility Model Application Publication (JP-Y) No. 7-10345. Further, as described in Japanese Patent Application Laid-Open (JP-A) Nos. 7-64177, 6-250282 and 7-128732, it may also be possible that an image size switching function is imparted to the finder, and accordingly the photographing aperture can be switched to normal exposure size or panoramic exposure size or optical or magnetic information is recorded on the film to record that photographing has been conducted at standard, panoramic or high vision size according to this switching action of the finder. In addition, there is also a unit which can carry out close up photographing or telephotographing by altering the focal length of the photographing lens and specifying the finder visual field.

As the photographic film used in the film unit with lens, a film in the form of a sheet or roll can be used, and further, the photographic film is directly loaded as described in Dutch Patent (DP) No. 6,708,489, or loaded in a container before being loaded in the film unit with a lens as described in Japanese Patent Application Publication (JP-B) No. 2-32615. After being photographed, in order to take out the photographed film from the film unit with a lens for development, a lid may be made for taking out the photographed film at the bottom of the film unit body with a lens, and the lid may be opened for taking out the film as described in Japanese Patent Application Publication (JP-B) No. 6-16158 and Japanese Utility Model Application Publication (JP-Y) No. 7-15545, or the back lid may be opened or broken to take out the photographed film as described in DP No. 6,708,489. Further, as described in U.S. Pat. No. 5,202,713, an opening which is usually in light-shielded condition may be formed on a part of the film unit body with a lens, and one end of the film then may be clamped and the film may be drawn out by the clamp as described in aforementioned Japanese Patent Application Publication (JP-B) No. 2-32615.

When a photographic film in the form of a roll is used in the film unit with a lens, it is desirable that the photograph film in the form of a roll is loaded in a container and the container is loaded in the film unit with a lens. As the container used, there are advantageously used cartridges for 135 film prescribed by the ISO Standard described in Japanese Patent Application Laid-Open (JP-A) Nos. 54-111822 and 63-194255, U.S. Pat. Nos. 4,832,275 and 4,834,306, Japanese Patent Application Laid-Open (JP-A) Nos. 2-124564, 3-155544, 2-264248, Japanese Utility Model Application Publication (JP-Y) No. 5-40508, Japanese Patent Application Publication (JP-B) Nos. 2-32615 and 7-117707, or cartridges having a narrower diameter than that of the above-described Standard which can accommodate a photographic film prescribed in the ISO standard, or single-shaft cartridges having a spool to which one end of a film is fixed, such as a cartridge for APS (Advanced Photo System) described in Japanese Patent Application Laid-Open (JP-A) Nos. 8-211509, 8-262645 and 8-262639. Further, two-shaft cartridges using a 110 size standard film described in Japanese Utility Model Application Publication (JP-Y) Nos. 4-14748 and 3-22746 can also be used. And optionally, a photographic film having a backing paper can also be used.

When the single-shaft axial cartridge having a spool to which one end of a film is fixed is used, it is possible that prewind loading during the production stages (factory prewind) of the film unit with a lens is conducted in which the cartridge is housed in one compartment of the film unit with a lens, and most of the photographic film, drawn from the cartridge and wound in the form of a roll, is housed in another compartment, and a part of the photographic film drawn out of the compartment after each photograph is taken is wound on the cartridge by rotating the spool of the cartridge using an external winding member, or reversely, that a spool not in the cartridge to which the leading end of the photographic film is fixed, is housed in one accommodation compartment of the film unit with a lens, and the cartridge in which most of the photographic film is loaded is housed in another compartment, and the photographic film is drawn from the cartridge and wound on the spool not in the cartridge by an external winding member after each photograph is taken.

In the factory prewind method, the photographic film drawn out from the cartridge may be wound on a spool not in the cartridge, and may be loaded in another compartment, or as described in Japanese Patent Application Publication (JP-B) No. 2-32615, may be loaded in another compartment in an empty state. Further, in the above-described factory prewind, it is possible that the photographic film is previously drawn out from the cartridge to be wound in the form of a roll in a dark soon, this cartridge and the photographic film in the form of a roll are loaded in the film unit with a lens, then the back lid of the film unit with a lens is closed to shield from the light as described in Japanese Patent Application Publication (JP-B) No. 7-56564, or the cartridge in which most of the photographic film is loaded is housed in one compartment, and a spool not in the cartridge to which the leading end of the photographic film is fixed, is housed in another compartment, and the back lid is closed to shield from the light, then the film is wound from the first spool to the other spool by rotating it from the outside of the film unit.

As described in Japanese Utility Model Application Publication (JP-Y) Nos. 4-1546 and 7-20667, the film unit with a lens is advantageously equipped with a self cocking mechanism which, from the driving action of the slave sprocket when it is engaged by the film perforations during the winding action after each photograph is taken, charges the shutter mechanism to kick the shutter blades, as well as preventing the film from being wound on any further. The charged shutter mechanism is released from the charged position by the action of depressing the shutter button, kicking the shutter blades to make the exposure and take the photograph and, at the same time, making rewinding of the film possible. Further, the film unit with a lens may build in a flashtube circuit board on the outside of which a switch is made for flashtube charging, and in this case, a structure may be formed in which the flash output is linked with the photographing operation by the turning on of a flash synchronizing switch in response to the above-described photographing exposure operation by the shutter blades, as described in Japanese Utility Model Application Publication (JP-Y) Nos. 2-34688, 6-41227, Japanese Patent Application Laid-Open (JP-A) No. 7-122389 and Japanese Patent Application Publication (JP-B) No. 6-12371.

On the other hand, as described in Japanese Utility Model Application Publication (JP-Y) No. 4-1546, a counter displaying the number of photographs taken or remaining is provided on the film unit with a lens. Further, this counter has a mechanism which release the above-described shutter charge and the frame by frame winding preventor in response to winding up after photographing of the final frame, and by this mechanism, the photographic film can be wound up continuously to the final winding position by the subsequent winding action.

The processing layer of the processing element used in the present invention contains at least a base and/or base precursor.

As the base, an inorganic or organic base can be used. Examples of the inorganic base include ammonia, hydroxides, phosphates, carbonates, borates and organic acid salts of alkali metal or alkaline earth metal described in Japanese Patent Application Laid-Open (JP-A) No. 62-209448, and acetylides of alkaline metal or alkaline earth metal, and,the like described in Japanese Patent Application Laid-Open (JP-A) No. 63-25208.

Examples of the organic base include aliphatic or aromatic amines (e.g. primary amines, secondary amines, tertiary amines, polyamines, hydroxylamines, heterocyclic amines), amidines, bis or tris or tetraamidine, guanidines, water-insoluble mono, bis, tris or tetraguanidines, hydroxides of quaternary ammonium, and the like.

As the base precursor, decarboxylated type, decomposition type, reaction type and complex salt-forming type precursors can be used.

In the present invention, as described in European Patent Application No. 210,660 and U.S. Pat. No. 4,740,445, it is effective to adopt a method in which a base is generated by combining, as the base precursor, a basic metal compound poorly soluble in water, and a metal ion constituting the basic metal compound with a compound which can cause a complex forming reaction (referred to as complex forming compound) using water as a medium. In this case, it is desirable that the basic metal compound poorly soluble in water is added to the light-sensitive element and the complex forming compound is added to the processing element, however, the reverse structure is possible.

The amount of the base or the base precursor to be used is 0.1~20 g/m$^2$,and more preferably 1~20 g/m$^2$. As the binder for the processing layer, a hydrophilic binder can be used. The processing material is preferably hardened by means of a hardener. As the hardener, a hardener contained in a light-sensitive material can be used.

The processing element can contain a mordanting agent for the purpose of transferring and removal of a dye used in the yellow filter layer or anti-halation layer of the light-sensitive element described above. As the mordanting agent, a polymer mordant is preferable. Examples thereof include polymers containing a secondary or tertiary amino group, polymers having nitrogen-containing heterocycle portion, polymers containing a quaternary cationic group and the like having a molecular weight from 5000 to 200000, particularly from 10000 to 50000.

Specific examples thereof are described in U.S. Pat. Nos. 2,548,564, 2,484,430, 3,148,061, 3,756,814, 3,625,694, 3,859,096, 4,128,538, 3,958,995, 2,721,852, 2,798,063, 4,168,976, 3,709,690, 3,788,855, 3,642,482, 3,488,706, 3,557,066, 3,271,147, 3,271,148, 2,675,316, 2,882,156, British Patent Nos. 1277453, Japanese Patent Application Laid-Open (JP-A) Nos. 54-115228, 54-145529, 54-126027, 50-71332, 53-30328, 52-155528, 53-125, 53-1024, and the like.

The amount added of the mordant is from 0.1 g/m$^2$ to 10 g/m$^2$, and preferably from 0.5 g/m$^2$ to 5 g/m$^2$.

In the present invention, it may also be possible that a developing stopper or a precursor of a developing stopper is contained in the processing element, and the developing stopper acts simultaneously with the development or at delayed timing.

The developing stopper herein described represents a compound which quickly neutralizes a base or reacts with a base to reduce the base concentration in the layer to stop the development after suitable developing, or a compound which causes mutual reaction interaction with silver or a silver salt to inhibit the development. The specific examples thereof include an acid precursor which releases an acid upon heating, an electrophilic compound which causes substitution reaction with a coexistent base upon heating, a nitrogen-containing heterocyclic compound, a mercapto compound and precursors thereof. The details are described in Japanese Patent Application Laid-Open (JP-A) No. 62-190529, pp. 31 to 32.

Further, the processing material may contain a printout preventing agent for a silver halide so that the printout preventing agent functions simultaneously with the development. Examples of the printout preventing agent include halides described in JP-B No. 54-164, JP-A Nos. 53-46,020 and 48-45,228 and JP-B No. 57-8,454, 1-phenyl-5-mercaptotetrazoles described in British Patent No. 1,005, 144 and viologens described in JP-A No. 8-184,936.

The amount of the printout preventing agent added is in the range of 10-4 to 1 mol, preferably in the range of 10,3 to 10-2 mol, per mol of Ag.

Meanwhile, the processing material may contain a physical development nucleus and a solvent for a silver halide so that the silver halide of the light-sensitive material is solubilized and fixed to the processing layer concurrently with the development.

A reducing agent necessary for the physical development may be any of the reducing agents known in the field of a light-sensitive material. Further, a precursor of the reducing agent may be used which itself has no reducing capability but is given a reducing capability by a nucleophilic reagent or heat in the developing process. The developing agent which is not consumed in the development and diffuses from the light-sensitive material can be used as a reducing agent, or otherwise a reducing agent may be incorporated in the processing material. In the latter case, the reducing agent incorporated in the processing material may be the same as or different from the reducing agent incorporated in the light-sensitive material.

Examples of the reducing agents to be used in the present invention include the reducing agents and precursors thereof described in U.S. Pat. Nos. 4,500,626, columns 49-50, 4,483,914, columns 30-31, 4,330,617 and 4,590,152, JP-A Nos. 60-140,335, pp. 17-18, 57-40,245,56-138,736,59-178, 458,59-53,831,59-182,449, 59-182,450, 60-119,555, 60-128,436 to 60-128,439, 60-198,540, 60-181,742, 61-259, 253, 62-244,044, 62-131,253 to 62-131,256, and European Patent No. 220,746A2, pp. 78–96.

Further, a combination of reducing agents, which is disclosed in U.S. Pat. No. 3,039,869, can also be used in the present invention.

In the case where a diffusive developing agent is used, a combination of an electron transferring agent and/or a precursor thereof may be used, as necessary. The electron transferring agent or a precursor thereof may be selected from the reducing agents or precursors thereof enumerated previously.

If the reducing agent is added to the processing material, the amount of the reducing agent added is in the range of 0.01 to 10 g/m$^2$ and preferably in the range of 0.1 to 5 times the molar number of silver in the light-sensitive material.

A physical development nucleus reduces the soluble silver halide diffused from the light-sensitive material to convert it into physically developed silver so that the developed silver is fixed to a processing layer. Examples of the physical development nucleus include any of known colloidal particles of a heavy metal, such as zinc, mercury, lead, cadmium, iron, chromium, nickel, tin, cobalt, copper and ruthenium, a noble metal, such as palladium, platinum, gold and silver, and a chalcogen compound composed of any of these heavy metals and noble metals and a substance such as sulfur, selenium or tellurium.

The particle diameters of these physical development nuclei are preferably in the range of 2 to 200 nm. The physical development nuclei are present in an amount ranging normally from $10^{-3}$ mg to 10 g/m$^2$ in the processing layer.

The solvent for silver halide may be a known compound, preferable examples of which include thiosulfates, sulfites, thiocyanates, thioethers as described in JP-B No. 47-11,386, a compound having a 5- or 6-membered imido ring, such as urasil and hydantoin, described in JP-A No. 8-179,458, a compound having a sulfur to carbon double bond as described in JP-A No. 53-144,319, and a mesoion thiolate compound such as trimethyltriazolium thiolate described in "Analytica Chimica Actal", vol. 248, pp. 604 to 614 (1991). A compound which is described in JP-A No. 8-69,097 and which is capable of fixing a silver halide to stabilize it can also be used as a solvent for silver halide.

The above-described solvents for the silver halide may be used alone or in a combination of two or more of them.

The total amount of the solvent for silver halide in the processing layer is in the range of 0.01 to 100 mmol/m$^2$ and preferably 0.1 to 50 mmol/m$^2$. This amount ranges from 1/20 to 20 times, preferably from 1/10 to 10 times, and more preferably from 1/4 to 4 times the molar amount of coated silver in a light-sensitive material.

When using the solvent for silver halide, it may be added to a solvent, such as water, methanol, ethanol, acetone, dimethylformamide or methylpropyl gycol, or to an alkaline or acidic aqueous solution, or otherwise a dispersion comprising solid particles of the solvent for the silver halide may be added to a coating solution.

A processing material may comprise auxiliary layers such as a protective layer, a primer layer, a back layer and the like.

The processing material is preferably composed of a continuous web and a processing layer coated thereon. The continuous web as written here refers to a web having a size which affords the state that a length of the processing material is sufficiently longer than the length of a longer side of a light-sensitive material to be processed such that part of the light-sensitive material does not need to be cut and that a plurality of light-sensitive materials can be processed. Generally, the processing material coated on the continuous web has a length which is 5 to 10,000 times the width. Although the width of the processing material is not limited, it is preferably larger than the width of the corresponding light-sensitive material.

It is also preferable to process a plurality of light-sensitive materials arranged in a parallel array. In this case, the width of the processing material is preferably equal to or larger than the width of the light-sensitive material times the number of light-sensitive materials to be processed simultaneously.

In a process utilizing such a continuous web, preferably the web is fed from a feeding roll and wound on a windup roll, and thereafter the web is disposed. Particularly, this disposal is easier when the light-sensitive material has a large size.

As explained above, the handling of the processing material coated on a continuous web is much easier in comparison with the handling of a conventional processing material coated on a sheet.

The thickness of the support for the processing material is not limited, but a smaller thickness is preferable and most preferably the thickness is in the range of 4 to 120 $\mu$m. The thickness of a support is preferably 100 $\mu$m or less, more preferably 60 $\mu$m or less, most preferably 40 $\mu$m or less because it increases the amount of processing material per unit volume and therefore the roll for the processing material can be rendered compact.

The material for the support is not particularly limited, only if it withstands the processing temperature. The support is generally selected from the photographic supports such as paper, synthetic polymer (film), described in "Fundamentals of Photographic Engineering—Silver Salt Photography Section", pp. 223–240, edited by Photographic Society of Japan, Corona Co., Ltd., 1979.

The support may be composed of a single material, or otherwise it may comprise a material whose one side or both sides are coated or laminated with a synthetic polymer such as polyethylene.

Other supports, which can be used in the present invention, include those described in, e.g., JP-A Nos. 62-253,159, pp. 29-31, 1-161,236, pp. 14–17, 63-316,848, 2-22,651 and 3-56,955 and U.S. Pat. No. 5,001,033.

Also preferable is a support made from a styrene-based polymer mainly composed of a syndiotactic structure.

The surface of these supports may be coated with a hydrophilic binder, a semiconducting metal oxide, such as alumina sol or tin oxide, and an antistatic agent such carbon black. A support having aluminum deposited on the surface thereof is also suitable.

In the present invention, in a developing process of the light-sensitive material exposed for taking photographs by use of a camera or the like comprises, the light-sensitive material is put together with a processing material having a processing layer, in the presence of water in an amount ranging from 1/10 to the equivalent of an amount which is required for the maximum swelling of the entire coating layers excluding back layers of these materials, so that the light-sensitive layer and the processing layer face each other, and these materials are heated at 60 to 100° C. for 5 to 60 seconds.

The water is not particularly specified, and examples of the water include distilled water, ion-exchange water, tap water, well water and mineral water. The water may be reused by being filtered and recycled by adding thereto a small amount of antiseptic for the prevention of water scale and putrefaction or by use of an activated carbon filter or an ion-exchange resin filter.

In the present invention, the light-sensitive material and/or the processing material, which are swollen with water, are put together and thereafter heated. Since the swollen layers are unstable, it is important to limit the amount of water to the above-mentioned range in order to prevent localized unevenness in color development.

The amount of water which is required for the maximum swelling of the coating layer can be obtained by a procedure comprising the steps of immersing a light-sensitive or processing material having a coating layer for the measuring of swell, measuring the weight of the maximum swell after confirming that the layer is sufficiently swollen by measuring the thickness of the layer, and subtracting the weight of the original layer from the measured weight. An example for measuring the degree of swell is described in "Photographic Science Engineering", vol. 16. Pp. 449 (1972).

Water can be supplied to the light-sensitive material or to the processing material or to both of them. The amount of water to be supplied ranges from 1/10 of to the equivalent of an amount which is required for the maximum swelling of the entire coating layers (not including the back layer) of the light-sensitive material and the processing material.

The timing to supply water may be any point after the exposure of the light-sensitive material to the heat development of the light-sensitive material. Preferably, water is supplied immediately before the heat development.

This amount of water in the present invention indicates an amount which is required when heat development is carried out by placing the light-sensitive material and the processing material face to face. Accordingly, the scope of the present invention includes a method in which an amount of water which exceeds the amount specified in the present invention is once supplied to the light-sensitive material or the processing material and thereafter the excessive water is removed from the light-sensitive material or the processing material by squeezing or other means before placing these materials face to face and the heat development is then carried out.

Normally, the required amount of water is supplied to the light-sensitive material or the processing material or to both of them, or alternatively, the supplied amount of water is adjusted to the required amount by an appropriate means as described above and thereafter heat development is carried out by putting the light-sensitive material and the processing material face to face. However, a method, in which the light-sensitivematerial and the processing material are first put together face to face and thereaftera required amount of water is supplied to the gap created between these materials, is also possible.

As for the methods for supplying water, a method in which a light-sensitive material or processing material is immersed in water and thereafter the excess water is removed by means of a squeezing roller are conceivable. It is more preferable that a predetermined amount of water is coated on the light-sensitive material or processing material. In this case, a particularly preferred mode is the employment of a water spraying apparatus comprising a plurality of nozzles which eject water and are linearly arranged at a certain space therebetween in the direction that crosses the direction of the transfer of the light-sensitive material or processing material and also actuators which changes the relationship of the nozzles with regard to the light-sensitive material or processing material being transferred. Further, a method in which water is coated by mean of a sponge or the like on the light-sensitive material or processing material is also suitable, because the apparatus in this case is simple.

The temperature of water supplied in preferably in the range of 30 to 60° C. Examples of the method for putting the light-sensitive material and the processing material together are described in JP-A Nos. 62-253,159 and 61-147,244.

Examples of the heating method in the developing process include a method in which the light-sensitive material is brought into contact with a heated block or plate, a method in which the light-sensitive material is brought into contact with such an object as a hot plate, a hot presser, a heated roller, a heated drum, a halogen lamp heater and an infrared or a far infrared lamp heater, and a method in which the light-sensitive material is passed through a heated atmosphere.

For the purpose of processing the light-sensitive material of the present invention, any known apparatus for heat development can be used. Preferred examples of the apparatus include the apparatus described in JP-A Nos. 59-75,247, 59-177,547, 59-181,353 and 60-18,951, JP-U No. 62-25,944 and Japanese Patent Application Nos. 4-277,517, 4-243,072, 4-244,693, 6-164,421 and 6-164,422.

In addition, commercially available apparatus such as "Pictrostat" 100, 200, 300, 330 and 50 and "Pictrography" 3000 and 2000, manufactured by Fuji Photo Film Co., Ltd. can be used in the present invention.

The light-sensitive material and/or the processing material of the present invention may have an electroconductive heat generating layer as a heating means for the heat development. For example, a heat generating element described in JP-A No. 61-145,544 can be used.

In the present invention, although the image information can be read out without removing the developed silver produced by development and the unreacted silver halide from the light-sensitive material, it can be read out after removing the developed silver and the unreacted silver halide. In the latter case, the developed silver or the unreacted silver halide can be removed concurrently with or after the development.

In order to remove the developed silver from the light-sensitive material concurrently with the development or in order to complex or solubilize the silver halide, the processing material may contain a silver oxidizing or re-halogenating agent, which acts as a bleaching agent, or a solvent for the silver halide, which acts as a fixing agent, so that these reactions occur at the time of the heat development.

Further, after the developing process, a second processing material, which contains a silver oxidizing or re-halogenating agent or a solvent for the silver halide, and the light-sensitive material may be put together face to face in order that the removal of the developed silver, or the complexing or solubilizing of the silver halide be carried out.

In the present invention, it is preferable that the light-sensitive material be subjected to the above-mentioned processing after development for image formation, in so far as the above-mentioned processing does not exert adverse effects on the reading out of image information. Since the undeveloped silver halide causes significant haze in a gelatin film and makes the background density increase, it is preferable to diminish the haze by use of the above-mentioned complexing agent or to solubilize the silver halide so that all or part of the silver halide is removed from the film.

EXAMPLES

In order to better explain the present invention, the following examples are given by way of illustration and not by way of limitation.

Example 1

A mixture of 0.74 g of gelatin having a weight average molecular weight of 15,000, 0.7g of potassium bromide, and 930 ml of distilled water was placed in a reaction vessel, and thereafter the temperature of the mixture was raised to 40° C. To this solution, which was vigorously stirred, there were added 30 ml of an aqueous solution containing 1.2 g of silver nitrate and 30 ml of an aqueous solution containing 0.82 g of potassium bromide over a period of 30 seconds. Upon completion of the addition, after the reaction solution was kept at 40° C. for 1 minutes, the temperature was raised to 75° C. Next, 27 g of gelatin and 200 ml of distilled water were added together to the reaction solution. After that, 100 ml of an aqueous solution containing 22.5 g of silver nitrate and 80 ml of an aqueous solution containing 15.43 g of potassium bromide were added to the reaction solution over a period of 11 minutes in such a manner that the flow rate of the addition was gradually increased. Further, 250 ml of an aqueous solution containing 75.1 g of silver nitrate and an aqueous solution containing potassium iodide and potassium bromide at a molar ratio of the former to the latter of 3:97 (having a potassium bromide concentration of 26%) were added to the reaction solution over a period of 20 minutes in such a manner that the flow rate of the addition was gradually increased and that the silver potential of the reaction solution was −10 mV versus a saturated calomel electrode. Furthermore, 75 ml of an aqueous solution containing 18.7 g of silver nitrate and a 21.9% potassium bromide aqueous solution were added to the reaction solution over a period of 3 minutes in such a manner that the silver potential of the reaction solution was 0 mV versus a saturated calomel electrode. After the completion of the addition, the temperature of the reaction solution was kept at 75° C. for 1 minute, and the temperature of the reaction solution was then lowered to 55° C. Then, 120 ml of an aqueous solution containing 8.1 g of silver nitrate and 320 ml of an aqueous solution containing 7.26 g of potassium iodide were added to the reaction solution over a period of 5 minutes. After the completion of the addition, 5.5 g of potassium bromide and 0.04 mg of potassium hexachloro iridate (IV) were added to the reaction solution, and the temperature of the reaction solution was kept at 550° C. for 1 minute. Then, 180 ml of an aqueous solution containing 44.3 g of silver nitrate and 160 ml of an aqueous solution containing 34.0 g of potassium bromide were added to the reaction solution over a period of 8 minutes. After the temperature was lowered, the desalting treatment of the reaction product was performed in an ordinary way. After the desalting, the reaction product was admixed with gelatin in an amount which produced an emulsion having a gelatin concentration of 7% by weight, and the pH of the product was adjusted to 6.2.

The thus obtained emulsion was spectrally sensitized and chemically sensitized by adding the spectral sensitizer as identified below, the compound I, potassium thiocyanate, chloroauric acid, sodium thiosulfate, and mono (pentafluorophenyl)diphenylphosphine selenide to the emulsion kept at 58° C.

It was found that the emulsion obtained comprised grains made up of hexagonal tabular grains having an average grain size expressed as an equivalent-sphere diameter of 0.66 μm, an average grain thickness of 0.15 μm, and an average aspect ratio of 7.5. This emulsion was designated as emulsion A-1G.

Sensitizing dye for green light-sensitive emulsion (I)

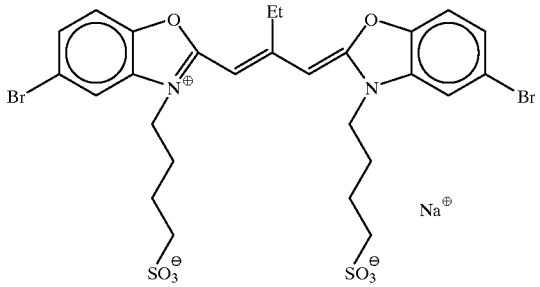

$6.0\times10^{-4}$ mol/mol of silver for the emulsions A-1

Sensitizing dye for green light-sensitive emulsion (II)

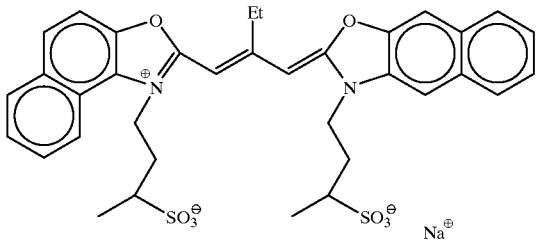

$5.0\times10^{-4}$ mol/mol of silver for the emulsions A-1

Sensitizing dye for green light-sensitive emulsion (III)

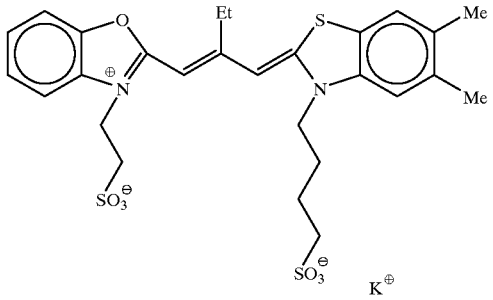

$5.0\times10^{-5}$ mol/mol of silver for the emulsions A-1

Compound I

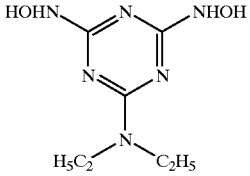

Next, a mixture of 2.9 g of gelatin having a weight average molecular weight of 15,000, 2.78 g of sodium chloride, and 1,670 ml of distilled water was placed in a reaction vessel, and thereafter the temperature of the reaction vessel was raised to 35° C. To this reaction mixture, which was vigorously stirred, there were added 80 ml of an aqueous solution containing 12.52 g of silver nitrate and 80 ml of an aqueous solution containing 4.48 g of sodium chloride over a period of 60 seconds. Further, 300 mg of the crystal habit controlling agent-1 and 4.17 g of sodium chloride were added to the reaction mixture, and the temperature of the reaction vessel was raised to 60° C. After the reaction vessel was kept at 60° C. for 15 minutes, an aqueous solution prepared by dissolving 40 g of phthalated gelatin in 400 ml of distilled water at 40° C. was added to the reaction mixture, and 75 mg of the crystal habit controlling agent-1 was then added to the resulting reaction mixture. Next, 800 ml of an aqueous solution containing 157.34 g of silver nitrate and 800 ml of an aqueous solution containing 57.46 g of sodium chloride were each added to the reaction mixture in such a manner that the flow rate gradually increased from an initial flow rate of 3.9 ml/minute over a period of 40 minutes. Over the time period between 10 minutes before the completion of the addition and the completion of the addition of these solutions, 15.9 mg of potassium hexacyanoferrate (II) was added. Further, 3 minutes before the completion of the addition of these solutions, 4.73 g of potassium bromide as a 10 mol % aqueous solution was added. Furthermore, over the time period between 2 minutes before the completion of the addition and the completion of the addition of these solutions, 50 ml of an aqueous solution containing 1.0 g of potassium iodide was added. After the completion of these additions, 38 ml of a 1 N potassium thiocyanate aqueous solution was added, and a spectral sensitizing dye as described below was then added. Then, after the temperature of the reaction vessel was kept at 75° C. for 15 minutes, the temperature was lowered. After the temperature was lowered, the desalting treatment of the reaction product was performed in an ordinary way. After the desalting, the reaction product was admixed with gelatin in an amount which produced an emulsion having a gelatin concentration of 7% by weight, and the pH of the product was adjusted to 6.2.

The thus obtained emulsion was spectrally sensitized and chemically sensitized by adding the compound I, potassium thiocyanate, chloroauric acid, sodium thiosulfate, and mono (pentafluorophenyl)diphenylphosphine selenide to the emulsion kept at 58° C.

It was found that the emulsion obtained comprised hexagonal tabular grains having an average grain size expressed as an equivalent-sphere diameter of 0.67 $\mu$m, an average grain thickness of 0.16 $\mu$m, and an average aspect ratio of 7.2. This emulsion was designated as emulsion B-1G.

Sensitizing dye for green light-sensitive emulsion (I)

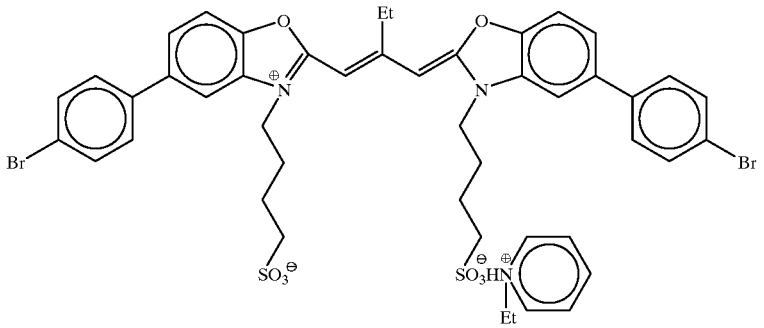

$4.2\times10^{-4}$ mol/mol of silver for the emulsions B-1

Sensitizing dye for green light-sensitive emulsion (V)

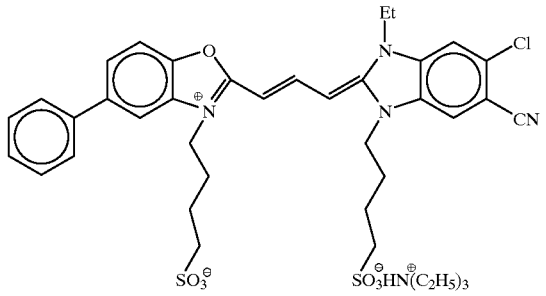

$1.1\times10^{-4}$ mol/mol of silver for the emulsions B-1

Sensitizing dye for green light-sensitive emulsion (VI)

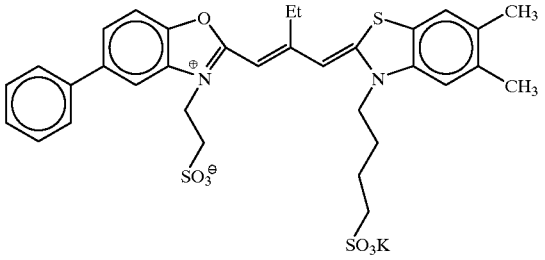

$3.0\times10^{-5}$ mol/mol of silver for the emulsions B-1

Next, a dispersion of zinc hydroxide serving as a base precursor was prepared.

A mixture, which comprised 31 g of zinc hydroxide powder having an average diameter of primary particles of 0.2 μm, 1.6 g of carboxymethylcellulose and 0.4 g of sodium polyacrylate as dispersants, 8.5 g of lime-processed ossein gelatin and 158.5 ml of water, was dispersed for one hour by means of a mill with glass beads. After filtering off the glass beads from the mixture, 188 g of a dispersion of zinc hydroxide was obtained.

Next, an emulsified dispersion of a magenta dye forming coupler was prepared in the following way.

A mixture, which comprised 7.80 g of magenta dye forming coupler (a), 6.68 g of a developing agent (b), 2 mg of an anti-fogging agent (c), 11.6 g of an organic solvent having a high boiling point (d) and 24.0 ml of ethyl acetate, was made into a solution at 60° C. The solution was blended into 150 g of an aqueous solution comprising 12 g of a lime-processed gelatin and 0.6g of sodium dodecylbenzenesulfonate. The resultant mixture was emulsified by means of a dissolver-type mixing device rotating at 10,000 revolutions per minute over a period of 20 minutes. After the emulsification, distilled water was added to the emulsion so that the total volume became 300 g, and the resultant emulsion was mixed at 2,000 revolutions per minute for 10 minutes.

Magenta dye-forming coupler (a1)

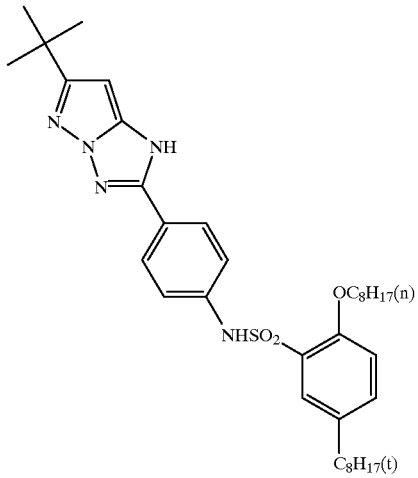

Developing agent (b)

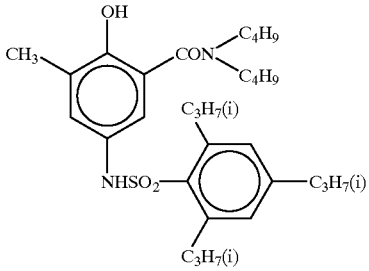

Surfactant (c)

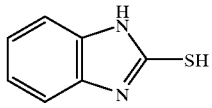

High boiling point organic solvent (d)

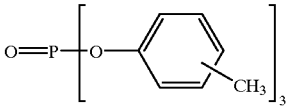

By using the combination, indicated in Table 1, of these dispersions, the silver halide emulsion A-1G or B-1G, and the compound represented by the general formula [I] or [II] used as an anti-fogging agent in the present invention ,or the comparative compound (α) or (β), compositions were coated on a support. In this way, samples 101 to 110 of color photographic light-sensitive materials for use in heat development were prepared.

TABLE 1

| | | Sample 101 | Sample 102 | Sample 103 | Sample 104 | Sample 105 | Sample 106 | Sample 107 | Sample 108 | Sample 109 | (mg/m²) Sample 110 |
|---|---|---|---|---|---|---|---|---|---|---|---|
| Protective layer | Lime-processed gelatin | 1000 | 1000 | 1000 | 1000 | 1000 | 1000 | 1000 | 1000 | 1000 | 1000 |
| | Matting agent (silica) | 50 | 50 | 50 | 50 | 50 | 50 | 50 | 50 | 50 | 50 |
| | Surfactant (f) | 100 | 100 | 100 | 100 | 100 | 100 | 100 | 100 | 100 | 100 |
| | Surfactant (g) | 300 | 300 | 300 | 300 | 300 | 300 | 300 | 300 | 300 | 300 |
| | Water-soluble polymer (h) | 15 | 15 | 15 | 15 | 15 | 15 | 15 | 15 | 15 | 15 |
| | Hardener (i) | | | | | | | | | | |
| Intermediate layer | Lime-processed gelatin | 375 | 375 | 375 | 375 | 375 | 375 | 375 | 375 | 375 | 375 |
| | Surfactant (g) | 15 | 15 | 15 | 15 | 15 | 15 | 15 | 15 | 15 | 15 |
| | Zinc hydroxide | 1100 | 1100 | 1100 | 1100 | 1100 | 1100 | 1100 | 1100 | 1100 | 1100 |
| | Water-soluble polymer (h) | 15 | 15 | 15 | 15 | 15 | 15 | 15 | 15 | 15 | 15 |
| Magenta colored layer | Lime-processed gelatin | 2000 | 2000 | 2000 | 2000 | 2000 | 2000 | 2000 | 2000 | 2000 | 2000 |
| | Emulsion (based on the amount of silver coated) | (A-1G) 1726 | (A-1G) 1726 | (A-1G) 1726 | (A-1G) 1726 | (A-1G) 1726 | (B-1G) 1726 | (B-1G) 1726 | (B-1G) 1726 | (B-1G) 1726 | (B-1G) 1726 |
| | Anti-fogging agent | — — | Comparative(α) 3.73 | I-3 4.85 | Comparative(β) 3.76 | II-2 4.67 | — — | Comparative(α) 3.73 | I-3 4.85 | Comparative(β) 3.76 | II-2 4.67 |
| | Magenta coupler (a) | 636 | 636 | 636 | 636 | 636 | 636 | 636 | 636 | 636 | 636 |
| | Developing agent (b) | 544 | 544 | 544 | 544 | 544 | 544 | 544 | 544 | 544 | 544 |
| | Anti-fogging agent (c) | 0.16 | 0.16 | 0.16 | 0.16 | 0.16 | 0.16 | 0.16 | 0.16 | 0.16 | 0.16 |
| | Organic solvent having a high boiling point (d) | 946 | 946 | 946 | 946 | 946 | 946 | 946 | 946 | 946 | 946 |
| | Surfactant (e) | 49 | 49 | 49 | 49 | 49 | 49 | 49 | 49 | 49 | 49 |
| | Water-soluble polymer (h) | 14 | 14 | 14 | 14 | 14 | 14 | 14 | 14 | 14 | 14 |
| Transparent PET support (120 μm) | | | | | | | | | | | |

Surfactant (e)

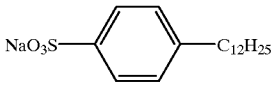

Surfactant (f)

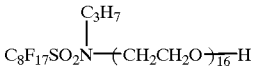

Surfactant (g)

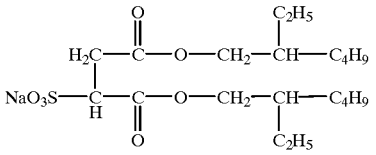

Water-soluble polymer (h)

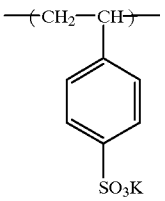

Hardener (i)

$CH_2{=}CH{-}SO_2{-}CH_2{-}SO_2{-}CH{=}CH_2$

Comparative (α)

-continued

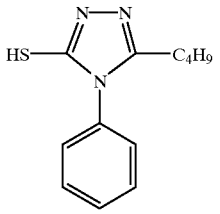

Comparative (β)

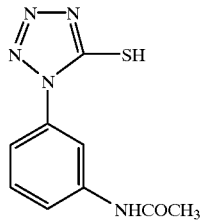

Further, as shown in Tables 2 and 3, processing materials P-1 and P-2 were prepared. The constitution of support A is shown in Table 4.

TABLE 2

Composition of the processing material P-1

| Constituent layer | Added substance | Amount added (mg/m²) |
|---|---|---|
| 4th layer | Acid-processed gelatin | 220 |
| Protective layer | Water-soluble polymer (j) | 60 |
| | Water-soluble polymer (k) | 200 |
| | Additive (l) | 20 |
| | Potassium nitrate | 12 |
| | Matting agent (m) | 10 |
| | Surfactant (g) | 7 |

TABLE 2-continued

Composition of the processing material P-1

| Constituent layer | Added substance | Amount added (mg/m$^2$) |
|---|---|---|
| | Surfactant (n) | 7 |
| | Surfactant (o) | 10 |
| 3rd layer | Lime-processed gelatin | 240 |
| Intermediate layer | Water-soluble polymer (k) | 24 |
| | Hardener (p) | 360 |
| | Surfactant (e) | 9 |
| 2nd layer | Lime-processed gelatin | 4800 |
| Base generating layer | Water-soluble polymer (k) | 1400 |
| | Guanidine picolinate | 5820 |
| | Potassium quinolinate | 450 |
| | Sodium quinolinate | 360 |
| | Surfactant (e) | 48 |
| 1st layer | Lime-processed gelatin | 280 |
| Primer layer | Water-soluble polymer (j) | 12 |
| | Surfactant (g) | 14 |
| | Hardener (p) | 370 |

Transparent support A (63 μm)

TABLE 3

Composition of the processing material P-2

| Constituent layer | Added substance | Amount added (mg/m$^2$) |
|---|---|---|
| 4th layer | Acid-processed gelatin | 220 |
| Protective layer | Water-soluble polymer (j) | 60 |
| | Water-soluble polymer (k) | 200 |
| | Additive (l) | 20 |
| | Potassium nitrate | 12 |
| | Matting agent (m) | 10 |
| | Surfactant (g) | 7 |
| | Surfactant (n) | 7 |
| | Surfactant (o) | 10 |
| | Hardener (p) | 124 |
| 3rd layer | Lime-processed gelatin | 240 |
| Intermediate layer | Water-soluble polymer (k) | 24 |
| | Surfactant (e) | 9 |
| 2nd layer | Lime-processed gelatin | 4800 |
| Base generating layer | Water-soluble polymer (k) | 1400 |
| | Surfactant (e) | 48 |
| | Additive A | 2800 |
| | Additive B | 1400 |
| 1st layer | Lime-processed gelatin | 280 |
| Primer layer | Water-soluble polymer (j) | 12 |
| | Surfactant (g) | 14 |

Transparent support A (63 μm)

TABLE 4

Composition of the support A

| Name of layer | Composition | Weight (mg/m$^2$) |
|---|---|---|
| Undercoat layer on the front side | Gelatin | 100 |
| Polymer layer | Polyethylene terephthalate | 62500 |
| Undercoat layer on the reverse side | Methyl methacrylate/2-ethylhexyl acrylate/methacrylic acid copolymer | 1000 |
| | PMMA latex (average particle diameter: 12 μm) | 120 |
| | | 63720 |

Water-soluble polymer (j)
κ-carageenan

Water-soluble polymer (k)
Sumikagel L-5H
(manufactured by Sumitomo Chemical Co., Ltd.)

Additive (l)

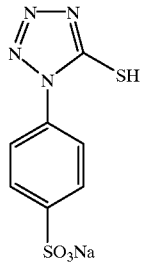

Mat Agent (m)
SYLOID 79
(manufactured by Fuji Devison Corp.)

Surfactant (n)

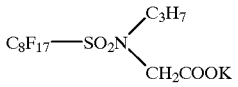

Surfactant (o)

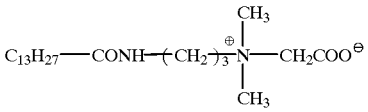

Hardener (p)

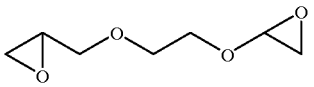

These light-sensitive materials were exposed to light of 500 lux for 1/100 second through an optical wedge and a green filter.

After the exposure, a heat development was carried out by the procedure comprising supplying 15 ml/m$^2$ of warm water at 400° C. to the light-sensitive layer of the light-sensitive material, putting together the light-sensitive material and the processing layer of a processing material so that the layers faced each other and thereafter heating the materials to 83° C. for 17 seconds by use of a heat drum. Then, removing the light-sensitive material and a magenta-colored wedge-shaped image were obtained. The colored samples were subjected to the transmission density measurement to obtain the so-called characteristic curve of the samples remaining silver halide.

These samples were subjected to the second processing by use of the processing material P-2. The second processing was carried out by the procedure in which 10 ml/m$^2$ of water were coated on the light-sensitive layer of the light-sensitive material which had undergone the first processing, and the light-sensitive layer and the processing layer of the processing material P-2 were put together face to face and thereafter the materials were heated to 60° C. to keep them at that temperature for 20 seconds. The colored samples thus obtained were subjected to the transmission density measurement. By this measurement, the characteristic curves of the samples having the residual silver halide complexed were obtained. The minimum density of each of the characteristic curves was taken as "fogging density". The sensitivity was expressed as the logarithm of an exposing light amount required to provide a density 0.15 higher than the fogging density. These results are shown in Table 5.

TABLE 5

| | Sample 101 | Sample 102 | Sample 103 | Sample 104 | Sample 105 | Sample 106 | Sample 107 | Sample 108 | Sample 109 | Sample 110 |
|---|---|---|---|---|---|---|---|---|---|---|
| Immediately after heat development | | | | | | | | | | |
| Fogging | 0.72 | 0.64 | 0.43 | 0.69 | 0.41 | 2.39 | 0.35 | 0.28 | 2.37 | 0.26 |
| Sensitivity | 100 | 57 | 78 | 91 | 75 | — | 36 | 112 | — | 125 |
| After the second processing | | | | | | | | | | |
| Fogging | 0.38 | 0.32 | 0.14 | 0.35 | 0.12 | 2.28 | 0.20 | 0.12 | 2.25 | 0.13 |
| Sensitivity | 100 | 53 | 77 | 90 | 73 | — | 31 | 111 | — | 122 |
| Remarks | Comparison | Comparison | Comparison | Comparison | Comparison | Comparison | Comparison | Present invention | Comparison | Present invention |

*The sensitivity was indicated as a relative value by taking the sensitivity of the sample 101 as 100.
**The sensitivity of the samples 106 and 109 could not be measured, because the fogging of these samples was significant.

As is apparent from the results, in comparison with the case where an emulsion composed of tabular silver iodobromide grains is used, the use of an emulsion composed of tabular grains having a high silver chloride content leads to significant fogging and poor discrimination when heat development is implemented. However, if an emulsion composed of tabular grains having a high silver chloride content is used in combination with the compound according to the present invention, good discrimination can be obtained and samples having a low minimum fogging density could be obtained even when silver halide remained. Further, in the case of samples which used an emulsion composed of tabular grains having a high silver chloride content, the transmission density was excellent on the second processing by the use of the A processing material P-2.

Example 2

Four samples, namely Samples 103, 105, 108 and 110, were exposed stepwise to light amounts which ranged from an amount corresponding to fogging density to an amount corresponding to a maximum color density, and were then subjected to heat development at 83° C. for 17 seconds by use of the processing material P-1 as in Example 1. The processed samples were then subjected to the measurement of RMS granularity by means of scattered light in order to obtain RMS granularity values corresponding to a density 0.5 higher than fogging density and to a density 1.5 higher than fogging density, this density range being a practical density range for images. The RMS granularity value was measured through an aperture having a diameter of 48 $\mu$m.

On the other hand, samples which had been exposed to light were subjected to CN-16 processing as a standard processing step for color negative film. The samples were then immersed in an alkaline buffer solution having a pH value of 11 to obtain colored images. With these samples, RMS granularity values were obtained in the same way as described above.

The results are shown in Table 6. As is apparent from the results, samples composed of tabular grains having a high silver chloride content lead to large granularity if processed by a conventional process using a liquid developing solution, but the same samples can lead to better granularity if processed by the simple heat development according to the present invention. This effect according to the present invention is pronounced when use is made of an emulsion which is composed of tabular grains having a high silver chloride content and which can provide a low minimum density even after heat development.

The RMS granulation level obtained is the square root of a double average of the deviation in density observed in the micro-density measured through an aperture having a diameter of 48 $\mu$m, and is given by the following equation.

$$\mathrm{RMS} = \sqrt{\sum_{i=1}^{N} \frac{(D_i - \overline{D})^2}{N-1}}$$

CN-16 processing, as referred to above, means a standard processing solution and a standard processing step for color negative film provided from Fuji Film Co., Ltd.

TABLE 6

| | Sample 103 | Sample 105 | Sample 108 | Sample 110 |
|---|---|---|---|---|
| Heat development | | | | |
| RMS for fogging density + 0.5 | 0.0175 | 0.0173 | 0.0179 | 0.0177 |
| for fogging density + 1.5 | 0.0268 | 0.0260 | 0.0202 | 0.0198 |
| CN-16 | | | | |
| RMS for fogging density + 0.5 | 0.0193 | 0.0199 | 0.0287 | 0.0291 |
| for fogging density + 1.5 | 0.0292 | 0.0301 | 0.0396 | 0.0414 |
| Remarks | Comparison | Comparison | Present invention | Present invention |

Example 3

By use of the combinations of silver halide emulsions of Example 1 and anti-fogging agents, the influence of storage, i.e., storing of coating liquids for 8 hours at 40° C., and storing of samples prepared for 3 days in conditions of 60° C. and 30% RH, on sensitivity was examined. The results are shown in Table 7. As is apparent from the results, the use of the compounds according to the present invention as anti-fogging agents makes it possible to markedly inhibit the reduction in sensitivity and the increase in fogging after storage of the light-sensitive materials, even when use is made of an emulsion which is composed of tabular grains having a high silver chloride content and which can provide a low minimum density even after heat development.

In accordance with the spectral sensitizing dyes employed (green-sensitive dye for Example 1 as well as blue-sensitive dye and red-sensitive dye shown in the following tables), namely the spectrally sensitized regions, the emulsions were given the subscript b, g, or r.

TABLE 7

| | Sample 101 | Sample 102 | Sample 103 | Sample 104 | Sample 105 | Sample 106 | Sample 107 | Sample 108 | Sample 109 | Sample 110 |
|---|---|---|---|---|---|---|---|---|---|---|
| After storage of coating liquids (after 8 hours at 40° C.) | −7 | −41 | −9 | −11 | −9 | — | −50 | −8 | — | −9 |
| After storage of photosensitive materials (after 3 days in a condition of 60° C. and 30% RH) | +26 | −21 | −3 | +10 | −2 | — | −77 | −12 | — | −8 |
| Remarks | Com-parison | Com-parison | Com-parison | Comparison | Comparison | Comparison | Comparison | Present invention | Comparison | Present invention |

*The sensitivity was indicated in decrements from 100 which was assigned to the sensitivity of the sample immediately after preparation thereof by using a fresh unstored coating liquid.
**The sensitivity of the samples 106 and 109 could not be measured, because the fogging of these samples was significant.

Example 4

Based on the methods for preparing emulsions A-1G and B-lG of Example 1, the following emulsions having different grains sizes were prepared by varying temperatures, adding rates of reactant liquids, and silver potentials at the time when grains were prepared. From these emulsions, multi-layered color light-sensitive materials shown in Tables 8 to 13 were prepared.

| | Emulsion | Equivalent-sphere diameter | Average grain thickness | Average aspect ratio | Halogen composition |
|---|---|---|---|---|---|
| For high-speed layer | A-1-o | 0.86 μm | 0.090 μm | 24.0 | Silver iodobromide |
| | B-1-o | 0.86 μm | 0.095 μm | 22.0 | Silver halide having a high silver chloride content |
| For medium-speed layer | A-1-m | 0.66 μm | 0.15 μm | 7.5 | Silver iodobromide |
| | B-1-m | 0.67 μm | 0.16 μm | 7.2 | Silver halide having a high silver chloride content |
| For low-speed layer | A-1-u | 0.43 μm | 0.18 μm | 3.0 | Silver iodobromide |
| | B-1-u | 0.43 μm | 0.18 μm | 3.0 | Silver halide having a high silver chloride content |

TABLE 8

| | | Sample 401 | Sample 402 | Sample 403 | Sample 404 | Sample 405 | Sample 406 | Sample 407 | (mg/m²) Sample 408 |
|---|---|---|---|---|---|---|---|---|---|
| Protective layer | Lime-processed gelatin | 1000 | 1000 | 1000 | 1000 | 1000 | 1000 | 1000 | 1000 |
| | Matting agent (silica) | 50 | 50 | 50 | 50 | 50 | 50 | 50 | 50 |

TABLE 8-continued

| | | Sample 401 | Sample 402 | Sample 403 | Sample 404 | Sample 405 | Sample 406 | Sample 407 | (mg/m$^2$) Sample 408 |
|---|---|---|---|---|---|---|---|---|---|
| | Surfactant (f) | 100 | 100 | 100 | 100 | 100 | 100 | 100 | 100 |
| | Surfactant (g) | 300 | 300 | 300 | 300 | 300 | 300 | 300 | 300 |
| | Water soluble polymer (h) | 15 | 15 | 15 | 15 | 15 | 15 | 15 | 15 |
| | Hardener (i) | 98 | 98 | 98 | 98 | 98 | 98 | 98 | 98 |
| Intermediate layer | Lime-processed gelatin | 375 | 375 | 375 | 375 | 375 | 375 | 375 | 375 |
| | Surfactant (g) | 15 | 15 | 15 | 15 | 15 | 15 | 15 | 15 |
| | Zinc hydroxide | 1100 | 1100 | 1100 | 1100 | 1100 | 1100 | 1100 | 1100 |
| | Water-soluble polymer (h) | 15 | 15 | 15 | 15 | 15 | 15 | 15 | 15 |
| Yellow colored layer (high sensitivity level layer) | Lime-processed gelatin | 150 | 150 | 150 | 150 | 150 | 150 | 150 | 150 |
| | Emulsion (based on the amount of silver coated) | (A-1-ob) 647 | (A-1-ob) 647 | (A-1-ob) 647 | (A-1-ob) 647 | (B-1-ob) 647 | (B-1-ob) 647 | (B-1-ob) 647 | (B-1-ob) 647 |
| | Yellow coupler (q) | 150 | 150 | 150 | 150 | 150 | 150 | 150 | 150 |
| | Developing agent (b) | 82 | 82 | 82 | 82 | 82 | 82 | 82 | 82 |
| | Developing agent (r) | 82 | 82 | 82 | 82 | 82 | 82 | 82 | 82 |
| | Anti-fogging agent (s) | 6 | 6 | 6 | 6 | 6 | 6 | 6 | 6 |
| | Anti-fogging agent | Comparative(α) 1.12 | I-3 1.45 | Comparative(β) 1.13 | II-1 1.10 | Comparative(α) 1.12 | I-3 1.45 | Comparative(β) 1.13 | II-1 1.10 |
| | Organic solvent having a high boiling point (d) | 50 | 50 | 50 | 50 | 50 | 50 | 50 | 50 |
| | Surfactant (e) | 3 | 3 | 3 | 3 | 3 | 3 | 3 | 3 |
| | Water-soluble polymer (h) | 1 | 1 | 1 | 1 | 1 | 1 | 1 | 1 |

TABLE 9

(No. 1 continued from Table 8)

| | | Sample 401 | Sample 402 | Sample 403 | Sample 404 | Sample 405 | Sample 406 | Sample 407 | (mg/m$^2$) Sample 408 |
|---|---|---|---|---|---|---|---|---|---|
| Yellow colored layer (middle sensitivity level layer) | Lime-processed gelatin | 220 | 1000 | 1000 | 1000 | 1000 | 1000 | 1000 | 1000 |
| | Emulsion (based on the amount of silver coated) | (A-1-mb) 475 | (A-1-mb) 475 | (A-1-mb) 475 | (A-1-mb) 475 | (B-1-mb) 475 | (B-1-mb) 475 | (B-1-mb) 475 | (B-1-mb) 475 |
| | Yellow coupler (q) | 138 | 100 | 100 | 100 | 100 | 100 | 100 | 100 |
| | Developing agent (b) | 75 | 75 | 75 | 75 | 75 | 75 | 75 | 75 |
| | Developing agent (r) | 75 | 75 | 75 | 75 | 75 | 75 | 75 | 75 |
| | Anti-fogging agent (s) | 5 | 5 | 5 | 5 | 5 | 5 | 5 | 5 |
| | Anti-fogging agent | Comparative(α) 1.03 | I-3 1.33 | Comparative(β) 1.04 | II-1 1.01 | Comparative(α) 1.03 | I-3 1.33 | Comparative(β) 1.04 | II-1 1.01 |
| | Organic solvent having a high boiling point (d) | 74 | 74 | 74 | 74 | 74 | 74 | 74 | 74 |
| | Surfactant (e) | 4 | 4 | 4 | 4 | 4 | 4 | 4 | 4 |
| | Water-soluble polymer (h) | 2 | 2 | 2 | 2 | 2 | 2 | 2 | 2 |
| Yellow colored layer (low sensitivity level layer) | Lime-processed gelatin | 1400 | 1400 | 1400 | 1400 | 1400 | 1400 | 1400 | 1400 |
| | Emulsion (based on the amount of silver coated) | (A-1-ub) 604 | (A-1-ub) 604 | (A-1-ub) 604 | (A-1-ub) 604 | (B-1-ub) 604 | (B-1-ub) 604 | (B-1-ub) 604 | (B-1-ub) 604 |
| | Yellow coupler (q) | 351 | 351 | 351 | 351 | 351 | 351 | 351 | 351 |
| | Developing agent (b) | 192 | 192 | 192 | 192 | 192 | 192 | 192 | 192 |
| | Developing agent (r) | 192 | 192 | 192 | 192 | 192 | 192 | 192 | 192 |
| | Anti-fogging agent (s) | 18 | 18 | 18 | 18 | 18 | 18 | 18 | 18 |
| | Anti-fogging agent | Comparative(α) 1.57 | I-3 2.03 | Comparative(β) 1.59 | II-1 1.54 | Comparative(α) 1.57 | I-3 2.03 | Comparative(β) 1.59 | II-1 1.54 |
| | Organic solvent having a high boiling point (d) | 469 | 469 | 469 | 469 | 469 | 469 | 469 | 469 |
| | Surfactant (e) | 23 | 23 | 23 | 23 | 23 | 23 | 23 | 23 |
| | Water-soluble polymer (h) | 10 | 10 | 10 | 10 | 10 | 10 | 10 | 10 |

TABLE 10

(No. 2 continued from Table 8)

| | | Sample 401 | Sample 402 | Sample 403 | Sample 404 | Sample 405 | Sample 406 | Sample 407 | (mg/m$^2$) Sample 408 |
|---|---|---|---|---|---|---|---|---|---|
| Intermediate layer | Lime-processed gelatin | 750 | 750 | 750 | 750 | 750 | 750 | 750 | 750 |
| | Dye (t) | 136 | 136 | 136 | 136 | 136 | 136 | 136 | 136 |
| | Organic solvent having a high boiling point (d) | 126 | 126 | 126 | 126 | 126 | 126 | 126 | 126 |
| | Surfactant (e) | 15 | 15 | 15 | 15 | 15 | 15 | 15 | 15 |
| | Water-soluble polymer (h) | 15 | 15 | 15 | 15 | 15 | 15 | 15 | 15 |
| Magenta colored layer (high sensitivity level layer) | Lime-processed gelatin | 150 | 150 | 150 | 150 | 150 | 150 | 150 | 150 |
| | Emulsion (based on the amount of silver coated) | (A-1-og) 647 | (A-1-og) 647 | (A-1-og) 647 | (A-1-og) 647 | (B-1-og) 647 | (B-1-og) 647 | (B-1-og) 647 | (B-1-og) 647 |
| | Magenta coupler (a) | 48 | 48 | 48 | 48 | 48 | 48 | 48 | 48 |
| | Developing agent (b) | 33 | 33 | 33 | 33 | 33 | 33 | 33 | 33 |
| | Anti-fogging agent (c) | 0.02 | 0.02 | 0.02 | 0.02 | 0.02 | 0.02 | 0.02 | 0.02 |
| | Anti-fogging agent | Comparative(α) 1.12 | I-3 1.45 | Comparative(β) 1.13 | II-1 1.10 | Comparative(α) 1.12 | I-3 1.45 | Comparative(β) 1.13 | II-1 1.10 |
| | Organic solvent having a high boiling point (d) | 50 | 50 | 50 | 50 | 50 | 50 | 50 | 50 |
| | Surfactant (e) | 3 | 3 | 3 | 3 | 3 | 3 | 3 | 3 |
| | Water-soluble polymer (h) | 1 | 1 | 1 | 1 | 1 | 1 | 1 | 1 |
| Magenta colored layer (middle sensitivity level layer) | Lime-processed gelatin | 220 | 220 | 220 | 220 | 220 | 220 | 220 | 220 |
| | Emulsion (based on the amount of silver coated) | (A-1-mg) 475 | (A-1-mg) 475 | (A-1-mg) 475 | (A-1-mg) 475 | (B-1-mg) 475 | (B-1-mg) 475 | (B-1-mg) 475 | (B-1-mg) 475 |
| | Magenta coupler (a) | 70 | 70 | 70 | 70 | 70 | 70 | 70 | |
| | Developing agent (b) | 49 | 49 | 49 | 49 | 49 | 49 | 49 | 49 |
| | Anti-fogging agent (c) | 0.02 | 0.02 | 0.02 | 0.02 | 0.02 | 0.02 | 0.02 | 0.02 |
| | Anti-fogging agent | Comparative(α) 1.03 | I-3 1.33 | Comparative(β) 1.04 | II-1 1.01 | Comparative(α) 1.03 | I-3 1.33 | Comparative(β) 1.04 | II-1 1.01 |
| | Organic solvent having a high boiling point (d) | 74 | 74 | 74 | 74 | 74 | 74 | 74 | 74 |
| | Surfactant (e) | 4 | 4 | 4 | 4 | 4 | 4 | 4 | 4 |
| | Water-soluble polymer (h) | 2 | 2 | 2 | 2 | 2 | 2 | 2 | 2 |

TABLE 11

(No. 3 continued from Table 8)

| | | Sample 401 | Sample 402 | Sample 403 | Sample 404 | Sample 405 | Sample 406 | Sample 407 | (mg/m$^2$) Sample 408 |
|---|---|---|---|---|---|---|---|---|---|
| Magenta colored layer (low sensitivity level layer) | Lime-processed gelatin | 1400 | 1400 | 1400 | 1400 | 1400 | 1400 | 1400 | 1400 |
| | Emulsion (based on the amount of silver coated) | (A-1-ug) 604 | (A-1-ug) 604 | (A-1-ug) 604 | (A-1-ug) 604 | (B-1-ug) 604 | (B-1-ug) 604 | (B-1-ug) 604 | (B-1-ug) 604 |
| | Magenta coupler (a) | 446 | 446 | 446 | 446 | 446 | 446 | 446 | 446 |
| | Developing agent (b) | 311 | 311 | 311 | 311 | 311 | 311 | 311 | 311 |
| | Anti-fogging agent (c) | 0.14 | 0.14 | 0.14 | 0.14 | 0.14 | 0.14 | 0.14 | 0.14 |
| | Anti-fogging agent | Comparative(α) 1.57 | I-3 2.03 | Comparative(β) 1.59 | II-1 1.54 | Comparative(α) 1.57 | I-3 2.03 | Comparative(β) 1.59 | II-1 1.54 |
| | Organic solvent having a high boiling point (d) | 469 | 469 | 469 | 469 | 469 | 469 | 469 | 469 |
| | Surfactant (e) | 23 | 23 | 23 | 23 | 23 | 23 | 23 | 23 |
| | Water-soluble polymer (h) | 10 | 10 | 10 | 10 | 10 | 10 | 10 | 10 |
| Intermediate layer | Lime-processed gelatin | 900 | 900 | 900 | 900 | 900 | 900 | 900 | 900 |
| | Dye (u) | 191 | 191 | 191 | 191 | 191 | 191 | 191 | 191 |
| | Organic solvent having a high boiling point (d) | 177 | 177 | 177 | 177 | 177 | 177 | 177 | 177 |
| | Surfactant (e) | 21 | 21 | 21 | 21 | 21 | 21 | 21 | 21 |
| | Zinc hydroxide | 1100 | 1100 | 1100 | 1100 | 1100 | 1100 | 1100 | 1100 |
| | Water-soluble polymer (h) | 15 | 15 | 15 | 15 | 15 | 15 | 15 | 15 |

TABLE 12

(No. 4 continued from Table 8)

(mg/m²)

| | | Sample 401 | Sample 402 | Sample 403 | Sample 404 | Sample 405 | Sample 406 | Sample 407 | Sample 408 |
|---|---|---|---|---|---|---|---|---|---|
| Cyan colored layer (high) sensitivity level layer) | Lime-processed gelatin | 150 | 150 | 150 | 150 | 150 | 150 | 150 | 150 |
| | Emulsion (based on the amount of silver coated) | (A-1-or) 647 | (A-1-or) 647 | (A-1-or) 647 | (A-1-or) 647 | (B-1-or) 647 | (B-1-or) 647 | (B-1-or) 647 | (B-1-or) 647 |
| | Cyan coupler (v) | 65 | 65 | 65 | 65 | 65 | 65 | 65 | 65 |
| | Developing agent (b) | 20 | 20 | 20 | 20 | 20 | 20 | 20 | 20 |
| | Developing agent (r) | 20 | 20 | 20 | 20 | 20 | 20 | 20 | 20 |
| | Anti-fogging agent (c) | 0.03 | 0.03 | 0.03 | 0.03 | 0.03 | 0.03 | 0.03 | 0.03 |
| | Anti-fogging agent | Comparative(α) 1.12 | I-3 1.45 | Comparative(β) 1.13 | II-1 1.10 | Comparative(α) 1.12 | I-3 1.45 | Comparative(β) 1.13 | II-1 1.10 |
| | Organic solvent having a high boiling point (d) | 50 | 50 | 50 | 50 | 50 | 50 | 50 | 50 |
| | Surfactant (e) | 3 | 3 | 3 | 3 | 3 | 3 | 3 | 3 |
| | Water-soluble polymer (h) | 1 | 1 | 1 | 1 | 1 | 1 | 1 | 1 |
| Cyan colored layer (middle sensitivity level layer) | Lime-processed gelatin | 220 | 220 | 220 | 220 | 220 | 220 | 220 | 220 |
| | Emulsion (based on the amount of silver coated) | (A-1-mr) 475 | (A-1-mr) 475 | (A-1-mr) 475 | (A-1-mr) 475 | (B-1-mr) 475 | (B-1-mr) 475 | (B-1-mr) 475 | (B-1-mr) 475 |
| | Cyan coupler (v) | 96 | 96 | 96 | 96 | 96 | 96 | 96 | 96 |
| | Developing agent (b) | 30 | 30 | 30 | 30 | 30 | 30 | 30 | 30 |
| | Developing agent (r) | 30 | 30 | 30 | 30 | 30 | 30 | 30 | 30 |
| | Anti-fogging agent (c) | 0.05 | 0.05 | 0.05 | 0.05 | 0.05 | 0.05 | 0.05 | |
| | Anti-fogging agent | Comparative(α) 1.03 | I-3 1.33 | Comparative(β) 1.04 | II-1 1.01 | Comparative(α) 1.03 | I-3 1.33 | Comparative(β) 1.04 | II-1 1.01 |
| | Organic solvent having a high boiling point (d) | 74 | 74 | 74 | 74 | 74 | 74 | 74 | 74 |
| | Surfactant (e) | 4 | 4 | 4 | 4 | 4 | 4 | 4 | 4 |
| | Water-soluble polymer (h) | 2 | 2 | 2 | 2 | 2 | 2 | 2 | 2 |

TABLE 13

(No. 5 continued from Table 8)

(mg/m²)

| | | Sample 401 | Sample 402 | Sample 403 | Sample 404 | Sample 405 | Sample 406 | Sample 407 | Sample 408 |
|---|---|---|---|---|---|---|---|---|---|
| Cyan colored layer (low sensitivity level layer) | Lime-processed gelatin | 1400 | 1400 | 1400 | 1400 | 1400 | 1400 | 1400 | 1400 |
| | Emulsion (based on the amount of silver coated) | (A-1-ur) 604 | (A-1-ur) 604 | (A-1-ur) 604 | (A-1-ur) 604 | (B-1-ur) 604 | (B-1-ur) 604 | (B-1-ur) 604 | (B-1-ur) 604 |
| | Cyan coupler (v) | 610 | 610 | 610 | 610 | 610 | 610 | 610 | 610 |
| | Developing agent (b) | 191 | 191 | 191 | 191 | 191 | 191 | 191 | 191 |
| | Developing agent (r) | 191 | 191 | 191 | 191 | 191 | 191 | 191 | 191 |
| | Anti-fogging agent (c) | 0.32 | 0.32 | 0.32 | 0.32 | 0.32 | 0.32 | 0.32 | 0.32 |
| | Anti-fogging agent | Comparative(α) 1.57 | I-3 2.03 | Comparative(β) 1.59 | II-1 1.54 | Comparative(α) 1.57 | I-3 2.03 | Comparative(β) 1.59 | II-1 1.54 |
| | Organic solvent having a high boiling point (d) | 469 | 469 | 469 | 469 | 469 | 469 | 469 | 469 |
| | Surfactant (e) | 23 | 23 | 23 | 23 | 23 | 23 | 23 | 23 |
| | Water-soluble polymer (h) | 10 | 10 | 10 | 10 | 10 | 10 | 10 | 10 |
| Antihalation layer | Lime-processed gelatin | 750 | 750 | 750 | 750 | 750 | 750 | 750 | 750 |
| | Dye (w) | 133 | 133 | 133 | 133 | 133 | 133 | 133 | 133 |
| | Organic solvent having a high boiling point (d) | 123 | 123 | 123 | 123 | 123 | 123 | 123 | 123 |
| | Surfactant (e) | 14 | 14 | 14 | 14 | 14 | 14 | 14 | 14 |
| | Water-soluble polymer (h) | 15 | 15 | 15 | 15 | 15 | 15 | 15 | 15 |
| Transparent PET support (120 μm) | | | | | | | | | |

Yellow dye forming coupler (q)
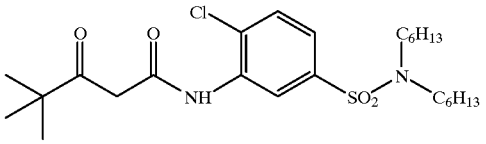
Developing agent (r)
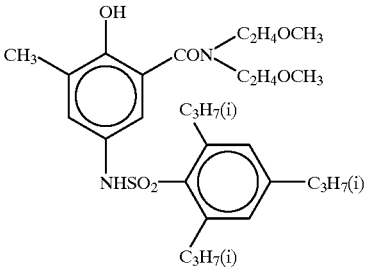
Anti-fogging agent (s)
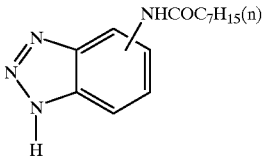
Dye (t)
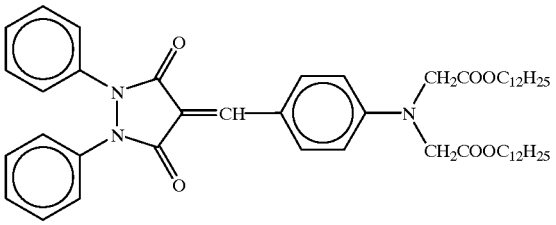
Dye (u)
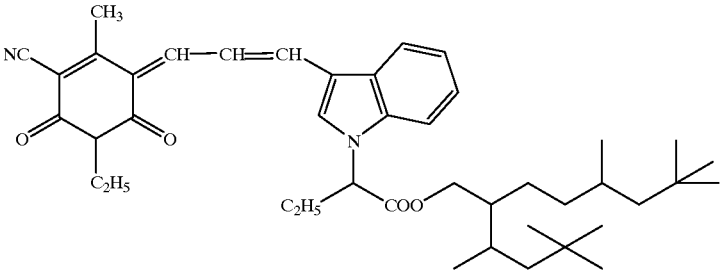

-continued
Cyan dye forming coupler (v)
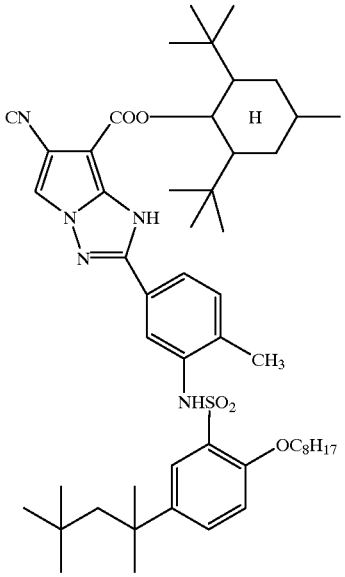
Dye (w)
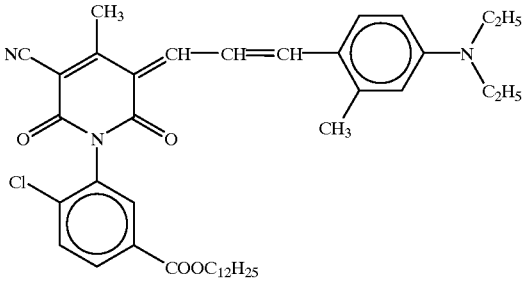
Sensitizing dye for blue-sensitive emulsion A
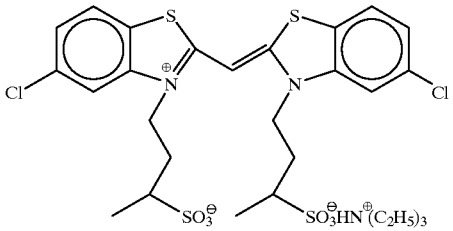
Sensitizing dye for blue-sensitive emulsion B
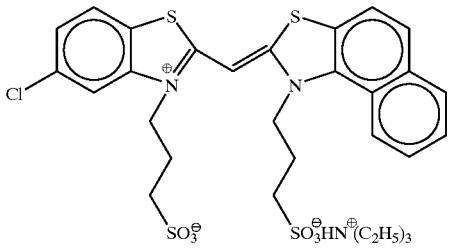
-continued
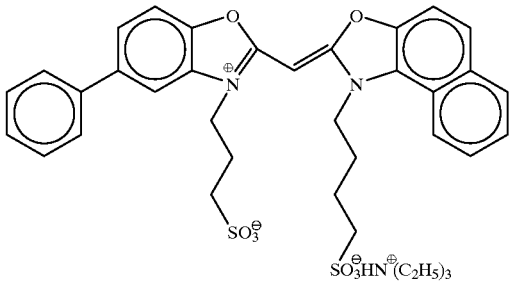
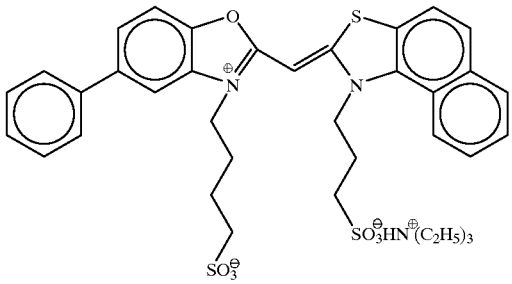

Sensitizing dye for red-sensitive emulsion A

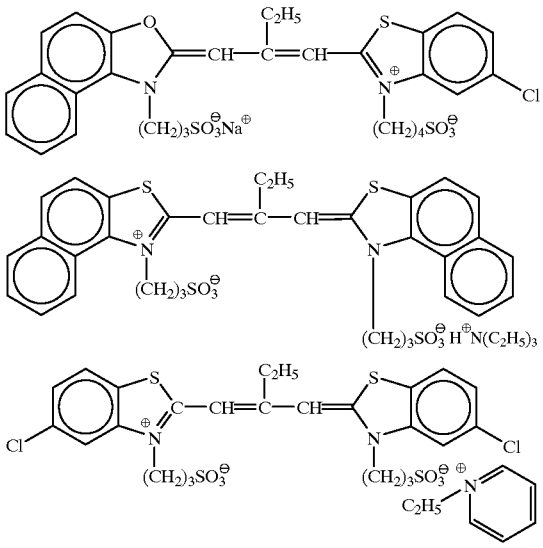

4:1:5 (molar ratio) blend

Sensitizing dye for red-sensitive emulsion B

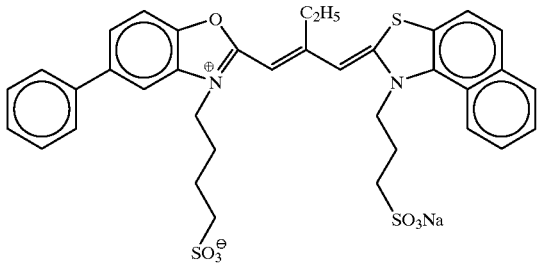

-continued

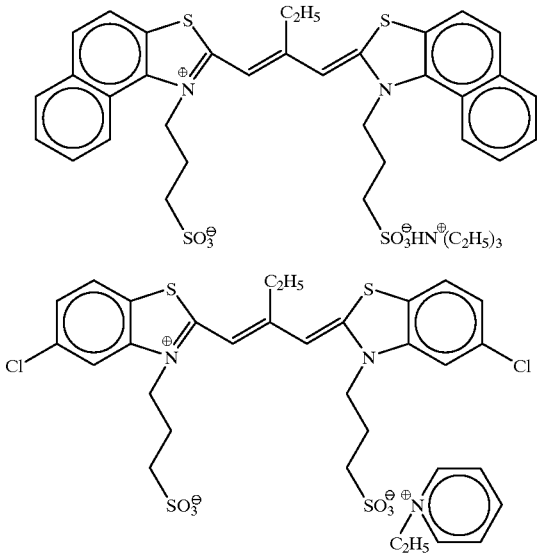

4:1:5 (molar ratio) blend

In order to examine the photographic characteristics, these light-sensitive materials were subjected to the same tests as in Example 1, except that the time period for heat development was 20 seconds. The results are shown in Table 14.

TABLE 14

| | Sample 401 | | | Sample 402 | | | Sample 403 | | | Sample 404 | | |
|---|---|---|---|---|---|---|---|---|---|---|---|---|
| | B | G | R | B | G | R | B | G | R | B | G | R |
| Immediately after heat development | | | | | | | | | | | | |
| Fogging | 1.64 | 1.08 | 1.05 | 1.51 | 0.92 | 0.87 | 1.70 | 1.15 | 1.13 | 1.49 | 0.90 | 0.85 |
| Sensitivity | 100 | 100 | 100 | 131 | 137 | 125 | 148 | 158 | 142 | 133 | 139 | 128 |
| After the second processing | | | | | | | | | | | | |
| Fogging | 0.94 | 0.69 | 0.62 | 0.83 | 0.57 | 0.51 | 1.02 | 0.74 | 0.79 | 0.80 | 0.55 | 0.53 |
| Sensitivity | 100 | 100 | 100 | 130 | 135 | 123 | 146 | 157 | 141 | 132 | 138 | 124 |
| Remarks | | Comparison | | | Comparison | | | Comparison | | | Comparison | |

| | Sample 405 | | | Sample 406 | | | Sample 407 | | | Sample 408 | | |
|---|---|---|---|---|---|---|---|---|---|---|---|---|
| | B | G | R | B | G | R | B | G | R | B | G | R |
| Immediately after heat development | | | | | | | | | | | | |
| Fogging | 1.01 | 0.73 | 0.64 | 0.91 | 0.55 | 0.44 | 2.58 | 2.51 | 2.47 | 0.90 | 0.54 | 0.43 |
| Sensitivity | 58 | 64 | 56 | 180 | 189 | 174 | — | — | — | 206 | 211 | 192 |
| After the second processing | | | | | | | | | | | | |

TABLE 14-continued

| | | | | | | | | | | | | |
|---|---|---|---|---|---|---|---|---|---|---|---|---|
| Fogging | 0.79 | 0.51 | 0.43 | 0.69 | 0.34 | 0.23 | 2.38 | 2.31 | 2.27 | 0.68 | 0.32 | 0.22 |
| Sensitivity | 57 | 63 | 55 | 178 | 188 | 173 | — | — | — | 204 | 210 | 191.00 |
| Remarks | Comparison | | | Present invention | | | Comparison | | | Present invention | | |

*The BGR of each sample were obtained from B density measurement, from G density measurement, and from R density measurement, respectively.
**The sensitivities were each indicated as a relative value by taking each of BGR sensitivities of the sample 401 as 100.
***The sensitivity of the sample 407 could not be measured, because the fogging of this sample was significant.

As will be seen from the results, the effects of the present invention were also obvious in multilayered color light-sensitive materials. Particularly, samples comprised of silver halide grains having a high silver chloride content were highly transparent and therefore suitable for reading out image information by means of a scanner or the like, even when silver halide remained.

Example 5

A support was prepared by the following process. The support thus prepared was different from the transparent PET support having a thickness of 120 μm used for the light-sensitive material of Example 4.

1) Preparation of support

A support used in this example was formed as follows.

100 parts by weight of a polyethylene-2,6-naphthalate (PEN) polymer and 2parts by weight of Tinuvin P.326 (manufactured by Ciba-Geigy Co.) as an ultraviolet absorbent were dried, melted at 300° C., and extruded from a T-die. The resultant material was longitudinally stretched by 3.3 times at 140° C., then transversely stretched by 3.3 times at 130° C., and thermally fixed at 250° C. for 6 seconds. The result was a 90 μm-thick PEN film. This PEN film was admixed with proper amounts of blue, magenta and yellow dyes (I-1, I-4, I-6, I-24, I-26, I-27 and II-5 described in Journal of Technical Disclosure No. 94-6,023). The PEN film was wound around a stainless steel core having a diameter of 20 cm and given a thermal hysteresis of 48 hours at 110° C., thereby manufacturing a support with a high resistance to curling.

2) Formation of primer layers on the support

The support was O subjected to corona discharge, UV irradiation and glow discharge and thereafter coated with a primer solution (10 ml/m$^2$, by using a bar coater) consisting of 0.1 g/m$^2$ of gelatin, 0.01 g/m$^2$ of sodium α-sulfo-di-2-ethylhexylsuccinate, 0.04 g/m$^2$ of salicylic acid, 0.2 g/m of p-chlorophenol, 0.012 g/m$^2$ of $(CH_2{=}CHSO_2CH_2NHCO)_2CH_2$ and 0.02 g/m$^2$ of a polyamide/epichlorohydrin polycondensate to obtain a primer layer. Drying was performed at 115 ° C. for 6 minutes (all of the rollers and conveyors in the drying zone were maintained at 115° C.).

3) Formation of back layers on the support One surface of the undercoated support was coated with an antistatic layer, a magnetic recording layer and a sliding layer, having the following compositions, respectively, as back layers.

3-1) Formation of antistatic layer 0.2 g/m$^2$ of a dispersion (secondary aggregate particle size: about 0.08 μm) of a fine powder of a tin oxide/antimony oxide composite material having an average particle size of 0.005 μm and a specific resistance of 5 Ω·cm was applied together with 0.05 g/m$^2$ of gelatin, 0.02 g/m$^2$ of $(CH_2{=}CHSO_2CH_2NHCO)_2CH_2$, 0.005 g/m$^2$ of poly (polymerization degree: 10) oxyethylene-p-nonylphenol and resorcin.

3-2) Formation of magnetic recording layer 0.06 g/m$^2$of cobalt-γ-iron oxide (specific surface area: 43 m$^2$/g; major axis: 0.14 μm: minor axis: 0.03 μm; saturation magnetization: 89 emu/g; $Fe^{+2}/Fe^{+3}$:6/94; surface-treated with aluminum oxide/silicon oxide in an amount corresponding to 2% by weight of the iron oxide) coated with 3-poly(polymerization degree: 15)oxyethylene-propyloxytrimethoxysilane (15% by weight), 1.2 g/m$^2$of diacetylcellulose (iron oxide was dispersed by means of an open kneader and a sand mill) and 0.3 g/m$^2$of $C_2H_5C(CH_2OCONH{-}C_6H_3(CH_3)NCO)_3$ as a hardener were applied by means of a bar coater by using acetone, methyl ethyl ketone and cyclohexanone as solvents, thus forming a 1.2 μm-thick magnetic layer. 10mg/m$^2$of silica particles (0.3 μm) as a matting agent and 10 mg/m$^2$ of aluminum oxide particles (0.15 μm) surface-coated with 3-poly (polymerization degree: 15)oxyethylene-propyloxytrimethoxysilane (15% by weight) as a polishing agent were added. Drying was performed at 115° C. for 6 minutes (all of the rollers and conveyors in the drying zone were maintained at 115° C.). The color density increment of $D^B$ of the magnetic recording layer measured by an X-light (blue filter) was about 0.1. The saturation magnetization moment, coercive force and squareness ratio of the magnetic recording layer were 4.2 emu/g, 7.3×10$^4$ A/m and 65%, respectively.

3-3) Formation of a sliding layer

Diacetylcellulose (25 mg/M$^2$) and a mixture of $C_6H_{13}CH(OH)C_{10}H_{20}COOC_{40}H_{81}$, (compound a; 6 mg/m$^2$)/$C_{50}H_{101}O(CH_2CH_2O)_{16}H$ (compound b; 9 mg/m$^2$) were applied. It should be noted that this mixture was melted in xylene/propyleneglycolmonomethyl ether (1/1) at 105° C., added to and dispersed in propyleneglycolmonomethyl ether (tenfold amount) at room temperature, and formed into a dispersion (average particle size: 0.01 μm) in acetone before being added. 15 mg/m$^2$ of silica particles (0.3 μm) as a matting agent and 15 mg/rn of aluminum oxide particles (0.15 μm) surface-coated with 3-poly(polymerization degree: 15)oxyethylene-propyloxytrimethoxysilane (15% by weight) as a polishing agent were added. Drying was performed at 115° C. for 6 minutes (all of the rollers and conveyors in the drying zone were maintained at 115° C.). The resultant sliding layer was found to have excellent characteristics. That is, the coefficient of kinetic friction was 0.06 (stainless steel hard ball having a diameter of 5 mmϕ; load: 100 g; speed: 60 cm/minute) and the coefficient of static friction was 0.07 (clip method) The coefficient of kinetic friction between an emulsion surface to be described later and the sliding layer was also excellent and gave a value of 0.12.

The light-sensitive material prepared was cut into a 24 mm-wide and 160 cm-long shape. Further, two 2 mm-square perforations with a spacing of 5.8 mm were formed on one side at 0.7 mm from end of width in the longitudinal direction, and this set of perforations was repeated at an interval of 32 mm. The thus obtained cut samples were accommodated in plastic film cartridges illustrated in FIGS. 1 to 7 of U.S. Pat. No. 5,296,887.

From the side of the magnetic recording layer coated on the sample, FM signals were recorded between the perforations of the light-sensitive material at a feed speed of 100 mm/second by using a head capable of inputting/outputting and having a head gap of 5 μm and a turn number of 2,000.

After the FM signals were recorded, the emulsion surface was given a uniform exposure amount of 1,000 cms on the front, and processed respectively by using the following method and thereafter again encased in the original plastic film cartridge.

The light-sensitive material encased in the cartridge in the manner described above was subjected to tests. Excellent results were also obtained, and thus the effect of the present invention was also confirmed.

As is apparent from what is described above, the present invention can provide a photographic light-sensitive material which enables simple and rapid image formation while minimizing adverse effects on the environment. More specifically, the present invention can provide a color photographic light-sensitive material, which provides good discrimination, sufficient sensitivity and high coloring density as a photographic light-sensitive material, little variation of sensitivity during production, and excellent storability as a product, by using an emulsion having a high content of silver chloride characterized in that light scattering is insignificant even if a simple and rapid process where silver halide is not removed is employed or in that fixing is easy even if a simple process is employed.

What is claimed is:

1. A silver halide color photographic light-sensitive material comprising a support and photographic constituent layers formed thereon, said photographic constituent layers including at least one photographic light-sensitive layer comprising light-sensitive silver halide, said silver halide color photographic light-sensitive material after exposure thereof being put together with a processing material, which comprises a support and constituent layers formed thereon including a processing layer containing at least a base and/or a base precursor, in the presence of water supplied between the light-sensitive material and the processing material in an amount ranging from 1/10 of to the equivalent of an amount which is required for the maximum swelling of the entire coating layers of these materials, so that the layers face each other, and being heated to form a color image in the light-sensitive material, wherein the light-sensitive material contains a compound represented by the following general formula [I] or [II]; at least one silver halide emulsion contained in the light-sensitive material is characterized in that silver halide grains of the emulsion have a silver chloride content of 50 mol % or more;

tabular grains whose principal faces are each made up of a (111) plane account for 50% or more of the total projected area of the silver halide grains of the emulsion;

and the tabular grains have an average grain thickness of 0.3 μm or less; and the grains have an average aspect ratio of 2 to 80:

General formula [I]

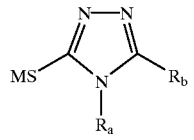

General formula [II]

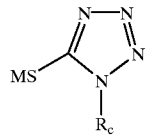

where $R_a$ and $R_b$ are each a group selected from the group consisting of an alkyl group, an alkenyl group, an aralkyl group, an aryl group, and a heterocyclic group with the sum of the carbon atoms of $R_a$ and $R_b$ is 14 or more; M stands for a hydrogen atom, ammonium, or an alkali metal atom; and $R_c$ stands for an aryl group with the sum of the carbon atoms of $R_c$ is 10 or more.

2. A silver halide color photographic light-sensitive material according to claim 1, wherein the average grain thickness is 0.2 μm or less.

3. A silver halide color photographic light-sensitive material according to claim 1, wherein the average grain thickness is 0.1 μm or less.

4. A silver halide color photographic light-sensitive material according to claim 1, wherein the light-sensitive material comprises at least two kinds of silver halide emulsions having light-sensitivity in the same wavelength region and having different average grain projected areas, in which these emulsions are combined such that a ratio of grain numbers per unit area of an emulsion having larger average grain projected area to the grain numbers per unit area of an emulsion having a smaller average grain projected area, is greater than a ratio of the value obtained by dividing the coated silver amount by the $3/2^{nd}$ power of the average grain projected area of emulsion having a larger average grain projected area to that value of an emulsion having a smaller average grain projected area.

5. A silver halide color photographic light-sensitive material according to claim 1, wherein at least part of the grains which constitute the silver halide emulsion, is formed in the presence of at least one of the compounds represented by the following general formula [III], [IV], or [V]:

General formula [III]

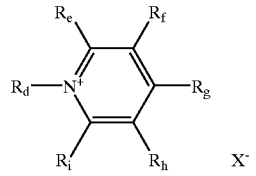

General formula [IV]

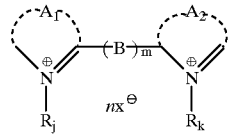

-continued

General formula [V]

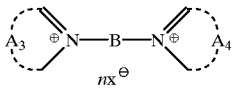

where $R_d$ is a group selected from the group consisting of an alkyl group, an alkenyl group, and an aralkyl group; $R_e$, $R_f$, $R_g$, $R_h$ and $R_i$ are each a group selected from the group consisting of a hydrogen atom and a substituent; the couples $R_e$ and $R_f$, $R_f$ and $R_g$, $R_g$ and $R_h$ as well as $R_h$ and $R_i$ each may form a condensed ring, however, provided that at least one of $R_e$, $R_f$, $R_g$, $R_h$ and $R_i$ is an aryl group; $X^-$ stands for a anion; $A_1$, $A_2$, $A_3$ and $A_4$ may be the same or different and each represent a group of atoms forming a nitrogen-containing heterocyclic ring; B stands for a divalent linking group; m is 0 or 1; $R_j$ and $R_k$ are each an alkyl group; $X^-$ stands for an anion; and n is 0 or 1 with the proviso that n is 0 if an intramolecular salt is formed.

6. A silver halide color photographic light-sensitive material according to claim 1, wherein the light-sensitive material contains in the photographic constituent layers thereof a developing agent and a compound capable of reacting with the oxidized form of the developing agent to form a dye.

7. A silver halide color photographic light-sensitive material according to claim 1, wherein the light-sensitive material contains in the photographic constituent layers thereof at least one compound represented by the following general formula [VI], [VII], [VIII], or [IX] as a developing agent:

General formula [VI]

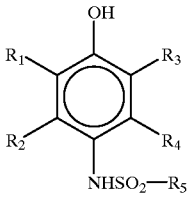

General formula [VII]

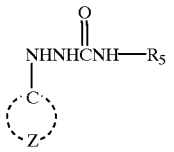

General formula [VIII]

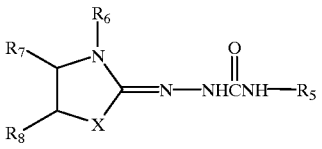

General formula [IX]

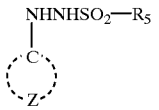

where $R_1$ to $R_4$ are each a group selected from the group consisting of a hydrogen atom, a halogen atom, an alkyl group, an aryl group, an alkylcarboxamido group, an arylcarboxamido group, an alkylsulfonamido group, an arylsulfonamido group, an alkoxy group, anaryloxy group, an alkylthio group, an arylthio group, an alkylcarbamoly group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, and an acyloxy group; $R_5$ is a group selected from the group consisting of an alkyl group, an aryl group, and a heterocyclic group; Z stands for a group of atoms forming an aromatic ring or a heterocyclic aromatic ring and the total of Hammett's constants σ of the substituents is 1 or greater if Z is a benzene ring; $R_6$ stands for an alkyl group; X is a group selected from the group consisting of an oxygen atom, a sulfur atom, a selenium atom, and a trivalent nitrogen atom bearing an alkyl substituent or an aryl substituent; $R_7$ and $R_8$ are each a group selected from the group consisting of a hydrogen atom and a substituent, and $R_7$ and $R_8$ may join with each other to form a double bond or a ring; and each of the compounds represented by the general formulas [VI] to [IX] contains at least one ballast group having 8 or more carbon atoms in order to impart oil solubility to the molecule.

8. A silver halide color photographic light-sensitive material according to claim 1, wherein the average grain thickness is 0.2 μm or less, and the light-sensitive material comprises at least two kinds of silver halide emulsions having light-sensitivity in the same wavelength region and having different average grain projected areas,in which these emulsions are combined such that a ratio of grain numbers per unit area of an emulsion having larger average grain projected area to the grain numbers per unit area of an emulsion having a smaller average grain projected area, is greater than a ratio of the value obtained by dividing the coated silver amount by the $3/2^{nd}$ power of the average grain projected area of emulsion having a larger average grain projected area to that value of an emulsion having a smaller average grain projected area.

9. A silver halide color photographic light-sensitive material according to claim 1, wherein the average grain thickness is 0.2 μm or less, and at least part of the grains which constitute the silver halide emulsion are formed in the presence of at least one of the compounds represented by the following general formula [III], [IV], or [V]:

General formula [III]

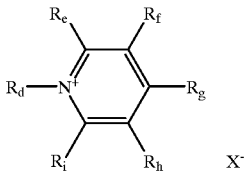

General formula [IV]

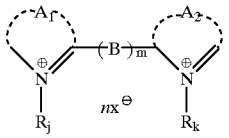

General formula [V]

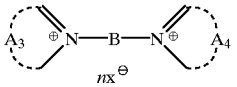

where $R_d$ is a group selected from the group consisting of an alkyl group, an alkenyl group, and an aralkyl group; $R_e$, $R_f$, $R_g$, $R_h$ and $R_i$ are each a group selected from the group consisting of a hydrogen atom and a substituent; the couples $R_e$ and $R_f$, $R_f$ and $R_g$, $R_g$ and $R_h$ as well as $R_h$ and $R_i$ each may form a condensed ring, however, provided that at least one of $R_e$, $R_f$, $R_g$, $R_h$ and $R_i$ is an aryl group; $X^-$ stands for a anion; $A_1$, $A_2$, $A_3$ and $A_4$ may be the same or different and each represent a group of atoms forming a nitrogen-containing heterocyclic ring; B stands for a divalent linking group; m is 0 or 1; $R_j$ and $R_k$ are each an alkyl group; $X^-$ stands for an anion; and n is 0 or 1 with the proviso that n is 0 if an intramolecular salt is formed.

10. A silver halide color photographic light-sensitive material according to claim 1, wherein the average grain thickness is 0.2 μm or less, and the light-sensitive material contains in the photographic constituent layers thereof a developing agent and a compound capable of reacting with the oxidized form of the developing agent to form a dye.

11. A silver halide color photographic light-sensitive material according to claim 1, wherein the average grain thickness is 0.2 μm or less, and the light-sensitive material contains in the photographic constituent layers thereof at least one compound represented by the following general formula [VI], [VII], [VIII], or [IX] as a developing agent:

General formula [VI]

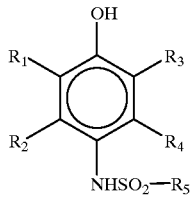

General formula [VII]

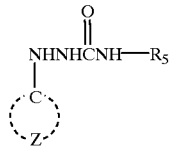

General formula [VIII]

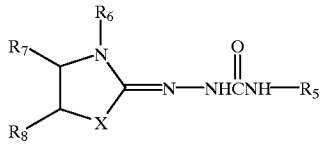

General formula [IX]

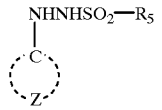

where $R_1$ to $R_4$ are each a group selected from the group consisting of a hydrogen atom, a halogen atom, an alkyl group, an aryl group, an alkylcarboxamido group, an arylcarboxamido group, an alkylsulfonamido group, an arylsulfonamido group, an alkoxy group, an aryloxy group, an alkylthio group, an arylthio group, an alkylcarbamoly group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, and an acyloxy group; $R_5$ is a group selected from the group consisting of an alkyl group, an aryl group, and a heterocyclic group; Z stands for a group of atoms forming an aromatic ring or a heterocyclic aromatic ring and the total of Hammett's constants σ of the substituents is 1 or greater if Z is a benzene ring; $R_6$ stands for an alkyl group; X is a group selected from the group consisting of an oxygen atom, a sulfur atom, a selenium atom, and a trivalent nitrogen atom bearing an alkyl substituent or an aryl substituent; $R_7$ and $R_8$ are each a group selected from the group consisting of a hydrogen atom and a substituent, and $R_7$ and $R_8$ may join with each other to form a double bond or a ring; and each of the compounds represented by the general formulas [VI] to [IX] contains at least one ballast group having 8 or more carbon atoms in order to impart oil solubility to the molecule.

12. A silver halide color photographic light-sensitive material according to claim 1, wherein the average grain thickness is 0.2 μm or less, and the light-sensitive material contains in the photographic constituent layers thereof a developing agent and a compound capable of reacting with the oxidized form of the developing agent to form a dye, and comprises at least two kinds of silver halide emulsions having light-sensitivity in the same wavelength region and having different average grain projected areas, in which these emulsions are combined such that a ratio of grain numbers per unit area of an emulsion having larger average grain projected area to the grain numbers per unit area of an emulsion having a smaller average grain projected area, is greater than a ratio of the value obtained by dividing the coated silver amount by the $3/2^{nd}$ power of the average grain projected area of emulsion having a larger average grain projected area to that value of an emulsion having a smaller average grain projected area.

13. A silver halide color photographic light-sensitive material according to claim 1, wherein at least one of of $R_a$ and $R_b$ in the general formula [I] has at least one aromatic ring.

14. A silver halide color photographic light-sensitive material according to claim 1, wherein $R_c$ in the general formula [II] has an aromatic ring directly linked to a tetrazole ring.

15. A silver halide color photographic light-sensitive material according to claim 5, $R_d$ in the general formula [III] is an aralkyl group.

16. A method for forming a color image, comprising putting the photographic light-sensitive material after image wise exposure thereof together with a processing material, which comprises a support and constituent layers formed thereon including a processing layer containing at least a base and/or a base precursor, face to face in the presence of water supplied between the light-sensitive material and the processing material in an amount ranging from 1/10 of to the equivalent of an amount which is required for the maximum swelling of the entire coating layers of these materials, and heating these materials at 60 to 100° C. for 5 to 60 seconds to form a color image in the light-sensitive material, said silver halide color photographic light-sensitive material comprising a support and photographic constituent layers formed thereon, said photographic constituent layers including at least one photographic light-sensitive layer comprising light-sensitive silver halide, wherein the light-sensitive material contains a compound represented by the following general formula [I] or [II] and where in at least one silver halide emulsion contained in the light-sensitive material is characterized in that silver halide grains of the emulsion have a silver chloride content of 50 mol % or more; that tabular grains whose principal faces are each made up of a (111) plane account for 50% or more of the total projected area of the silver halide grains of the emulsion; that the tabular grains have an average thickness of 0.3 μm or less; and that the grains have an average aspect ratio of 2 to 80, and said processing material comprising a support and constituent layers formed thereon including a processing layer containing at least a base and/or a base precursor:

General formula [I]

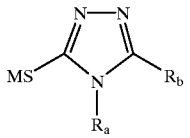

General formula [II]

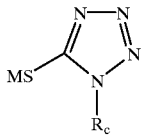

where $R_a$ and $R_b$ are each a group selected from the group consisting of an alkyl group, an alkenyl group, an aralkyl group, an aryl group, and a heterocyclic group with the sum of the carbon atoms of $R_a$ and $R_b$ is 14 or more; M stands for a hydrogen atom, ammonium, or an alkali metal atom; and $R_c$ stands for an aryl group with the sum of the carbon atom of $R_c$ is 10 or more.

* * * * *